US006200043B1

(12) United States Patent
Inoue et al.

(10) Patent No.: US 6,200,043 B1
(45) Date of Patent: Mar. 13, 2001

(54) SHEET FEEDING APPARATUS AND IMAGE FORMING APPARATUS HAVING SUCH SHEET FEEDING APPARATUS

(75) Inventors: Hiroyuki Inoue; Koh Hasegawa, both of Yokohama; Shinya Asano; Takashi Nojima, both of Tokyo; Akira Kida, Kawasaki; Takeshi Iwasaki, Yokohama; Noriko Kawasaki, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/290,402

(22) Filed: Apr. 13, 1999

(30) Foreign Application Priority Data

| | | |
|---|---|---|
| Apr. 15, 1998 | (JP) | 10-105214 |
| Apr. 15, 1998 | (JP) | 10-105238 |
| Apr. 15, 1998 | (JP) | 10-105251 |
| Apr. 15, 1998 | (JP) | 10-122814 |

(51) Int. Cl.[7] ..... B41J 3/36; B41J 29/02
(52) U.S. Cl. ..... 400/88; 400/663; 400/693
(58) Field of Search ..... 400/88, 624, 663, 400/664, 668, 692, 693; 347/108, 138, 152, 222, 245, 263

(56) References Cited

U.S. PATENT DOCUMENTS

| | | | | |
|---|---|---|---|---|
| 4,904,100 | | 2/1990 | Enix | 400/613 |
| 4,962,430 | * | 10/1990 | Hiroki et al. | 400/88 |
| 5,209,583 | * | 5/1993 | Lewis et al. | 400/88 |
| 5,291,249 | * | 3/1994 | Lee | 347/152 |
| 5,308,173 | * | 5/1994 | Amano et al. | 400/88 |
| 5,312,196 | * | 5/1994 | Hock et al. | 400/88 |
| 5,331,580 | * | 7/1994 | Miller et al. | 400/88 |
| 5,348,283 | | 9/1994 | Yanagi et al. | 271/127 |
| 5,370,380 | | 12/1994 | Suzuki et al. | 271/21 |
| 5,423,529 | | 6/1995 | Saito et al. | 271/127 |
| 5,485,991 | | 1/1996 | Hirano et al. | 271/121 |
| 5,620,174 | | 4/1997 | Taniguro et al. | 271/10 |
| 5,648,808 | | 7/1997 | Yanagi et al. | 347/104 |
| 5,672,019 | | 9/1997 | Hiramatsu et al. | 400/624 |
| 5,850,243 | * | 12/1998 | Kinoshita et al. | 400/88 |

FOREIGN PATENT DOCUMENTS

| | | | | |
|---|---|---|---|---|
| 0223674 | * | 6/1985 | (DE) | 400/88 |
| 0 492 638 | | 7/1992 | (EP) . | |
| 4-303336 | | 10/1992 | (JP) . | |
| 6-183582 | | 7/1994 | (JP) . | |
| 9-194085 | | 7/1997 | (JP) . | |

* cited by examiner

*Primary Examiner*—Eugene Eickholt
(74) *Attorney, Agent, or Firm*—Fitzpatrick, Cella, Harper & Scinto

(57) ABSTRACT

The present invention provides a sheet feeding apparatus and an image forming apparatus, in which excellent mounting ability is achieved and damage and dislodging of a recording apparatus can be prevented. A mounting opening for mounting the recording apparatus is formed in a side surface of an apparatus body comprised of an ASF upper case and an ASF base. When the recording apparatus is mounted, after the recording apparatus is rested on a recording apparatus supporting portions for supporting the recording apparatus for shifting movement in a mounting direction, the recording apparatus is guided along the recording apparatus supporting portions in the mounting direction. By providing an eaves portion substantially in parallel with the recording apparatus supporting portions, an upward movement of the recording apparatus is regulated when and after the recording apparatus is mounted.

36 Claims, 36 Drawing Sheets

[SHEET FEEDING FLOWCHART OF PRINTER]

[MAIN FLOWCHART OF ASF]

[SHEET FEEDING FLOWCHART C2 OF ASF]

[ INITIALIZING FLOWCHART C3 OF ASF ]

[TYPE OF DEVICE DISCRIMINATING FLOWCHART C1 OF PRINTER]

[SHEET FEEDING FLOWCHART OF PRINTER]

[SHEET FEEDING FLOWCHART C2 OF ASF]

| | TYPE OF SHEET | DRIVING SPEED ON REGISTRATION | PULSE NUMBER $P_5$ ON REGISTRATION |
|---|---|---|---|
| $T_1$ | ORDINARY PAPER | MIDDLE SPEED | SMALL |
| $T_2$ | POSTCARD | MIDDLE SPEED | LARGE ($P_5$=Pmax−Pc) |
| $T_3$ | ENVELOPE | LOW SPEED | MIDDLE |
| $T_4$ | GLOSSY PAPER | LOW SPEED | SMALL |
| $T_5$ | NO DESIGNATION | MIDDLE SPEED | LARGE ($P_5$=Pmax−Pc) |

SHEET FEEDING APPARATUS AND IMAGE FORMING APPARATUS HAVING SUCH SHEET FEEDING APPARATUS

BACKGROUND OF THE INVENTION

1. Field of the Invention

The present invention relates to a sheet feeding apparatus for feeding a recording medium to a recording apparatus and an image forming apparatus having such a sheet feeding apparatus, and more particularly, it relates to mounting of the recording apparatus.

2. Related Background Art

Similar to many other equipments, compactness and light-weighted requirements for a recording apparatus (referred to as "printer" hereinafter) have been sought greatly, and, thus, printers have been made compact and light-weighted.

During realization of compactness, as disclosed in Japanese Patent Application Laid-open No. 6-183582, there has been proposed a technique in which a printer body portion for recording an image is separated from an auto sheet feeder (referred to as "ASF" hereinafter) portion (sheet feeding apparatus) for stacking sheets thereon and feeding the stacked sheets (recording media) one by one to an image forming portion of the printer, so that the ASF can be detachably mounted to the printer.

Further, there has also been proposed an ASF which can detachably be mounted, from outside, to a printer having a plurality of sheet feeding openings or a printer in which only manual sheet insertion is permitted, as well as the compact printer.

In such a conventional ASF, the ASF essentially has a concept that it is to be mounted to the printer, and, thus, the printer is a principal part on the desk exceedingly. That is to say, since the conventional ASF cannot perform a function for automatically feeding the sheet by itself only, the ASF can have any form. For example, the only ASF may not be operated by itself or may not be operated in a condition that recording media (referred to as "sheets" hereinafter) are set therein.

However, recently, a mobile field has been noticed to enhance maneuverability, and, thus, portable ability has been requested for printers. To this end, for the ASFs, there has been requested a function for connection to the portable printer on the desk in a more preferable condition, i.e., a function in which a so-called mobile printer having excellent portable ability can be used as a desk-top printer having excellent sheet feeding ability on the desk.

Further, in an ASF to be mounted to the printer from outside, for example, as disclosed in Japanese Patent Application Laid-open No. 4-303336, a drive transmitting means (such as a gear) exposed out of the ASF is connected to a drive transmitting means exposed out of the printer so that a motor disposed within the printer can be used as a drive source for a sheet feed roller for feeding the sheets one by one.

Further, in the ASF to be mounted to the printer from outside, for example, as disclosed in Japanese Patent Application Laid-open No. 9-194085, an apparatus incorporating therein a motor as a drive source for a sheet feed roller has been proposed. In this case, a control means disposed within the printer imparts a control signal to a motor disposed within the ASF through electric contacts between the printer and the ASF to rotate the motor of the ASF.

FIG. 39 is a perspective view showing a printer body of a printer 1000 disclosed in the above Japanese Patent Application Laid-open No. 4-303336 and an ASF to be mounted to the printer body from outside, in a separated condition.

The ASF 1047 has left and right hooks 1016, 1017 to be inserted into hook fitting holes 1103*y*, 1103*z* of the printer body 1101, and the left and right hooks 1016, 1017 can be rotated by sliding operation portions 1016*c* (only one is shown) provided on left and right side surfaces of the ASF 1047.

The left and right hooks 1016, 1017 inserted into the hook fitting holes 1103*y*, 1103*z* are rotated by sliding the left and right operation portions 1016*c* in directions shown by the arrows L1016X, L1017X to engage the ASF 1047 with the printer body 1101, thereby securing the ASF to the printer body.

The connection between the ASF 1047 and the printer body 1101 by means of the left and right hooks 1016, 1017 simultaneously produces connection of sheet paths 1056, 1101*y* and a gear 1047*z* constituting a sheet route between the ASF 1047 and the printer body 1101.

When the ASF 1047 is dismounted from the printer body 1101, the left and right hooks 1016, 1017 are rotated in directions opposite to the directions for engagement between the ASF 1047 and the printer body 1101 by sliding the left and right operation portions 1016*c* in directions opposite to the directions shown by the arrows L1016X, L1017X, thereby separating the ASF 1047 from the printer body 1101.

However, in such a mounting/dismounting mechanism between the printer body 1101 and the ASF 1047, the operator or user must pay attention to damage of positioning means and connectors (connection portions) in order to convey the sheet from the ASF 1047 to the printer body 1101 without any sheet jam.

Further, since the two hooks 1016, 1017 are independently rotated, the hooks 1016, 1017 must be rotated independently in order to separate the ASF 1047 from the printer body 1101, thereby worsening operability. Further, when the ASF 1047 is connected to the printer body 1101, it cannot be ascertained whether such connection is effected properly.

In addition, in such a mounting/dismounting mechanism between the printer body and the ASF, when the ASF is connected to the printer body, there arose a problem that a relative positional relationship becomes incorrect.

There also arose a problem that separation between the printer body and the ASF cannot be preformed smoothly.

Further, when the ASF is connected to the printer body by such a mounting/dismounting mechanism between, due to the relative positional error, the sheet cannot flow from the ASF to the printer body smoothly.

In addition, since the separation between the printer body and the ASF is not ensured completely, the printer body and/or the ASF may be damaged.

SUMMARY OF THE INVENTION

The present invention aims to eliminate the above-mentioned conventional drawbacks, and an object of the present invention is to provide an ASF (sheet feeding apparatus) and an image forming apparatus having such an ASF, in which excellent mounting ability can be achieved and damage and disengagement of a mounted printer (recording apparatus) can be prevented so that the printer (recording apparatus) having excellent portable ability can be used properly as a desk-top printer having excellent sheet feeding ability on the desk.

The present invention provides a sheet feeding apparatus to which a recording apparatus capable of recording an image on a recording medium by itself can detachably be mounted and which is adapted to feed the recording medium to the mounted recording apparatus, and comprising a recording apparatus supporting portion for supporting the recording apparatus for movement in a mounting direction when the recording apparatus is mounted.

In the present invention, the sheet feeding apparatus may further comprise an eaves portion disposed in parallel with the recording apparatus supporting portion and adapted to regulate an upper shifting movement of the recording apparatus when and after the recording apparatus is mounted.

In the present invention, a length of the recording apparatus supporting portion in the mounting direction may be a length capable of forming a space having a predetermined mounting direction length below the recording apparatus when the recording apparatus is mounted.

In the present invention, the length L2 of the recording apparatus supporting portion in the mounting direction for forming the space below the recording apparatus may have the following relationship with respect to a length L1 of the recording apparatus in the mounting direction:

$$L1/2 \leqq L2 \leqq L1-15 \text{ mm}.$$

In the present invention, the relationship "$L1/2 \leqq L2 \leqq L1-15$ mm" may be satisfied at at least a part of the recording apparatus supporting portion in a direction perpendicular to the mounting direction.

In the present invention, a length L3 of the eaves portion in the mounting direction may have the following relationship with respect to the length L1 of the recording apparatus in the mounting direction:

$$L1/4 \leqq L3 \leqq L1/2.$$

In the present invention, the relationship "$L1/4 \leqq L3 \leqq L1/2$" may be satisfied at at least a part of the eaves portion in a direction perpendicular to the mounting direction.

In the present invention, the recording apparatus supporting portion may have sliding portions for slidingly contacting with the recording apparatus at both ends thereof in the direction perpendicular to the mounting direction, and a stepped portion may be provided between the sliding portions.

In the present invention, the stepped portion may have a position and depth so that the recording apparatus supporting portion is not contacted with projections protruded from a lower surface of the recording apparatus when the recording apparatus is shifted in the mounting direction.

The present invention further provides an image forming apparatus including a recording apparatus and a sheet feeding apparatus to which the recording apparatus can detachably be mounted and which is adapted to feed a recording medium to the mounted recording apparatus, wherein the sheet feeding apparatus is the aforementioned sheet feeding apparatus.

As is in the present invention, when the recording apparatus is mounted, after the recording apparatus is rested on the recording apparatus supporting portion for shifting movement in the mounting direction, the recording apparatus is shifted along the recording apparatus supporting portion. Further, by the eaves portion disposed substantially in parallel with the recording apparatus supporting portion, the upper movement of the recording apparatus is regulated.

Further, the present invention aims to eliminate the above-mentioned conventional drawbacks, and an object of the present invention is to provide a sheet feeding apparatus and an image forming apparatus, in which mounting and dismounting between a body of the apparatus and a recording apparatus can easily be performed.

A further object of the present invention is to provide a sheet feeding apparatus and an image forming apparatus, in which non-detachment between a circular hole and a first pin is prevented, and positioning means and electrical connecting portions can be prevented from being damaged.

To achieve the above object, the present invention provides a sheet feeding apparatus having an apparatus body to which a recording apparatus capable of recording an image on a sheet by itself can detachably be mounted and adapted to feed the sheet to the recording apparatus mounted to the apparatus body, and comprising a connecting means including an elongated hole formed in one of the recording apparatus and the apparatus body and adapted to connect the recording apparatus to the apparatus body, a pin provided on the other of the recording apparatus and the apparatus body and adapted to be connected to the elongated hole, and a connection releasing member provided on either one of the recording apparatus or the apparatus body and biased toward a connection releasing direction, and wherein an electrical connecting portion of the recording apparatus or the apparatus body is disposed at a pin side between the connection releasing member and the pin.

In the present invention, the sheet feeding apparatus may further comprise a lock means provided on either one of the recording apparatus or the apparatus body and adapted to be connected to the other of the recording apparatus and the apparatus body, and be characterized in that, after the connection between the recording apparatus and the apparatus body effected by the lock means is released, the connection releasing member is operated toward the connection releasing direction, thereby releasing the connection between the elongated hole and the pin.

In the present invention, the sheet feeding apparatus may further comprise a protruded member at a side of connection between the elongated hole and the pin, and, after the connection between the recording apparatus and the apparatus body effected by the lock means is released, the connection releasing member is operated toward the connection releasing direction, thereby releasing the connection between the elongated hole and the pin and operating the protruded member.

Further, the present invention provides a sheet feeding apparatus having an apparatus body to which a recording apparatus capable of recording an image on a sheet by itself can detachably be mounted and adapted to feed the sheet to the recording apparatus mounted to the apparatus body, and comprising connecting means including a circular hole and an elongated hole formed in one of the recording apparatus and the apparatus body and adapted to connect the recording apparatus to the apparatus body, first and second pins provided on the other of the recording apparatus and the apparatus body and adapted to be connected to the circular hole and the elongated hole, respectively, and first and second connection releasing members provided in the vicinity of the first and second pins and biased toward a connection releasing direction, and wherein the connecting means is designed so as to release the connection between the circular hole and the first pin before the connection between the elongated hole and the second pin is released, and electrical connecting portions of the recording apparatus and the apparatus body are disposed in the vicinity of the second pin between the first and second pins.

In the present invention, a ratio between a distance X1 from the second pin to the electrical connecting portions and a distance X2 from the second pin to the first connection releasing member may be 0.5 or less.

Further, according to the present invention, the second connection releasing member may be spaced apart from the connecting position between the circular hole and the first pin more than the electrical connecting portions.

The present invention further provides an image forming apparatus comprising the aforementioned sheet feeding apparatus, and a recording apparatus for recording an image on the sheet conveyed from the sheet feeding apparatus.

With the arrangement as mentioned above, the electrical connecting portions of the recording apparatus and the apparatus body are disposed in the vicinity of the pin rather than the connection releasing member between the pin and the connection releasing member, and the connection between the recording apparatus and the apparatus body is released by using the connecting position between the elongated hole and the pin as a pivot center.

Further, the electrical connecting portions of the recording apparatus and the apparatus body are disposed in the vicinity of the second pin between the first and second pins, and the connection between the circular hole and the first pin is released before the connection between the elongated hole and the second pin is released.

A still further object of the present invention is to provide an image forming apparatus in which connection and disconnection between a sheet feeding apparatus and a recording apparatus can be effected by a simple operation.

A further object of the present invention is to provide an image forming apparatus in which connection between a sheet feeding apparatus and a recording apparatus can be ascertained.

Further, the present invention aims to eliminate the above-mentioned conventional drawbacks, and an object of the present invention is to provide an image forming apparatus comprising a sheet feeding apparatus for feeding a sheet and a recording apparatus for recording an image on the sheet fed by the sheet feeding apparatus, the sheet feeding apparatus and the recording apparatus being capable of being separated from each other, and wherein one of the sheet feeding apparatus and the recording apparatus has a plurality of lock members supported for shifting movement, and an operation member engaged by at least one lock member and supported for shifting movement, so that the plurality of lock members are shifted integrally or collectively by manipulating the operation member, and further wherein the sheet feeding apparatus or the recording apparatus not having the lock members has a plurality of engagement portions with which the plurality of lock members are engaged, so that the sheet feeding apparatus and the recording apparatus are interconnected by engaging the lock members with the engagement portions, and engagement between the lock members and the engagement portions is released by shifting the lock members via the operation member.

In this case, each lock member may be a pawl-shaped member and each engagement portion may be a hole. Further, the lock member may be rotatably supported.

Alternatively, the lock members and the operation member may be provided on the sheet feeding apparatus and the engagement portions may be provided in the recording apparatus.

In this case, the sheet feeding apparatus may have a horizontal guide surface for determining a shifting direction of the recording apparatus when the recording apparatus is mounted, and the lock members may be arranged to protrude upwardly from the guide surface so that the lock members are shifted downwardly by lowering the operation member thereby to release the engagement between the lock members and the engagement portions.

Further, the lock members may be biased by an elastic member toward a direction along which the lock members are engaged by the engagement portions, so that, when the lock members are engaged by the engagement portions, the elastic member shifts the operation member via the lock members. In this case, the elastic member may comprise a spring such as a coil spring.

The sheet feeding apparatus may have a protruded portion connected to the operation member and supported for shifting movement substantially in a horizontal direction, so that the recording apparatus is shifted in the horizontal direction by shifting the protruded portion substantially in the horizontal direction by lowering the operation member. In such a case, the shifting movement of the protruded portion substantially in the horizontal direction may be effected after the shifting movement of the lock member, thereby separating the recording apparatus from the sheet feeding apparatus.

The lock members and the operation member may be provided on the recording apparatus and the engagement portions may be provided in the sheet feeding apparatus.

The other object of the present invention is to provide a recording apparatus comprising a mount/dismount connection mechanism for positioning and connecting a printer body and an ASF and for easily disconnecting the apparatuses from each other, and a printer body and an ASF which can positively be mounted and dismounted with respect to each other by such a mechanism.

The above object is achieved by the following means:

A mount/dismount connection mechanism comprising connection means for detachably interconnecting the apparatuses, connection positioning means in which a circular hole and an elongated hole formed in one of the apparatuses are engaged by a pair of protruded shafts provided on the other apparatus to determine a relative connection position between the apparatuses, connection releasing means for releasing a connecting condition of the connection means interconnecting the apparatuses, and spacing means for biasing the interconnected apparatuses toward a separating direction, and wherein the connection means has a pair of lock members for interconnecting the apparatuses in the vicinity of the elongated hole and the circular hole and the lock member disposed in the vicinity of the circular hole releases the connection before the lock member disposed in the vicinity of the elongated hole releases the connection.

A mount/dismount connection mechanism in which the pair of lock members are provided on the other apparatus, and an engagement amount between the lock member disposed in the vicinity of the circular hole and the one apparatus is smaller than an engagement amount between the lock member disposed in the vicinity of the elongated hole and the one apparatus.

A mount/dismount connection mechanism in which the spacing means has a biasing member biased to be protruded in the vicinity of the circular hole rather than the elongated hole in a condition that the apparatuses are interconnected.

A mount/dismount connection mechanism in which the spacing means has a pair of biasing members biased to be protruded in the vicinity of the circular hole and the elongated hole in a condition that the apparatuses are interconnected.

A recording apparatus in which the other apparatus is a sheet feeding apparatus for feeding the sheet and the one apparatus is a body of the recording apparatus for forming an image on the sheet fed from the sheet feeding apparatus, and sheet feeding apparatus and the body of the recording apparatus are interconnected by any one of the above-mentioned mount/dismount connection mechanisms.

The connection between the apparatuses is positively positioned by engagement between the circular/elongated holes and the pair of protruded shaft of the connection positioning means and is effected by connection engagement of the connection means.

The releasing of the connection between the apparatuses is effected by releasing the connection between the apparatuses by manipulating the connection releasing means.

In this case, since the engagement amount of the lock member disposed in the vicinity of the circular hole is smaller than the engagement amount of the lock member disposed in the vicinity of the elongated hole, the engagement of lock member disposed in the vicinity of the circular hole is firstly released to separate the apparatuses from each other, thereby preventing non-detachment between the circular hole and the protruded shaft. Thus, the apparatuses can be separated from each other smoothly.

Since the biasing member of the spacing means presses the vicinity of the circular hole from which the protruded shaft is hard to be disengaged, the apparatuses can be separated from each other positively and smoothly.

Alternatively, since the pair of biasing members of the spacing means press the vicinity of the circular hole and the elongated hole and the lock member disposed in the vicinity of the circular hole is firstly released prior to the lock member disposed in the vicinity of the elongated hole, the non-detachment between the circular hole and the protruded shaft is prevented, thereby separating the apparatuses from each other smoothly.

Since the printer body and the ASF are positively positioned by the engagement between the circular/elongated holes and the pair of protruded shaft of the connection positioning means and thereafter the circular and the protruded shaft are separated from each other smoothly without non-detachment, the printer body and the ASF are not damaged.

DETAILED DESCRIPTION OF THE PREFERRED EMBODIMENTS

The preferred embodiments of the present invention will now be fully described hereinafter with reference to the accompanying drawings.

First of all, a first embodiment of the present invention will be described.

Figure 1:
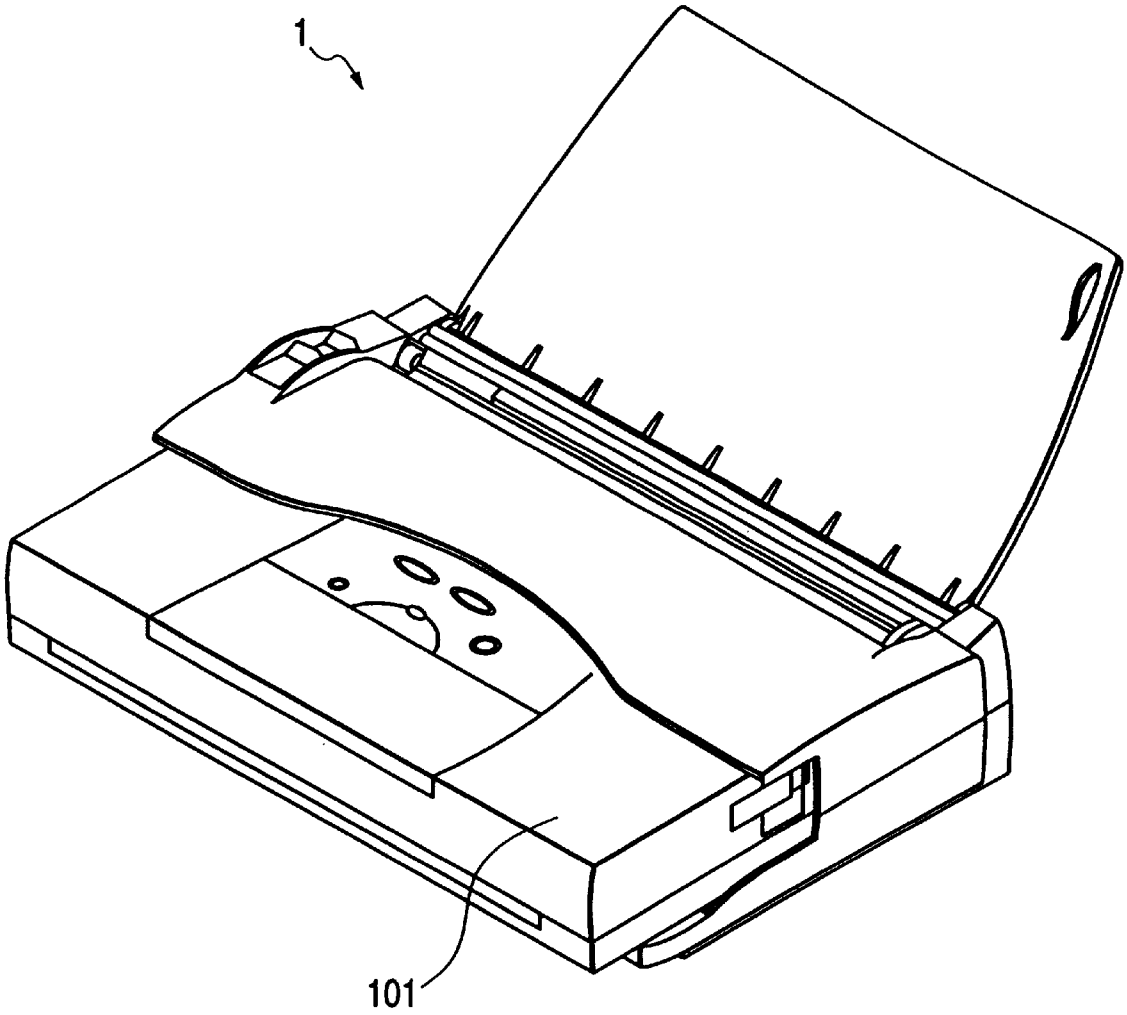
FIG. 1 is a perspective view showing a condition that a printer is mounted to an ASF according to a first embodiment of the present invention.
Figure 2:
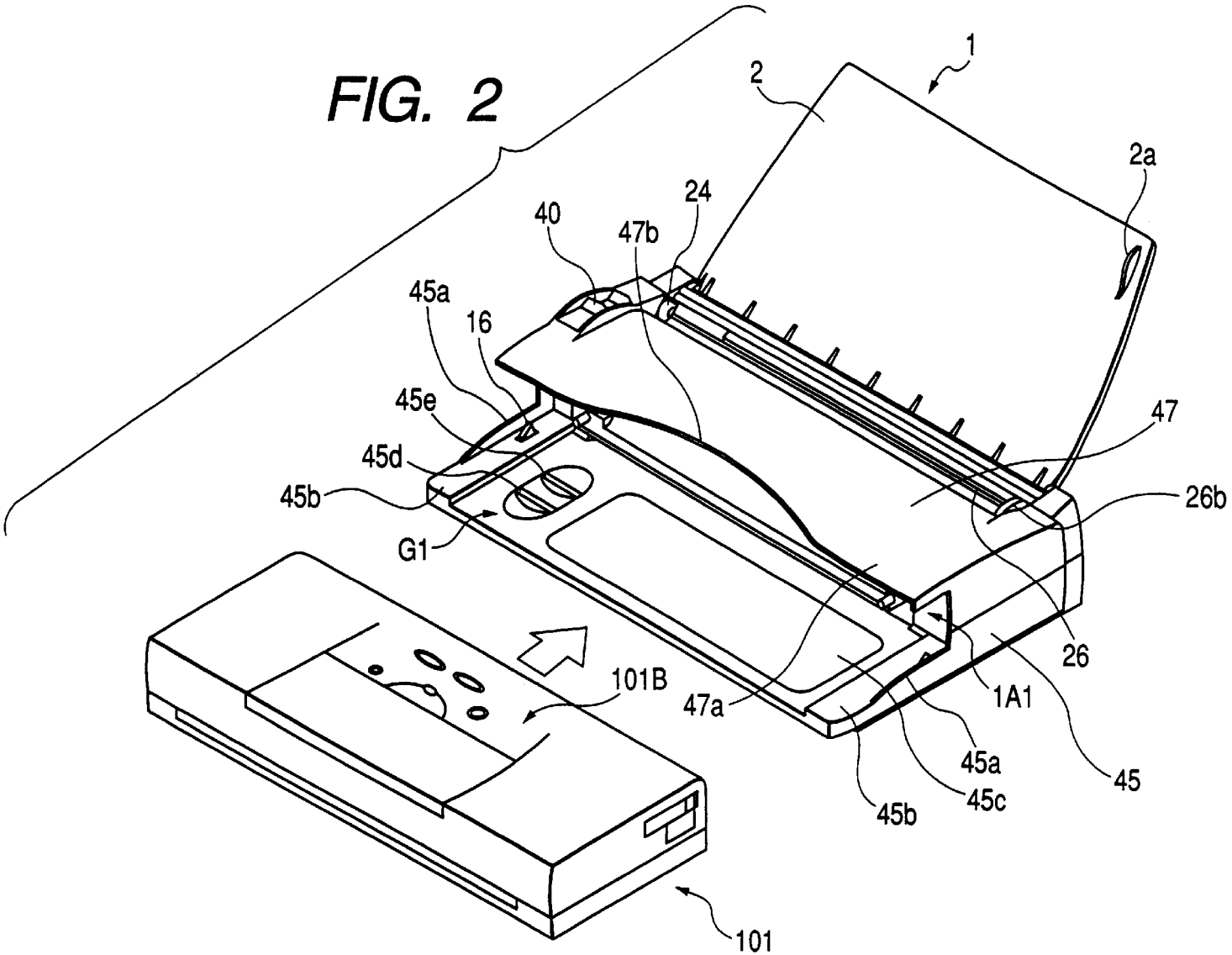
FIG. 2 is a view showing a condition that the printer is mounted to the ASF.
Figure 3:
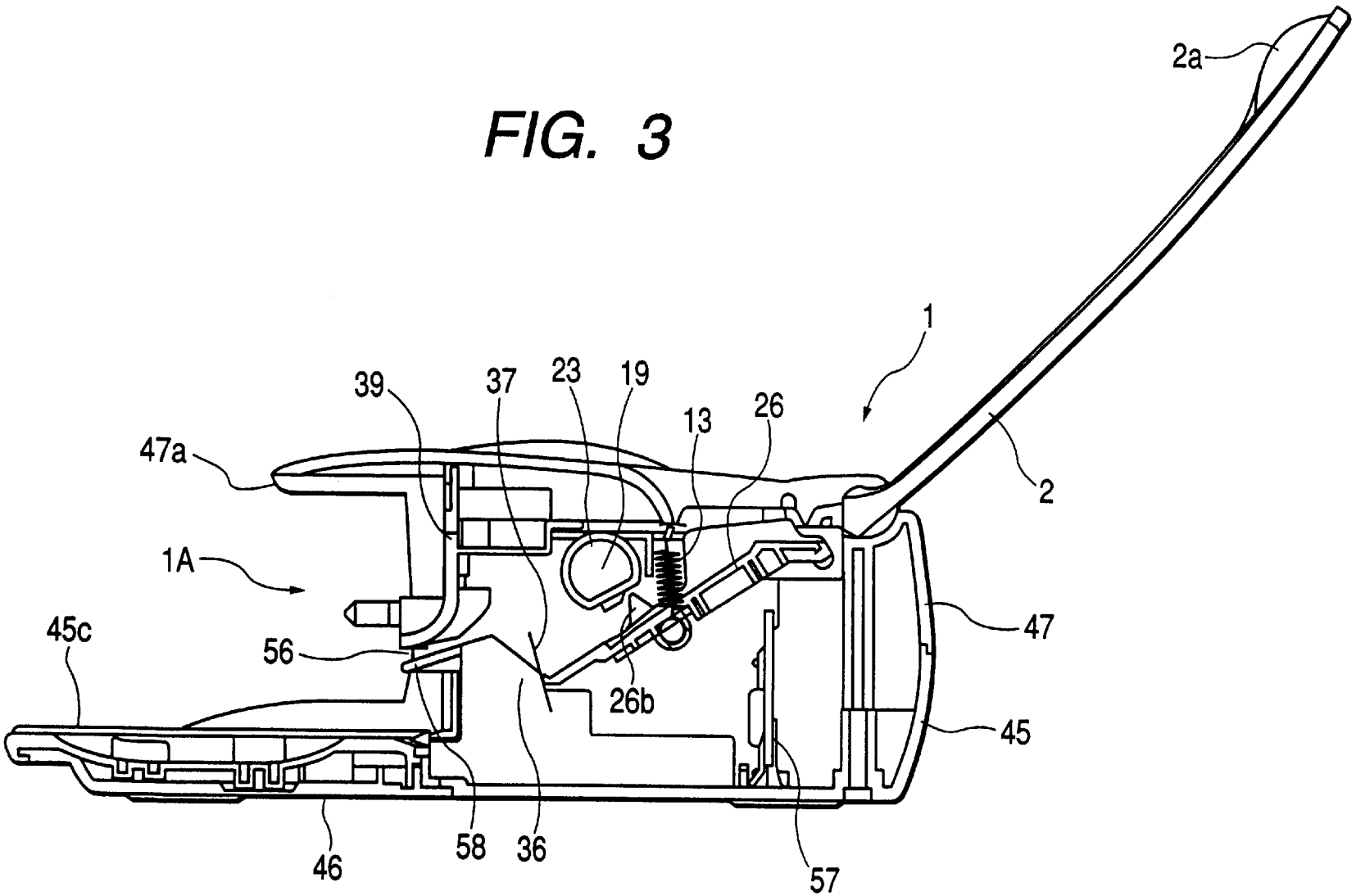
FIG. 3 is a sectional view of the ASF.
Figure 4:
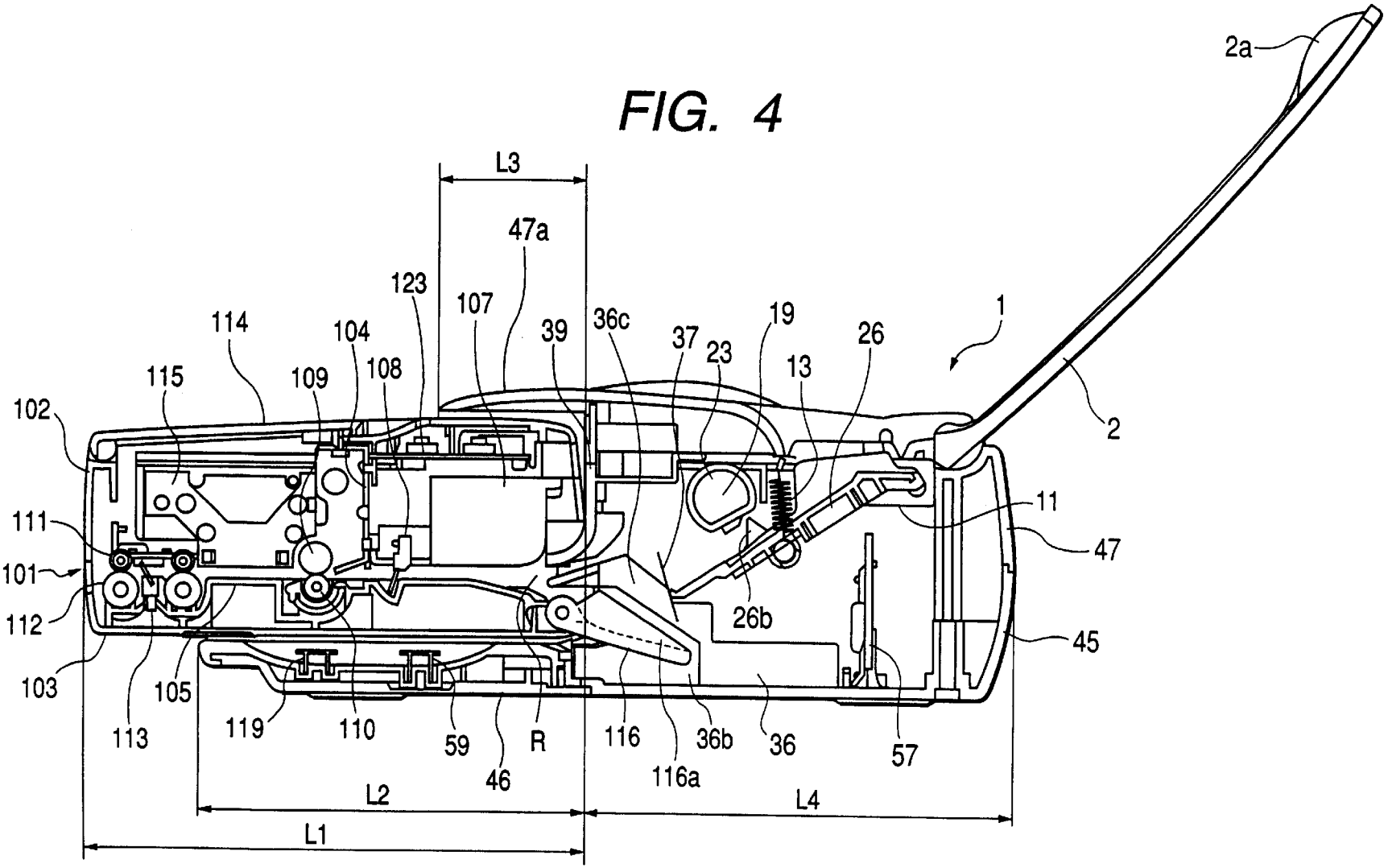
FIG. 4 is a sectional view of the ASF to which the printer is mounted.

FIG. 1 is a perspective view showing a condition that a printer is mounted to an ASF according to a first embodiment of the present invention, FIG. 2 is a view showing a condition that the printer is mounted to the ASF, FIG. 3 is a sectional view of the ASF, and FIG. 4 is a sectional view of the ASF to which the printer is mounted.

In FIGS. 1 to 4, a printer 101 can be detachably mounted to an ASF 1. The ASF 1 and the printer 101 constitutes an image forming apparatus.

The printer 101 is a so-called compact and portable mobile printer having a battery, and, in the illustrated embodiment, the ASF is not incorporated into the printer 101, and the printer itself can effect only manual sheet insertion. By adopting this arrangement, the printer 101 itself can be made compact, simpler and cheaper to provide an optimum form as the mobile printer. Of course, even when the printer 101 incorporates a small ASF, the present invention can be applied to such printer.

Incidentally, as examples that such a compact and portable printer 101 is used, the printer can be used particularly outdoors, in a vehicle or in an office to which the user visited. In such a case, since the number of recording sheets to be required is relatively small, the manual sheet insertion or the incorporated ASF having small capacity can cope with small number of recording sheets. However, if the printer 101 is used in the user's office, it may be required that a relatively large number of various kinds of sheets are used.

To meet such requirement, the ASF 1 separated from the printer 101 is very useful. That is to say, the ASF 1 is of so-called desk-top type which can always be rested on the desk in the office, and, by mounting the printer 101 to the ASF 1, the printer 101 has a feature of the desk-top printer. Incidentally, the ASF 1 has a construction which will be described later, so that various kinds of recording media such as post cards, envelopes, plastic films and cloth can automatically be fed.

As such, in the illustrated embodiment, by mounting the very compact mobile printer itself to the ASF of the present invention, a printer having excellent added value which can be used as the desk-top printer having high performance can be provided. In this case, the ASF 1 also acts as a storing container for the printer 101 when the printer is not used as a printer unit itself and is said to have a role of a so-called docking station where the automatic sheet feeding ability is added to the printer.

When the printer 101 is not mounted, the ASF 1 according to the present invention can stably be self-contained as the ASF itself, and, further, in a condition that the sheets are contained within the ASF, the printer 101 can be separated from the ASF. With this arrangement, the user can achieve a stand-by condition as the desk-top printer only by mounting the discrete printer 101 to the self-contained ASF 1. This means that the ASF functions as the docking station very convenient for the user.

When it is desired that the printer 101 is used properly as the mobile printer or as the desk-top printer, it is important that the ASF 1 and the printer 101 can easily be mounted and dismounted relative to each other. The reason is that the user who dismounts the printer 101 from the ASF 1 and transports the separated printer and re-mounts the printer to the ASF every day must expend troublesome effort if the mounting and dismounting of the printer is complicated and time-consumed.

Thus, in the illustrated embodiment, as shown in FIG. 3, a mounting opening (referred to as "opening" hereinafter) 1A for mounting the printer 101 is provided in a front surface of the ASF 1. Further, a sheet passing path of the printer 101 is substantially horizontal (horizontal path), so that a sheet path which will be described later can be formed by shifting a sheet feeding side of the printer 101 toward the ASF 1 to be inserted into the opening 1A of the ASF 1.

That is to say, in the illustrated embodiment, the printer 101 having the horizontal path is inserted into the ASF 1 substantially in the horizontal direction thereby to mount the printer to the ASF. When the printer 101 is inserted into the ASF substantially in the horizontal direction, the printer 101 is automatically secured to the ASF 1 (A securing method for securing the printer to the ASF when the printer 101 is mounted to the ASF 1 will be described later). When the printer 101 is separated from the ASF 1, the securing between the printer 101 and the ASF 1 is released only by pushing a push lever 40 provided on an upper surface of the ASF, so that the printer 101 is pushed out of the front surface of the ASF 1.

With this arrangement, the user can effect the mounting and dismounting between the printer 101 and the ASF 1 so that the printer can be used properly as the mobile printer or as the desk-top printer.

In the illustrated embodiment, in order to facilitate the mounting and dismounting, a bottom surface of the opening 1A is formed on a front part of an ASF base 45 for forming a body of the ASF together with an ASF upper case 47, and there is provided a table portion (recording apparatus supporting portion) 45*c* for supporting the printer 101 for shifting movement in a mounting direction when the printer 101 is mounted.

When the printer 101 is mounted to the ASF 1, first of all, the printer 101 is rested on the table portion 45*c*. In this case, the user grips upper and lower surfaces of a front (sheet discharging side) central portion of the printer 101 by his one hand so that the printer 101 is slowly rested on the table portion 45*c* from a rear side (sheet feeding side) thereof (the printer 101 may be gripped by both hands of the user).

Then, as the printer 101 rested on the table portion 45*c* is pushed by the hand toward the rear side (mounting direction) shown by the arrow in FIG. 2, both side surfaces of the printer 101 is directed to positioning bosses (described later) while being guided by printer side guide portions 45*a* provided on both side ends of the table portion 45*c*, with the result that the printer is positioned by fitting positioning holes (described later) of the printer 101 onto the positioning bosses.

In this case, it is merely required that the printer 101 be rested on substantially a central portion of the table portion 45*c* and be pushed rearwardly, but troublesome positioning is not required. As such, when the printer 101 is mounted to the ASF 1, since the printer 101 may be rested on the table portion 45*x* and then be pushed along the table portion 45*c*, operability and mounting ability can be improved considerably.

Incidentally, as shown in FIG. 2, printer sliding portions 45*b* on which a rear surface of the printer is slid when the printer 101 is pushed are provided on both ends of the table portion 45*c* in a direction perpendicular to the printer mounting direction. Further, a stepped portion G1 is defined between the printer sliding portions 45*b*.

The printer 101 is provided at its bottom with projections (for example, rubber legs (not shown) for increasing resistance to movement of the printer 101 caused by an external force when the printer itself is used on the desk). However, when the printer 101 is mounted to the ASF 1, if such rubber legs are contacted with the table portion 45*c*, a force for pushing the printer 101 into the ASF is greatly increased, thereby worsening the operability.

To avoid this, the stepped portion G1 formed between the printer sliding portions 45*b* prevents the contact between the rubber legs and the table portion 45*c*. The stepped portion G1 has a depth greater than lengths of the rubber legs to prevent the contact between the rubber legs and the table portion 45*c*.

By providing such a stepped portion G1, since the rubber legs do not contact with the table portion 45*c*, the user can easily push the printer 101 by his hand without requiring the great force, thereby improving the operability and mounting ability.

On the other hand, an eaves portion 47*a* which forms a part of the opening 1A and disposed substantially in parallel with the table portion 45*c* is formed on the ASF upper case 47. The eaves portion 47*a* cooperates with the table portion 45*c* to form a pocket for receiving the printer 101. The pocket so formed informs the user of a direction along which the printer 101 is pushed substantially in parallel with the ASF 1 so that the user can push the printer 101 only along this direction.

This direction coincides with a connecting direction of connectors for electrically connecting the printer 101 and the ASF 1 (described later), so that the connectors can be interconnected during the insertion of the printer 101 into the ASF 1. With this arrangement, since an additional operation for connecting the connectors is not required, operability is improved, and, when the printer 101 is mounted to the ASF 1, since the printer cannot be inserted from different directions, the connectors can be prevented from being damaged due to abnormal interference therebetween.

After the printer 101 was mounted, if a front portion (sheet discharging side) of the printer 101 is subjected to an upward force, the eaves portion 47*a* abuts against the printer 101 to regulate upward movement of the printer 101. Thus, even if the printer 101 is forcibly shifted upwardly with respect to the ASF 1, the upward movement of the printer 101 can be prevented, thereby preventing damage of the mounting portion and dismounting due to the upward movement of the printer 101.

Incidentally, in the illustrated embodiment, the eaves portion 47*a* is greatly protruded at its both sides thereof to form a central recess 47*b*. By providing such a recess 47*b*, an operation portion 101B (including a power source switch, for example) provided on the printer 101 can be exposed to outside.

When a clearance between the eaves portion 47*a* and the upper surface of the printer is selected to about 0.5 mm to 2 mm, the upward movement of the printer can effectively be prevented. If the clearance is too great, the desired effect cannot be achieved.

As shown in FIG. 4, when it is assumed that a length of the printer 101 in the front-and-rear direction (mounting direction) is L1, a length of the table portion 45*c* in the front-and-rear direction is L2 and a length of the eaves portion 47*a* in the front-and-rear direction is L3, the following relationship is satisfied in the illustrated embodiment:

$$L1/2 \leqq L2 \leqq L1-15 \text{ mm}$$

By selecting the length L2 of the table portion 45*c* in the front-and-rear direction to become greater than the half (L1/2) of the length L1 of the printer in the front-and-rear direction in this way, when the printer 101 is mounted to the ASF 1, the printer 101 can be held in a stable condition. Here, this relationship may be satisfied at a part of the table portion 45*c* and is not necessarily satisfied at the entire table portion 45*c*.

If a relationship "L1/2>L2" is established, in the mounted condition, the printer 101 is greatly protruded from the ASF 1. In such a condition, if a downward external force acts on the protruded portion, the entire rear part may be lifted, which is an unstable condition.

Further, by selecting the length L2 of the table portion 45*c* in the front-and-rear direction to become smaller than the length L1 of the printer 101 in the front-and-rear direction by a predetermined value or more (15 mm in the illustrated embodiment), when the printer 101 is mounted, a space into which the user's fingers can be inserted can be reserved below the front part of the printer 101.

As a result, when the user mounts or dismounts the printer 101, he can handle the printer 101 by gripping the upper and lower surfaces of the latter by his one hand or both hands, thereby improving the operability and the mounting ability. This relationship is not necessarily satisfied at the entire table portion 45*c* but may be satisfied at a part (for example, central part or both lateral parts) of the table portion 45*c* to form the space(s).

Further, by providing the space below the front part of the printer 101 in this way, it can be designed so that the magnitude of the height is not felt great visually. Further, when a thickness (length in the height direction) of the table portion 45*c* is selected to about 10 mm, the user's fingers can be inserted below the printer 101 in the condition that the ASF 1 is rested on the desk. This is desirable.

On the other hand, in the illustrated embodiment, there is the following relationship between the length L1 of the printer 101 in the front-and-rear direction and the length L3 of the eaves portion 47*a* in the front-and-rear direction:

$$L1/4 \leqq L3 \leqq L1/2$$

So long as the length L3 of the eaves portion 47*a* in the front-and-rear direction is equal to or greater than ¼ of the length L1 of the printer 101 in the front-and-rear direction, it was found that the upward movement of the printer 101 can be prevented and that the pushing direction of the printer 101 can be determined.

If the length L3 of the eaves portion 47*a* in the front-and-rear direction exceeds ½ of the length L1 of the printer 101 in the front-and-rear direction, the pushing amount of the printer during the mounting becomes too great relative to the length of the printer 101 in the front-and-rear direction, and, it was found that operating feeling is lost and that the operation on the upper surface of the printer 101 is obstructed. Further, the great eaves portion 47*a* makes the entire apparatus bulky visually to give a sense of oppression to the user.

From the above explanation, it was found that it is desirable that the length L3 of the eaves portion 47*a* in the front-and-rear direction is equal to or smaller than ½ of the length L1 of the printer 101 in the front-and-rear direction. Further, when the eaves portion 47*a* is protruded to this extent, the strength of the protruded eaves portion 47*a* is ensured, thereby giving adequate rigidity to the apparatus.

By designing the table portion 45*c* and the eaves portion 47*a* under the above-mentioned conditions, the operability and the mounting ability are greatly improved, and the pushing direction of the printer 101 can be determined stably, and the flying (upward movement) of the printer can effectively be prevented.

Incidentally, in the illustrated embodiment, the opening 1A1 is formed above the printer side guide portions 45*a* having the height greater than the clearance between the eaves portion 47*a* and the upper surface of the printer. By forming the opening 1A1 in this way, when a power source code, an interface connector or/and an infrared ray communication portions are provided on the side surface of the printer 101, the ASF 1 does not interfere with these elements. That is to say, the printer 101 can be mounted and dismounted with respect to the ASF 1 even in a condition that the power source code, interface connector or the like are attached to the printer.

Next, a connector cover in a connector portion for effecting electrical connection between the printer 101 and the ASF 1 will be described.

Particularly when the printer 101 is used for a long time (in a condition separated from the ASF 1), the connectors are exposed and are not connected to each other. In such a case, dirt or foreign matters may enter into the connector portions or great static electricity may be transmitted to internal electric circuit through the connectors to damage the circuit.

To avoid such inconveniences, in the illustrated embodiment, a connector cover for protecting the connector is associated with each connector. The connector cover is used as a one-piece part so that, when the printer 101 is mounted to the ASF, the connector cover can be removed. In the very small printer such as the mobile printer, since the available space is very limited, a cheap removable connector cover not requiring an installation space so much is desirable.

Figure 5:
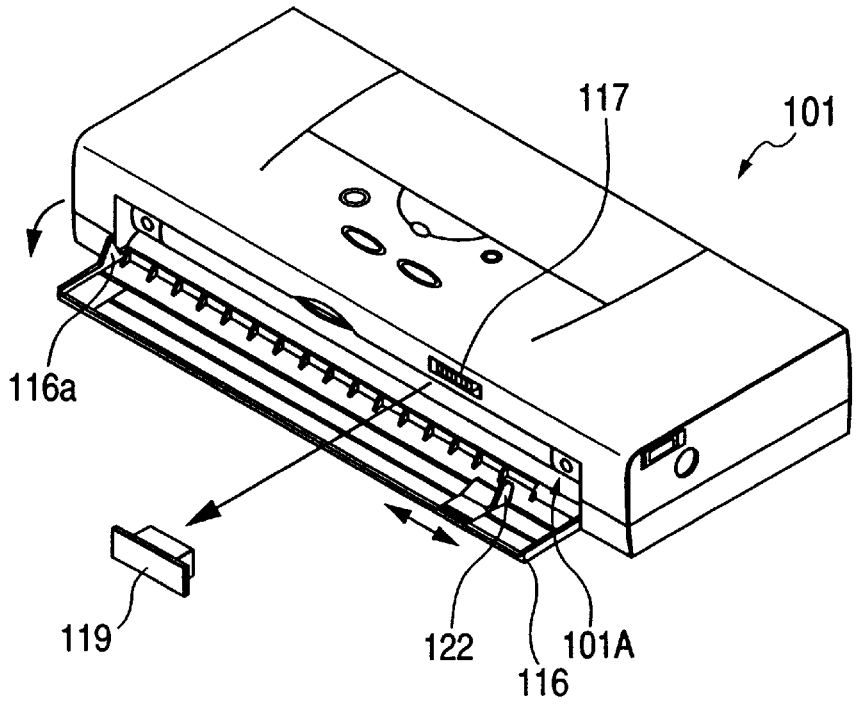
FIG. 5 is a perspective view showing an embodiment of the present invention.

For example, regarding the printer 101, as shown in FIG. 5, a printer connector 117 is provided on an upper part of a surface of the printer which is opposed to the ASF 1 when the printer is mounted. When the printer 101 is mounted to the ASF 1, a sheet feed tray 116 is opened and the printer connector cover 119 is removed from the printer connector 117. Similarly, regarding the ASF, for example, an ASF connector cover 59 is removed from an ASF connector 44 (described later) shown in FIG. 11.

When the connectors are interconnected, as shown in FIG. 4, the removed connector covers 59, 119 are contained in connector cover containing portions 45*d*, 45*e* (FIG. 2) of the table portion 45*c*. The containing portions 45*d*, 45*e* utilize the thickness of the table portion 45*c* and are formed by providing projections having the same sizes as the connector covers in the thickness. While the printer 101 is being mounted to the ASF 1, by containing the connector covers 59, 119 in the connector cover containing portions 45*d*, 45*e*, the connector covers 59, 119 can be prevented from being lost.

Incidentally, so long as the connector cover containing portions 45*d*, 45*e* merely contain the connector covers, such connector cover containing portions may be formed at any positions on the ASF 1 or the printer 101. However, as is in the illustrated embodiment, by providing the connector cover containing portions 45*d*, 45*e* on the table portion, in the condition that the printer is mounted, since the connector covers are held between the ASF 1 and the printer 101, the connector covers are not dropped or lost, and good appearance can be obtained because the covers are concealed.

Further, when the printer 101 is dismounted, since the connector covers 59, 119 reappear again, the user is aware of the presence of the connector covers and, thus, re-attachment of the connector covers can be prevented from being forgotten. The connector cover containing portions 45*d*, 45*e* can be provided for a plurality of connector covers. Incidentally, in this embodiment regarding the connector covers, even when the printer 101 and the ASF 1 have a relationship of note personal computer/station, the present invention is applicable.

In the illustrated embodiment, while an example that both the printer connector 117 and the ASF connector 44 are protected by the connector covers 119, 59 was explained, either one of the connectors 117, 44 may be protected by the connector cover.

Next, in the condition that the printer 101 is mounted on the ASF 1, a manner in which the sheet to be recorded is fed and recorded will be briefly explained (details will be described later).

FIG. 4 is a sectional view showing the condition that the printer 101 was mounted on the ASF 1. In FIG. 4, a pressure plate 26 for setting a predetermined number of sheets (described later) has one end rotatably supported by a chassis 11 of the ASF and is biased toward a pick-up rubber 23 wound around a pick-up roller 19 in a clockwise direction by means of a pressure plate spring 13 with predetermined pressure.

When the sheets are set, the pressure plate 26 is displaced away from the pick-up rubber 23 and held there by a cam (described later). In this case, predetermined clearance is maintained between the pick-up rubber 23 and the pressure plate 26, and the sheets are set by inserting the sheets into the clearance.

Incidentally, leading ends of the sheets abut against a bank sheet (plastic film) 37 provided on a bank 36, thereby positioning the leading ends. A most part of each sheet is supported on an ASF sheet feeding tray 2. The ASF sheet feeding tray 2 has one end rotatably supported by the ASF upper case 47 and is held at a certain angle when the sheets are supported thereon.

When the ASF 1 receives a sheet feeding command signal from the printer 101, the pick-up roller 19 starts to rotate in the clockwise direction, and, at the same time, the holding of the pressure plate 26 is released by the cam. As a result, the pressure plate 26 urges the sheets against the pick-up rubber 23. Consequently, the sheets start to be shifted by the surface friction of the pick-up rubber 23. Only one sheet is separated from the other sheets by the bank sheet 37, and the separated sheet is conveyed through an ASF sheet path 58 (FIG. 3) defined by the bank 36 and a positioning base 39.

Thereafter, the sheet is transferred from an ASF sheet discharge portion 56 (FIG. 3) to a sheet path of the printer through a sheet feeding opening 101A (described later) defined between a platen 105 of the printer and a lower surface of a battery 107 and called as a manual insertion opening (when the printer 101 is used as a single unit).

When the sheet conveyed through the sheet path is detected by a sheet end sensor 108, the printer 101 confirms that the sheet is conveyed from the ASF 1, and the leading end of the sheet abuts against a nip between an LF roller 109 and a pinch roller 110. When the ASF 1 receives information of the sheet end sensor 108 from the printer 101, the ASF sends a response signal indicating completion of sheet feeding to the printer at a predetermined timing.

In this case, the sheet is being urged against the nip between the LF roller 109 and the pinch roller 110 by resiliency of the sheet with predetermined pressure, thereby effecting registration of the leading end of the sheet (to correct skew-feed). In this condition, the printer 101 which received the response signal indicating completion of sheet feeding from the ASF 1 rotates the LF roller 109 at a predetermined timing to feed out the sheet to a recording portion having a head 115. In this way, predetermined feeding of the sheet is effected, and an image is recorded on the sheet by the head 115. Thereafter, the sheet is conveyed between a sheet discharge roller 112 and a spur roller 111 and is discharged.

In the illustrated embodiment, in the condition that the printer 101 was mounted on the ASF 1, as mentioned above, the sheet path (recording medium passing path) R is formed. In this case, the sheet path R of the printer 101 becomes substantially in parallel with the mounting direction.

When the sheet is straddled between the ASF 1 and the printer 101 while the sheet is being transferred from the ASF 1 to the printer 101, if the sheet is jammed, it is required that the printer 101 is separated from the ASF 1. In such a case, since the sheet path R is substantially parallel with the connector connecting direction, the printer can be separated from the ASF.

If the sheet path R is perpendicular to the connector connecting direction, when the printer 101 is separated along the connector connecting direction, the sheet must be moved in its thickness direction, with the result that the sheet may be torn and the torn sheet may remains within the apparatus. When a sheet hard to be torn is used, it may be impossible to separate the printer 101 from the ASF.

However, in the illustrated embodiment, since the sheet path R is substantially parallel with the connector connecting direction, if the sheet is jammed, the printer 101 can be separated by shifting the printer along the sheet surface, with the result that the sheet jam treatment can easily be performed and the sheet is prevented from being torn or remaining within the apparatus.

Next, a reference position of a sheet width-wise direction in the sheet path R will be described.

First of all, sheet width-wise reference in the printer 101 will be explained.

Figure 6:
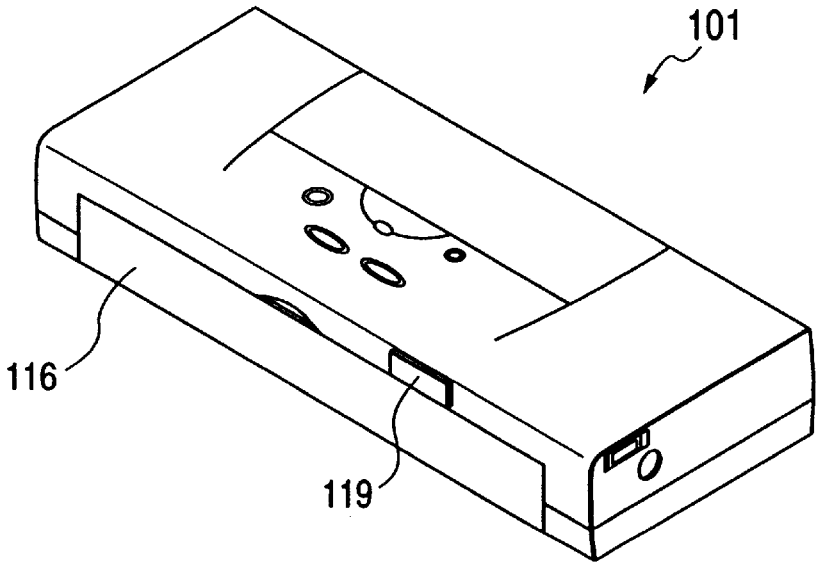
FIG. 6 is a perspective view showing an embodiment of the present invention.

As shown in FIGS. 5 and 6, the printer 101 is provided with a rotatable sheet feeding tray 116 having one end pivotally supported at a predetermined position. When the printer 101 is used as a single unit, the sheet feeding tray 116 serves to stabilize the sheet manual insertion.

When the sheet feeding tray 116 is opened, the sheet feeding opening 101A is exposed and a reference guide (positioning member) 116*a* extending vertically from one end of the sheet feeding tray 116 is revealed. When the sheets are inserted, the sheets are inserted along the reference guide 116*a*. In the illustrated embodiment, the sheet width-wise reference is this reference guide 116*a*. The sheets are positioned in the width-wise direction by inserting the sheets while abutting one lateral edges of the sheets against the reference guide.

Further, in the illustrated embodiment, a similar guide (not shown) provided at the same position with respect to the sheet width-wise direction within the printer cooperates with the reference guide 116*a* to position the sheets in the width-wise direction. An opened condition and a closed condition of the sheet feeding tray 116 are maintained or held by a toggle means (not shown).

Since the longer the guide in a sheet conveying direction the more stable the sheet direction, by using the reference guide 116*a* provided on the sheet feeding tray 116, the positioning of the sheet in the width-wise direction is stabilized and the skew-feed is prevented. However, even if there is not similar guide within the printer, the sheet can be guided only by the reference guide 116*a* provided on the movable sheet feeding tray 116.

As mentioned above, particularly in the very small mobile printer, since it is very difficult to provide a manual insertion sheet feeding opening and a sheet feeding opening from the ASF independently and to further provide the respective guides associated therewith because of limitation of space, it is required that the manually inserted sheet and the sheet fed from the ASF are fed through a common sheet feeding opening.

Thus, when the printer 101 is mounted to the ASF 1, although the reference guide 116a which is the sheet reference for the manually inserted sheet is required to be used for the sheet fed from the ASF 1, it is difficult to convey the sheet automatically fed from the ASF 1 along (while contacting with) the reference guide 116*a*. The reason is that the sheet reference of the printer 101 and the sheet reference of the ASF 1 must be coincided with each other completely in order that the ASF 1 can perform the same operation (effected by the user) in which the lateral edge of the sheet is contacted with the reference guide 116*a* while adjusting the sheet by hand.

On the other hand, in the illustrated embodiment, the sheet reference of the ASF 1 is an ASF sheet reference 26*b* provided on the pressure plate 26. By contacting the lateral edges of the sheets with this ASF sheet reference, the sheets can be positioned at the predetermined position. However, due to great tolerance in construction, since it is very difficult to align this position with the reference guide 116*a*, great cost and a complicated mechanism are required in order to realize such alignment.

Further, if the sheet references are not aligned with each other, the lateral edge of the sheet interferes with the reference guide 116*a* to cause the skew-feed of the sheet or damage of the lateral edge of the sheet, or the leading end of the sheet is struck against the reference guide 116*a* to cause the sheet jam.

For example, when the reference guide 116*a* is provided only at a position relatively upstream of the manual insertion sheet feeding portion of the printer 101, i.e., as shown in FIG. 5, when the sheet width-wise reference is determined only by the reference guide 116*a* revealed when the movable sheet feeding tray 116 and there is no member for regulating the widthwise position of the sheet at a downstream side therefrom, as the printer 101 is mounted to the ASF 1, by setting the sheet path R so that the sheet passes above the reference guide 116*a*, only the sheet positioning performed by the sheet reference 26*b* of the ASF 1 becomes effective, the interference with the sheet reference of the printer 101 can be avoided.

Further, as shown in FIG. 5, in the condition that the sheet feeding tray 116 of the printer as the single unit is opened (i.e., when the manual insertion sheet feeding is effected), the sheet guiding surface of the sheet feeding tray 116 becomes substantially horizontal, but, as shown in FIG. 4, in the condition that the printer 101 was mounted on the ASF 1, by rotating and retarding the movable sheet feeding tray 116 further downwardly from the position (of the sheet feeding tray) when the printer is used as the single unit, the sheet path is more resembled to the sheet path upon the manual insertion.

Incidentally, the ASF has a reference guide containing portion 36*b* for containing the sheet feeding tray 116 rotated to the predetermined position. As the printer 101 is pushed into the ASF 1, the reference guide 116*a* is guided by a reference guide guiding portion 36*c* defining the reference guide containing portion 36*b* to be contained within the reference guide containing portion 36*b*.

By doing so, a shifting amount of the sheet path of the ASF 1 regarding the sheet path for the manual insertion, which is required for avoiding the interference between the reference guide 116*a* and the sheet path, can be reduced, thereby preventing inconvenience (for example, back tension on the sheet) due to unnatural sheet path.

Incidentally, in the illustrated embodiment, as shown in FIG. 6, the sheet feeding tray 116 of the printer has a right end guide (another positioning member) 122 for guiding the other lateral edge of the sheet opposite to the sheet reference. The right end guide 122 is slidable with respect to the sheet feeding tray 116 in the sheet width-wise direction so that it can guide the other lateral edge of the sheet opposite to the sheet reference.

A shape of the right end guide 122 looked at from the sheet thickness direction in the sheet path is substantially the same as that of the reference guide 116*a* and, when the printer 101 is mounted to the ASF 1, the right end guide 122 contained within the reference guide containing portion 36*b*, together with the sheet feeding tray 116 and the reference guide 116*a*. Although the right end guide 122 can be shifted at any position within a predetermined range with respect to the sheet feeding tray 116, when the right end guide 122 is positioned at any position within the predetermined range, the reference guide containing portion 36*b* can contain the sheet feeding tray 116 having the reference guide 116*a* and the right end guide 122.

When the printer 101 is mounted to the ASF 1 in this way, by setting the sheet path at a position spaced apart from the reference guide 116*a* and the right end guide 122, the sheet reference of the printer can be invalid and only the sheet reference of the ASF can be valid, with the result that the apparatus can be prevented from being made expensive and complicated (since the requirement for alignment between both sheet references can be avoided).

Further, the fact that the sheet fed from the ASF 1 interferes with the sheet reference 116*a* and the right end guide 122 of the printer to cause the skew-feed of the sheet and/or the damage of the lateral edge of the sheet and the fact that the sheet is struck against the sheet reference 116*a* and the right end guide 122 to cause the sheet jam can be prevented.

Incidentally, in the above explanation, while an example that the sheet passes above the reference guide 116*a* was explained, the present invention is not limited to such an example, but, for example, the reference guide 116 may be slidable on the sheet feeding tray 116 in the sheet width-wise direction and, as the printer is mounted, the reference guide 116*a* may be slid in the sheet width-wise direction by a shifting means (such as a cam) synchronous with the mounting of the printer so that the sheet can pass alongside the reference guide 116*a*.

In the case where the reference guide is provided at the same position as the reference guide 116*a* with respect to the sheet width-wise direction within the printer to increase a length for guiding the sheet thereby to stabilize the positioning of the sheet, it is difficult to dispose the sheet path at a position spaced apart from all of the reference guides.

Figure 7:
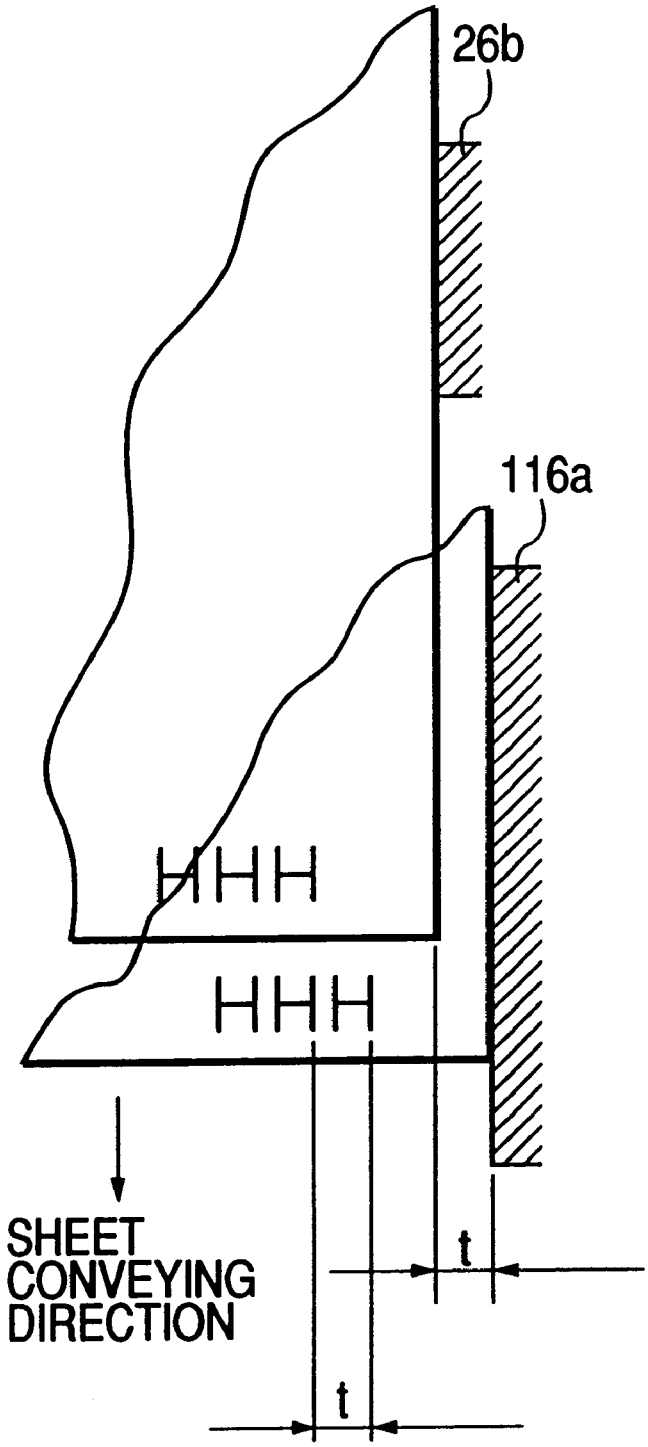
FIG. 7 is a schematic plan view showing an embodiment of the present invention.

In this case, as shown in FIG. 7, the sheet reference guide 116*a* of the printer and the sheet reference 26*b* of the ASF are previously arranged at offset positions. That is to say, the sheet reference 26*b* of the ASF is set at a position deviated inwardly from the sheet reference guide 116*a* of the printer (i.e., the recording position of the head 115 perpendicular to the sheet conveying direction) by a distance t so that, when the sheet is fed from the ASF 1, the sheet does not interfere with the sheet reference guide 116*a* of the printer.

The deviation amount t between the sheet references is greater than the positioning tolerance between the printer 101 and the ASF 1 in the sheet width-wise direction and is determined in consideration of the possibility that the sheet may be skew-fed from the ASF 1. In the illustrated embodiment, the deviation amount t between the sheet references is selected to about 0.6 mm.

In this case, since the sheet reference when the recording is effected by the printer alone is deviated from that when the recording is effected by the printer mounted on the ASF, in both cases, if the image is recorded on the sheets by the head 115 at the same positions, distances between the lateral edges and the images differ from each other in both cases.

To avoid this, in the illustrated embodiment, the recording position when the recording is effected by the printer alone is deviated from that when the recording is effected by the printer mounted on the ASF by the same amount as the deviation amount t. For example, in the illustrated embodiment, since the printer 101 is electrically connected to the ASF 1 via the connectors 44, 117, the printer 101 can electrically detect the mounting/non-mounting of the ASF 1, and the judgment for deviating the recording position (position of the head 115) can be effected on the basis of a detected result. Incidentally, this judgment may be effected by additional ASF detecting switch, as well as the aforementioned electrical connection.

With the arrangement as mentioned above, by deviating the sheet reference when the recording is effected by the printer alone from that when the recording is effected by the printer mounted on the ASF, the interference between the reference guides can be avoided, and, thus, the image can be recorded at the same positions on the sheets in both cases. Accordingly, inconvenience (for example, recording at different positions on the sheets in both cases) caused because of the deviation between the recording positions in both cases can be eliminated. In this regard, it is not necessarily that the deviation amount between the sheet references is completely the same as the deviation amount between the recording positions, but, these deviation amounts may be differentiated within an allowable range.

Next, the ASF sheet feeding tray 2 for supporting the stacked sheets will be explained.

Figure 8:
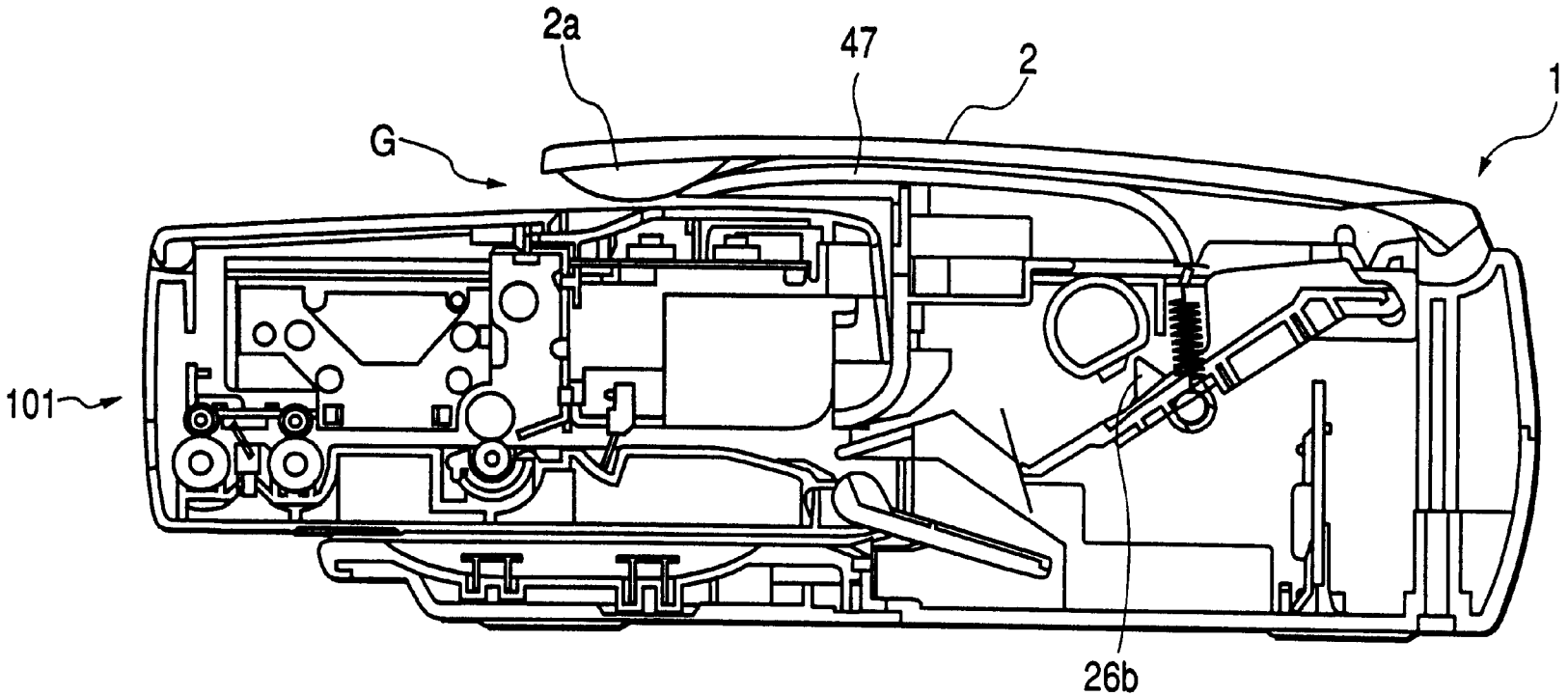
FIG. 8 is a sectional view showing an embodiment of the present invention.

As shown in FIGS. 1 to 4, the ASF sheet feeding tray 2 has one end rotatably supported by the ASF upper case 47 so that the ASF sheet feeding tray 2 can be folded around the supported position. When the sheets are stacked, the ASF sheet feeding tray 2 is opened at a certain predetermined angle; whereas, when the sheets are not stacked, the tray can be closed or folded as shown in FIG. 8.

This means that the ASF 1 according to the illustrated embodiment not only serves to use the portable printer 101 as the desk-top printer but also serves to provide the portable ability of the ASF 1 to which the printer 101 is mounted (because of compactness).

In order to realize such use condition, when the ASF sheet feeding tray 2 is closed, it must be closed along the profile of the ASF 1 (to which the printer is mounted) as much as possible. To this end, the ASF sheet feeding tray 2 is formed from a thin plate.

Figure 9:
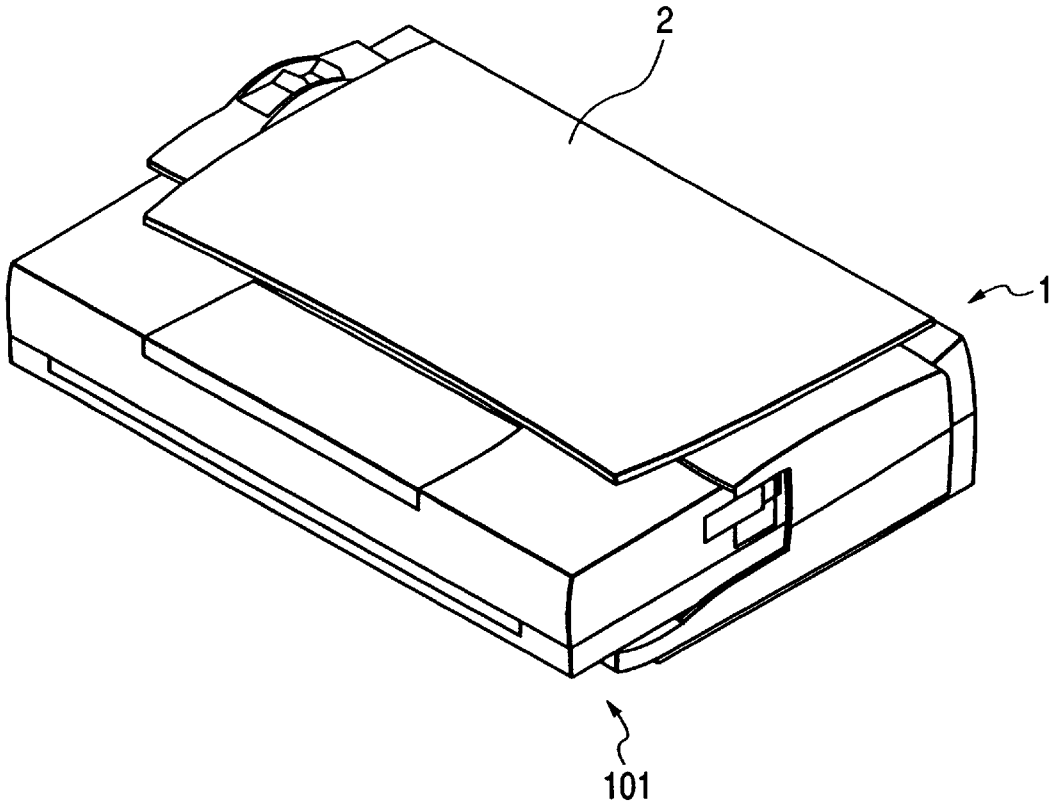
FIG. 9 is a perspective view showing an embodiment of the present invention.

Further, in the illustrated embodiment, as shown in FIG. 9, when the ASF sheet feeding tray 2 is closed, since the operation portion of the printer 101 is covered or concealed, even when the ASF on which the printer 101 was mounted is transported in the condition that the sheet feeding tray 2 is closed, the user is prevented from inadvertently touching the operation portion to operate the printer 101.

Further, desirably, it is so designed that, when the sheet feeding tray 2 is folded, any part of the tray is engaged by the ASF upper case 47 via an engagement means (not shown) such as a hook to prevent inadvertent opening of the sheet feeding tray during the transportation. The engagement means for the sheet feeding tray 2 may be provided on the printer or on the ASF itself, but, more preferably, such engagement means is provided on a side guide portion 2*a* which will be described later. When the engagement means provided on the printer is used, such engagement means can also act as an engagement maintaining means (which may be "complete lock").

Figure 10:
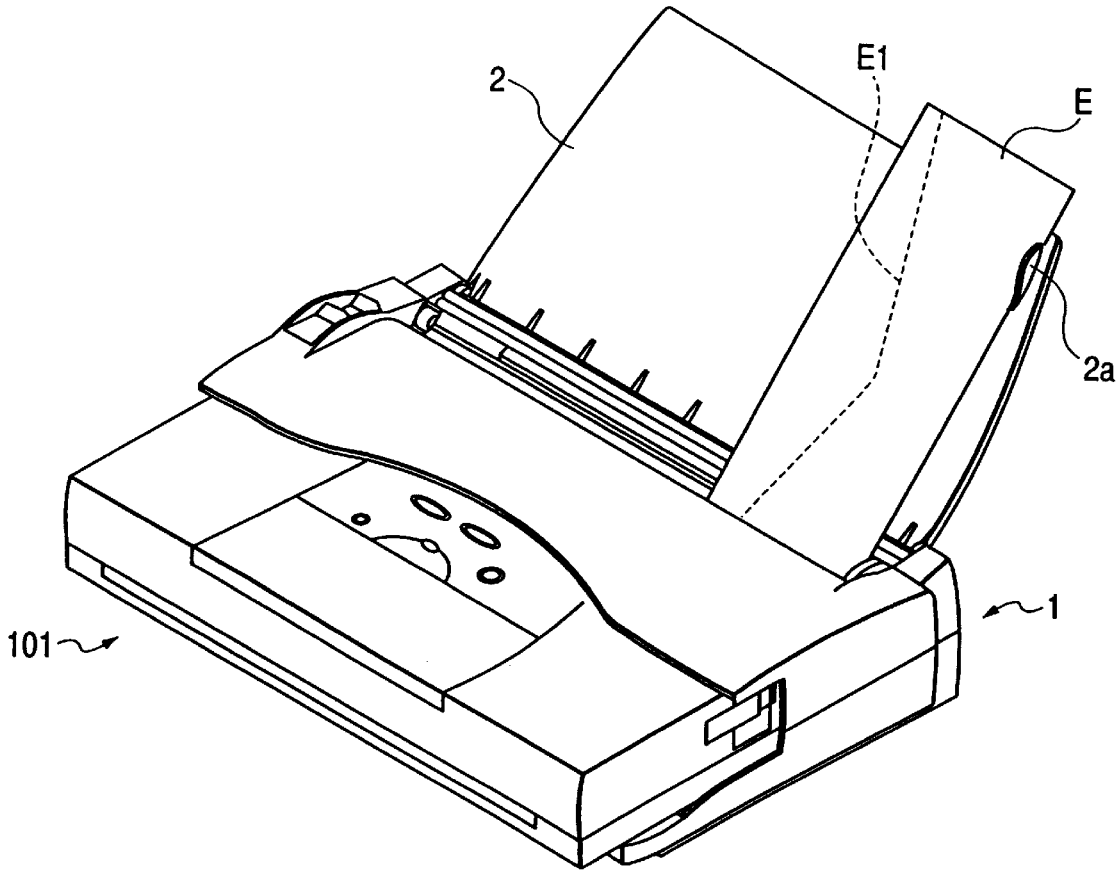
FIG. 10 is a perspective view showing an embodiment of the present invention.

On the other hand, as shown in FIG. 10, when an envelope E is fed by the ASF along a longitudinal direction thereof, normally, a tab E1 of the envelope is positioned at the left. In the ASF 1 according to the illustrated embodiment, due to swelling of the tab E1 with moisture, during the envelope feeding, the tab E1 (left side) of the envelope is subjected to a strong resistance force, with the result that the envelope E tends to be rotated in the clockwise direction.

In the illustrated embodiment, in order to prevent (regulate) the clockwise rotation of the envelope E, i.e., shifting movement of the envelope in a direction perpendicular to the sheet feeding direction, an ASF sheet feeding tray side guide portion (referred to as "side guide portion" hereinafter) 2*a* as a regulating member is provided at an upstream part of the ASF sheet feeding tray 2. By providing such a side guide portion 2*a*, after the envelope E is set in the ASF 1 longitudinally, when the envelope is fed, even if the envelope is subjected to a force tending to rotate the envelope in the clockwise direction, a rear lateral edge of the envelope abuts against the side guide portion 2*a*, thereby regulating the clockwise rotation.

When the envelope is fed in the longitudinal direction, particularly at a timing for starting the feeding of the envelope E, the tab E1 is subjected to the resistance. In the illustrated embodiment, this occurs when the envelope E rides over the bank sheet 37 and when a leading end of the envelope is lifted along the inclined surface of the bank 36. When this timing is passed, the influence of the resistance of the tab E1 is decreased, with the result that the rotation of the envelope E is not generated even absence of the side guide portion 2*a*.

For these reasons, in the illustrated embodiment, the side guide portion 2*a* is provided on a part of the ASF sheet feeding tray 2 in the vicinity of the trailing end of the envelope to prevent the rotation of the envelope. There is no side guide along the entire lateral edge of the envelope.

Further, in the illustrated embodiment, when the printer 101 is mounted, as shown in FIG. 8, a stepped portion or gap G is created between the ASF upper case 47 and the upper surface of the printer, and, when the ASF sheet feeding tray 2 is closed, the side guide portion 2*a* is housed within the gap G as shown in FIG. 8.

In this way, by providing the side guide portion 2*a* on the part of the ASF sheet feeding tray 2 and by housing the side guide portion 2*a* within the gap G, when the ASF sheet feeding tray 2 is closed, the side guide portion 2*a* does not interfere with other parts so that the ASF sheet feeding tray 2 can be closed along the outer profile of the ASF, thereby keeping the portable ability and made the apparatus more compact.

It is required that a height of the side guide portion 2*a* is greater than a thickness of the sheet stack such as envelope stack, and, to achieve the above effect, a depth of the gap G is required to be greater than the height of the side guide portion 2*a*.

In the illustrated embodiment, although the rotation preventing effect during the envelope longitudinal feeding can be obtained, other than the envelope, when other sheets having a length similar to that of the envelope are fed, if rotation is generated for any reason, such rotation can be regulated (prevented). Since the side guide portion 2*a* is integrally formed with the ASF sheet feeding tray 2, the manufacturing cost is cheap. In place of the fact that the gap G is created when the ASF sheet feeding tray 2 is closed, a recess may be previously formed in the printer 101 or in the ASF 1 and the side guide portion 2*a* may be housed in such a recess.

On the other hand, when such a side guide portion having the above-mentioned construction is adopted to the sheet feeding tray 116 of the printer 101, even when the printer 101 is used as a single unit, rotation of the sheet can be regulated. Further, by forming the side guide portion on the part of the sheet feeding tray 116, when the sheet feeding tray 116 is closed, the side guide portion does not interfere with other parts so that the sheet feeding tray 116 can be closed along the outer profile of the printer, thereby keeping the portable ability and made the printer more compact.

Next, the printer mounting/dismounting mechanism of the ASF will be described.

Figure 11:
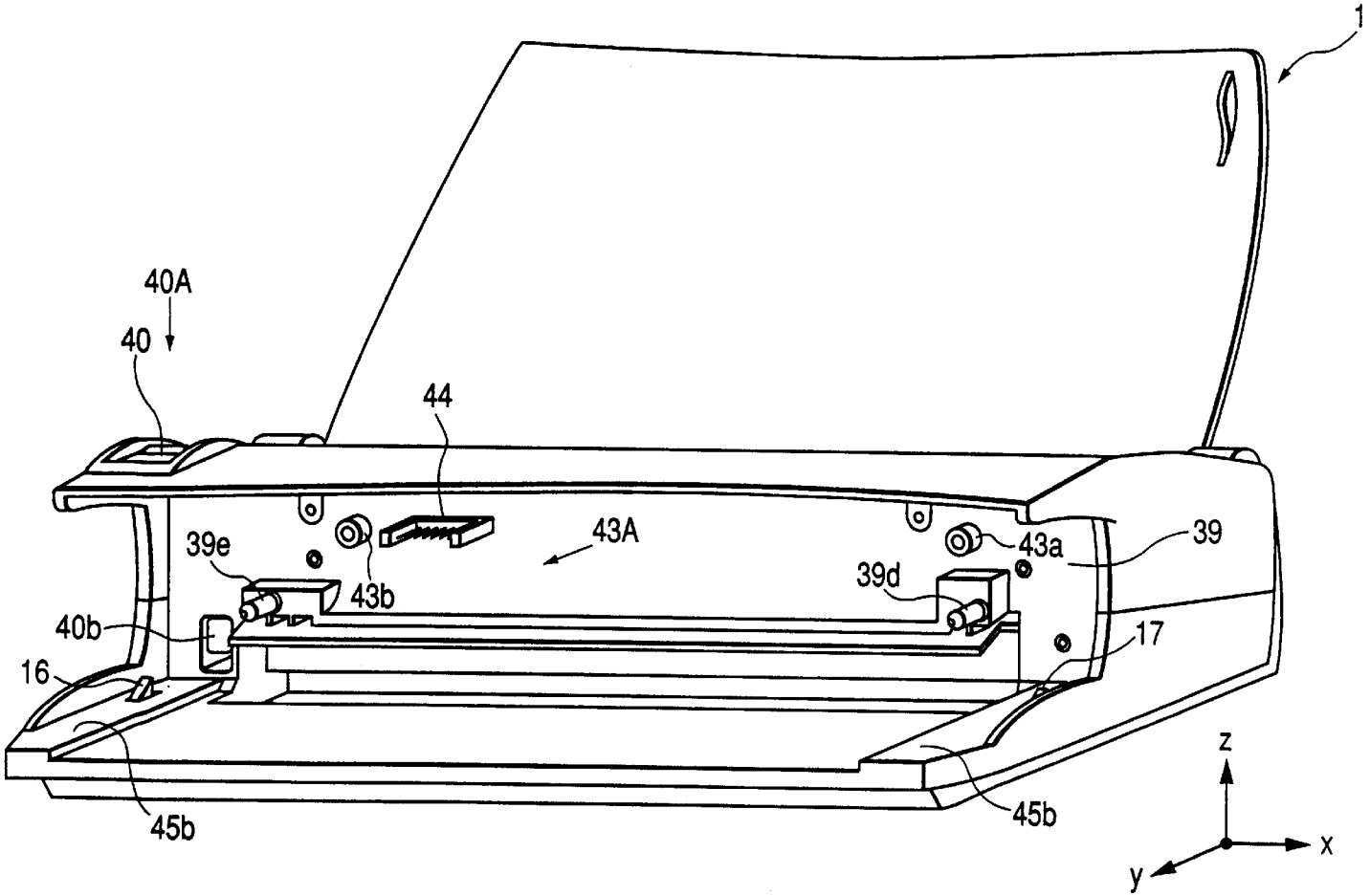
FIG. 11 is a perspective view showing arrangement of parts associated with a printer mounting/dismounting mechanism of the ASF of the present invention.
Figure 12:
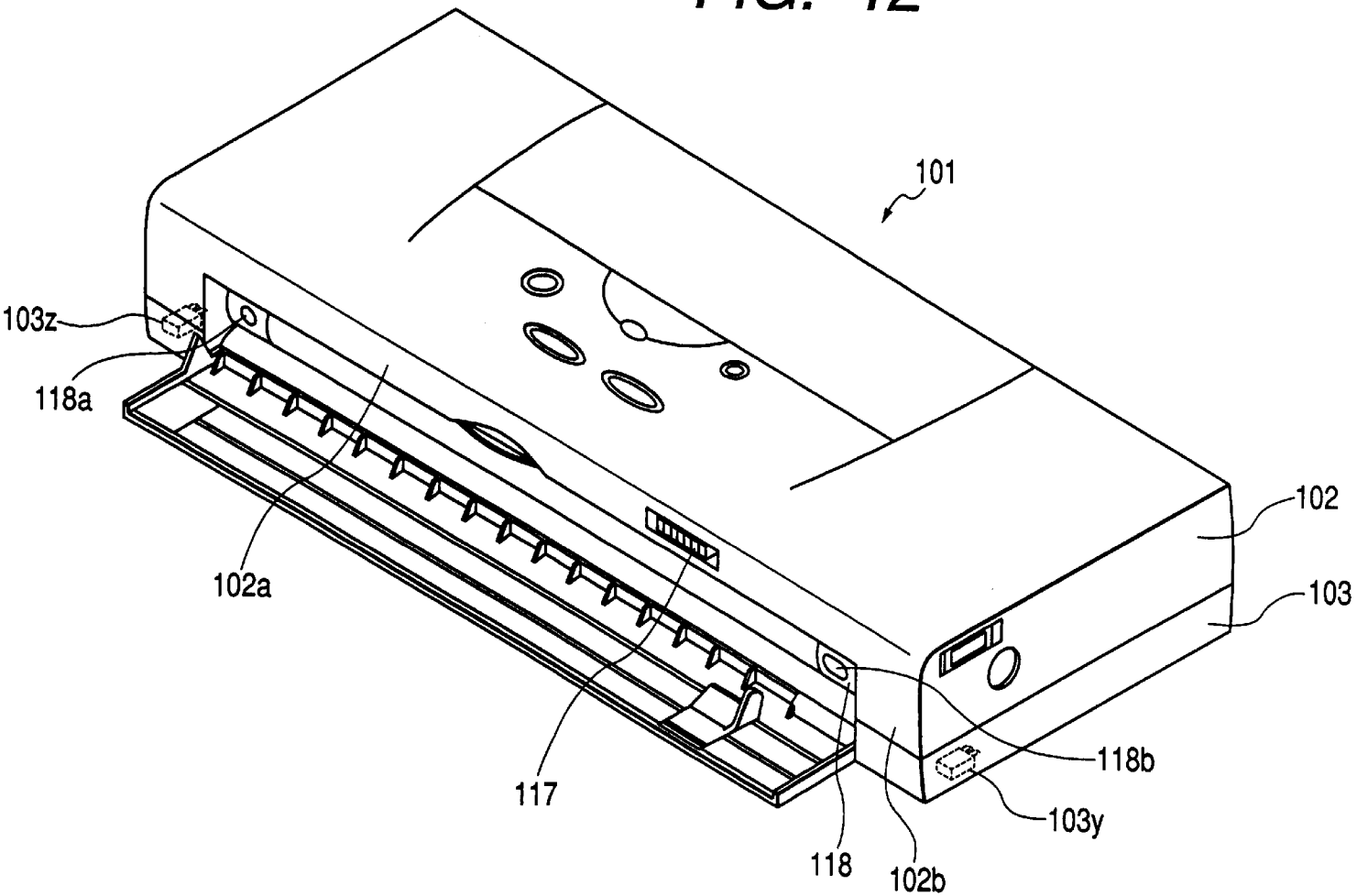
FIG. 12 is a perspective view showing arrangement of parts (associated with the ASF) of the printer mounted to the ASF of the present invention.

FIG. 11 is a perspective view showing arrangement of parts associated with the printer mounting/dismounting mechanism of the ASF, and FIG. 12 is a view showing arrangement of parts associated with the mounting/dismounting of the printer 101 with respect to the ASF 1.

In FIG. 11, a positioning base 39 is a member for positioning the sheet path between the ASF 1 and the printer and positioning the connection between the ASF connector 44 of the ASF 1 and the printer connector 117.

Two positioning bosses (first and second pins) 39*d*, 39*e* are provided on the positioning base 39. When the printer 101 is mounted to the ASF 1, before the printer connector 117 is connected to the ASF connector 44, the first positioning boss 39*d* is fitted into a first positioning hole (circular hole) 118*a* provided in a substrate holder 118 of the printer 101 as shown in FIG. 12, and the second positioning boss 39*e* is fitted into a second positioning hole (elongated hole) 118*b*. The first and second positioning bosses 39*d*, 39*e* and the first and second positioning holes 118*a*, 118*b* engaged by such first and second positioning bosses 39*d*, 39*e* constitute a positioning means.

Incidentally, since the connection between the connectors is effected after the positioning effected by fitting between the positioning bosses 39*d*, 39*e* and the positioning holes 118*a*, 118*b*, the damage of the connectors due to positional deviation between the connectors can be prevented. Further, the positioning between the ASF 1 and the printer 101 in an x and z directions is effected by the fitting of the bosses 39*d*, 39*e*, the positioning of the sheet path between the printer 101 and the ASF 1 is achieved simultaneously.

On the other hand, in order to effect the positioning of the printer 101 in a y direction after it is mounted to the ASF 1, retractable hooks 16 (left) and 17 (right) are provided on the printer sliding portions 45*b* of the ASF 1. Regarding the printer, hook fixing holes 103*y*, 103*z* into which the two hooks 16, 17 are to be fitted are formed in both side portions of the base 103 of the printer 101.

When the printer 101 is mounted to the ASF 1, the left and right hooks 16, 17 of the ASF 1 are fitted into the hook fixing holes 103*y*, 103*z* of the printer 101, thereby effecting the positioning of the printer 101 in the y direction.

When the user dismounts the printer 101 from the ASF 1, the push lever 40 is depressed in the direction shown by the arrow 40A. That is to say, when the push lever 40 is depressed, the left and right hooks 16, 17 protruded from the printer sliding portions 45*b* are retarded toward a direction shown by the arrow 40A to be disengaged from the hook fixing holes 103*y*, 103*z* of the printer 101.

Thereafter, a sheet feeding side upper part 102*a* of the printer 101 is pushed in a direction shown by the arrow 43A (y direction) by pop-ups 43*a*, 43*b* provided on the ASF 1, the connection between the connectors 44, 117 is released. The pop-ups 43*a*, 43*b* are biased toward the direction 43A (y direction) by elastic members (not shown), and they can be slid in the y direction.

Since the biasing force of the pop-ups 43*a*, 43*b* acts as a reaction force when the printer 101 is mounted to the ASF 1, if the biasing force is too great, the printer 101 cannot be inserted into the ASF 1, thereby causing poor mounting. Thus, the biasing force is selected to an appropriate value (for example, to an extent that when, the printer 101 is mounted to the ASF 1, the ASF is not moved by the biasing force).

If a force required for disconnecting the connectors is greater than the biasing force of the pop-ups 43*a*, 43*b*, the connection between the connectors cannot be released only by the pop-ups 43*a*, 43*b*. Thus, in the illustrated embodiment, it is so designed that, by pushing the push lever 40 in the direction 40A, a protrudable portion 40*b* of the push lever 40 is protruded in the y direction.

By pushing a sheet feeding side lower portion 102*b* (or a central portion) of the printer 101 by the protruded portion 40*b* of the push lever 40, the connection between the connectors (44, 117) is released. With this arrangement, the user can easily retract the printer 101 from the ASF 1 in the y direction.

Next, the mounting/dismounting mechanism between the ASF 1 and the printer 101 will be further fully described.

Figure 13:
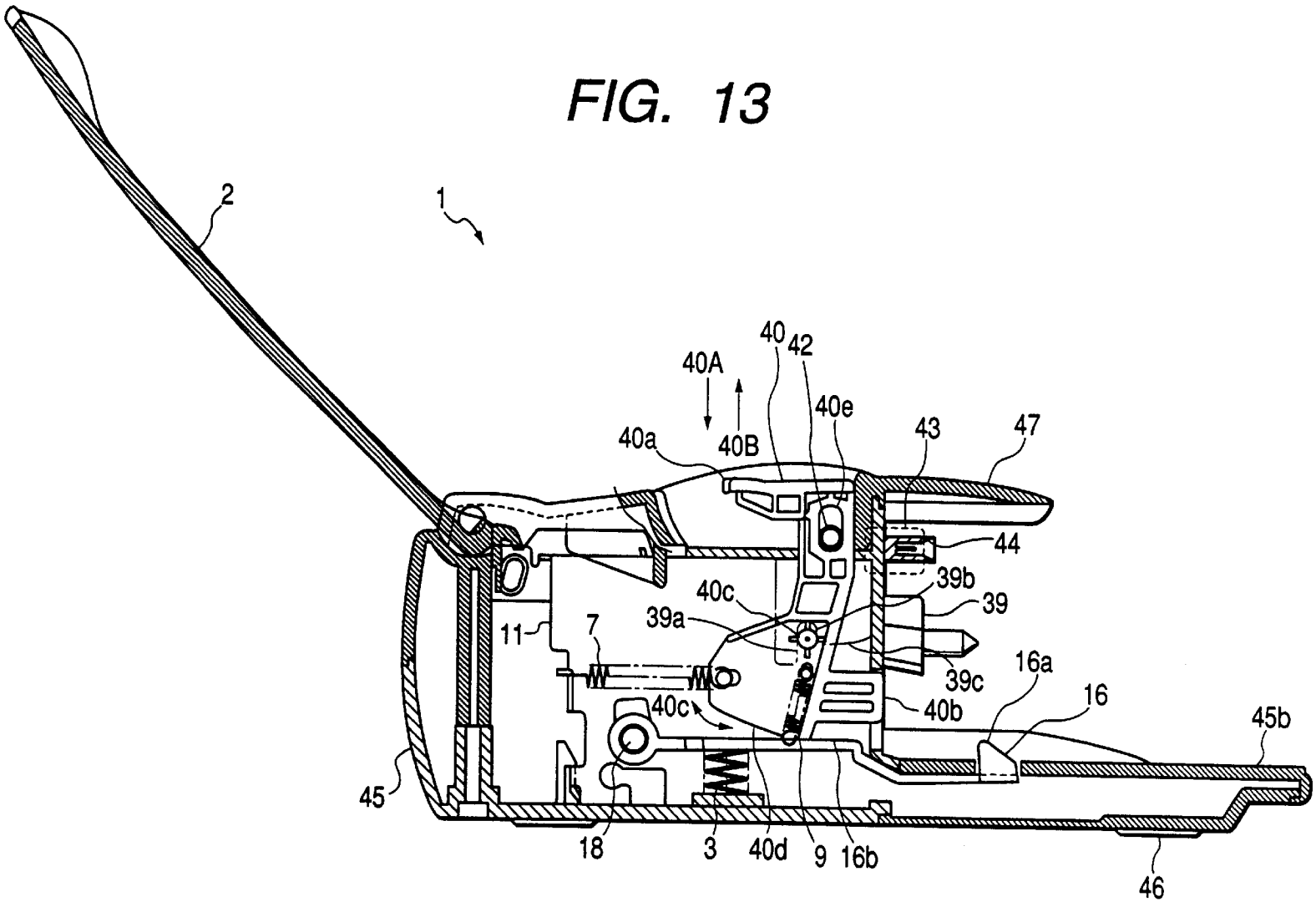
FIG. 13 is a left sectional view for explaining a mounting/dismounting mechanism between the ASF and the printer of the present invention.

FIG. 13 shows arrangement of parts associated with the mounting of the printer to the ASF 1. As shown in FIG. 13, the push lever 40 is rotatably (in directions 40A, 40B and 40C) attached to a lever shaft 42 secured to the positioning base 39. The push lever 40 and the chassis 11 of the ASF 1 are interconnected by a push lever spring 7.

The push lever 40 is provided with a rotation preventing boss 40*c* and the positioning base 39 is provided with slide surfaces 39*a*, 39*b*, 39*c* against which the boss 40*c* abuts (for clarify's sake, the slide surface 39*c* is shown by the two dot and chain line). With the arrangement, when the boss 40*c* of the push lever 40 abuts against the slide surface 39*a*, rotation of the push lever 40 around the lever shaft 42 is regulated.

The left and right hooks 16, 17 are secured to a hook shaft 18 rotatably attached to the chassis 11 so that the left and right hooks 16, 17 are operated in a synchronous manner. A connecting spring 9 is disposed between the left hook 16 and the push lever 40 so that a lower end 40*d* of the push lever 40 always abuts against an upper surface of the left hook 16 by the connecting spring 9.

Further, a hook spring 3 is disposed between the left hook 16 and the ASF base so that a pawl portion 16*a* of the left hook 16 is maintained in a protruded condition (from the printer sliding portion 45*b* of the ASF base 45) by the hook spring 3.

Figure 14:
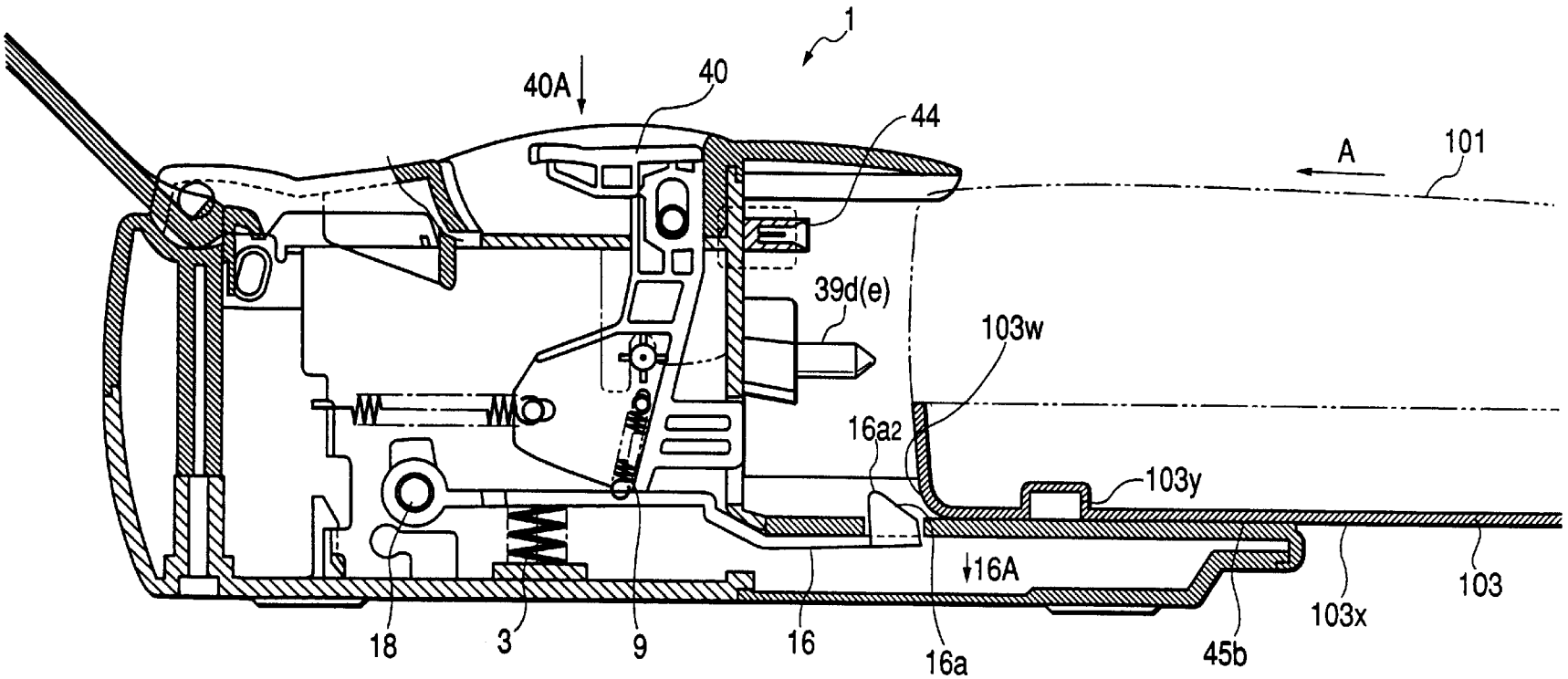
FIG. 14 is a left sectional view for explaining a mounting/dismounting mechanism between the ASF and the printer of the present invention.

FIG. 14 shows a condition that the printer 101 is rested on the printer sliding portion 45*b* for preparing for the mounting of the printer 101 to the ASF 1. Incidentally, in FIG. 14, for clarify's sake, the printer 101 is shown by the two dot and chain line. Further, the base of the printer 101 is shown as a sectional view.

As the printer 101 is shifted in the direction shown by the arrow A along the printer sliding portion 45*b* of the ASF base 45 to push the printer into the ASF 1, firstly, the pawl portion 16*a* of the left hook 16 abuts against a base leading end 103*w* of the printer 101. When the printer 101 is further pushed, the left hook 16 is rotated downwardly around the hook shaft 18 in a direction shown by the arrow 16A until an upper end 16*a*2 of the pawl portion 16*a* abuts against a bottom surface 103*x* of the base 103. At the same time, the push lever 40 is lowered in the direction 40A since it is operated in synchronous with the left hook 16 due to the presence of the connecting spring 9.

Figure 15:
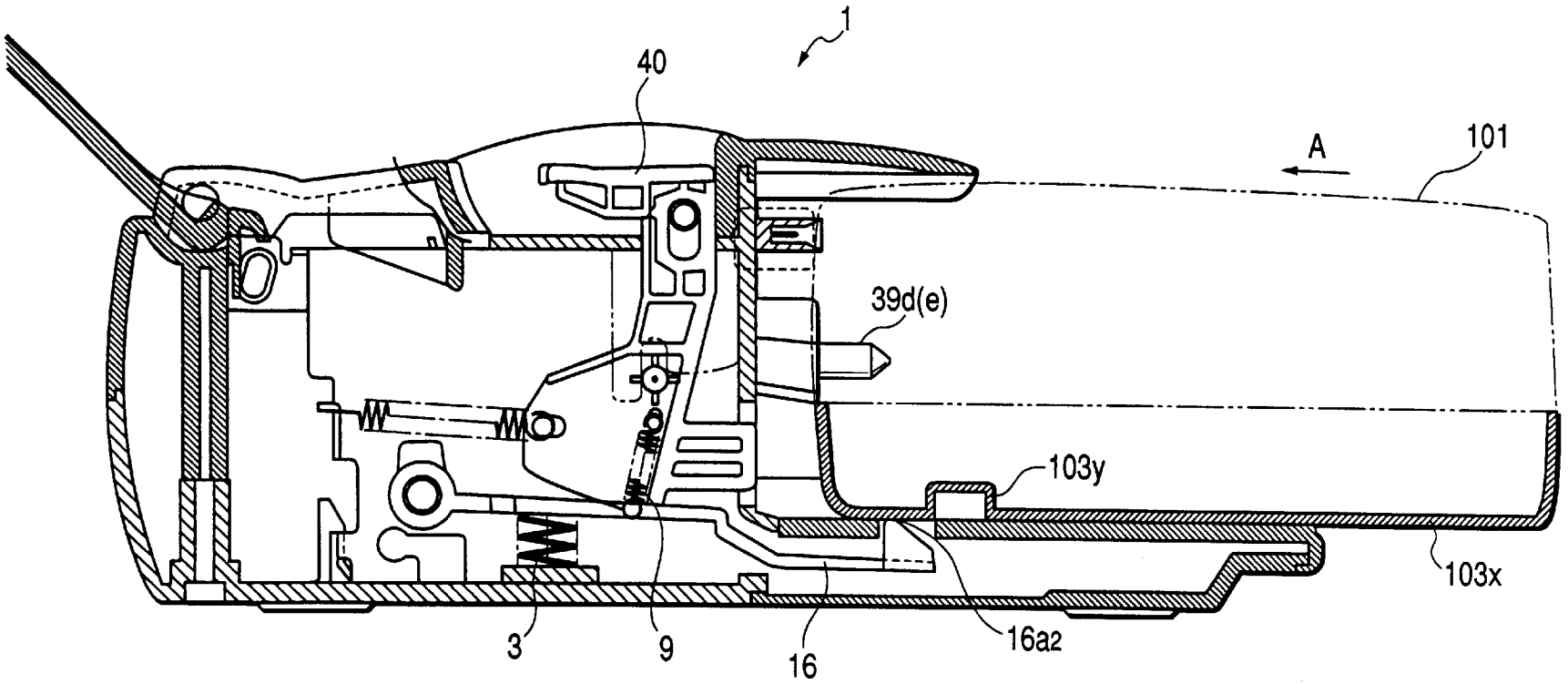
FIG. 15 is a left sectional view for explaining a mounting/dismounting mechanism between the ASF and the printer of the present invention.

In this pushed position, as shown in FIG. 15, the positioning bosses 39*d*, 39*e* are already fitted into the positioning hole 118*a* (FIG. 12) and the positioning elongated hole 118*b* (FIG. 12) of the printer 101, so that the positioning between the connectors is completed before the ASF connector 44 (FIG. 13) is connected to the printer connector 117 (FIG. 12).

Figure 16:
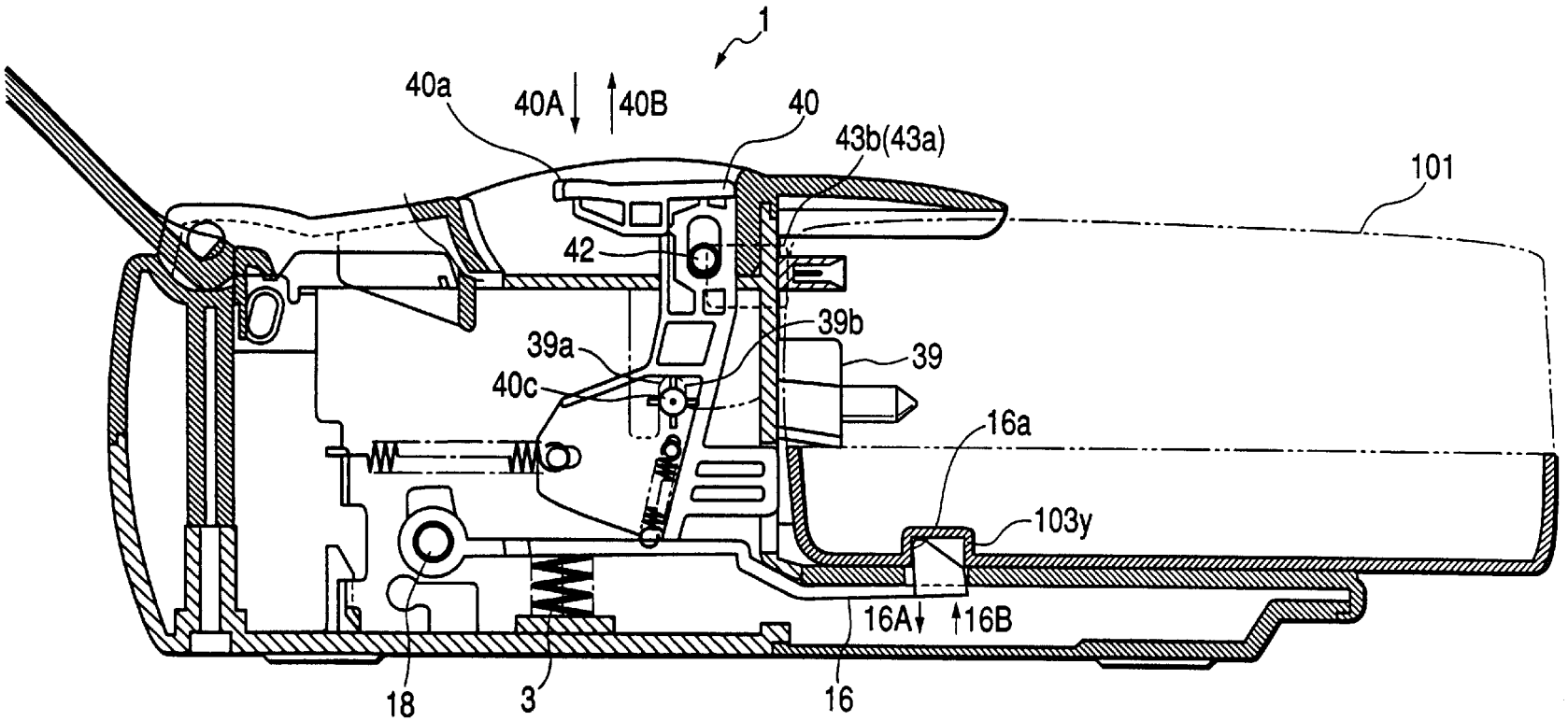
FIG. 16 is a left sectional view for explaining a mounting/dismounting mechanism between the ASF and the printer of the present invention.

Thereafter, as the printer 101 is further pushed, the ASF connector 44 is connected to the printer connector 117. When the pawl portion 16*a* of the left hook 16 reaches the hook fixing hole 103*y* of the printer 101, as shown in FIG. 16, the left hook 16 is lifted in a direction shown by the arrow 16B by the biasing force of the hook spring 3, with the result that the pawl portion 16*a* of the left hook 16 abuts against a wall of the hook fixing hole 103*y* of the printer 101, thereby fitting the pawl portion into the hook fixing hole.

At the same time, the push lever 40 is lifted in the direction 40B. Thus, the user can confirms the fact that the printer 101 is mounted (secured) to the ASF 1.

Since the left and right hooks 16, 17 are secured to the hook shaft 18, so long as both the left and right hooks 16, 17 are not entered into the hook fixing holes 103*y*, 103*z* (FIG. 12), the push lever 40 is not lifted in the direction 40B. Accordingly, poor mounting in which, for example, the printer 101 is mounted to the ASF 1 obliquely so that one of the hooks is not fitted into the corresponding hook fixing hole can be prevented by confirming the height position of the push lever 40 by the user.

In the illustrated embodiment, the fitting positions between the hooks 16, 17 and the printer 101 is set to be the same or slightly higher than the rotational center positions of the hooks 16, 17. Thus, even if the printer 101 is forcibly separated from the ASF 1, since the hooks 16, 17 remain in a force balancing position, i.e., a position having the same height as the rotational center positions of the hooks 16, 17, the printer 101 is not dislodged from the ASF 1.

Next, the dismounting of the printer 101 from the ASF 1 will be explained.

When the user wants to dismount the printer 101 from the ASF 1, as shown in FIG. 16, the user pushes a push portion 40*a* of the push lever 40 in the direction 40A by his finger. In this case, since the boss 40*c* is pinched between the guide surfaces 39*a*, 39*b* of the positioning base 39, the push lever 40 cannot rotate around the lever shaft until the guide surface 39*b* is retarded. Thus, the push lever is lowered in the direction 40A.

Figure 17:
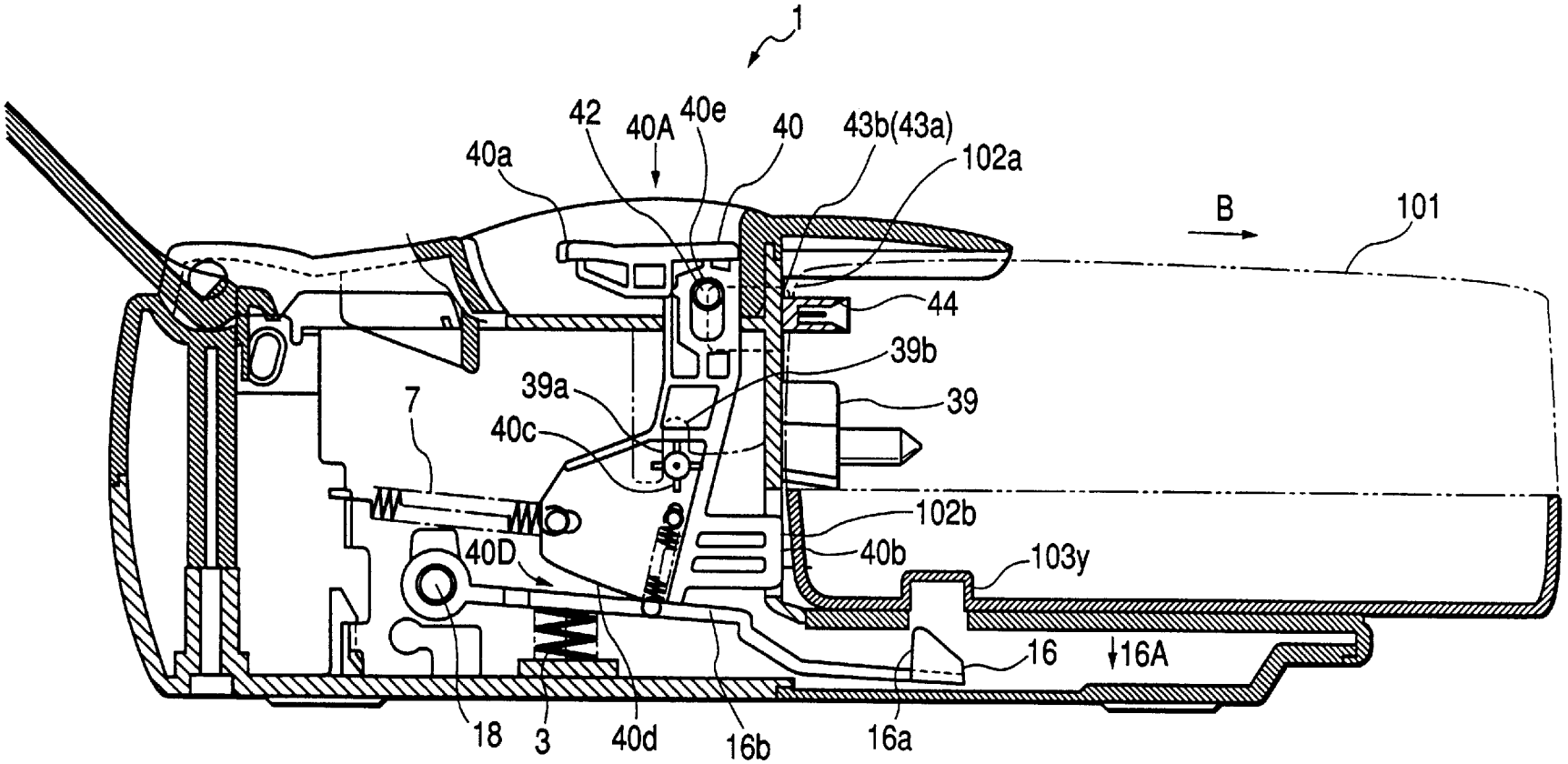
FIG. 17 is a left sectional view for explaining a mounting/dismounting mechanism between the ASF and the printer of the present invention.

Since the push lever 40 is operated in synchronous with the left hook 16, at the same time when the push lever 40 is lowered, the left hook 16 is rotated around the hook shaft 18 in the direction 16A, with the result that pawl portion 16*a* of the left hook 16 is disengaged from the hook fixing hole 103*y* of the printer 101, as shown in FIG. 17. Although not shown, at the same time, the right hook 17 is disengaged from the hook fixing hole 103*z*.

When the pawl portion 16*a* is disengaged in this way, the sheet feeding side upper portion 102*a* of the printer 101 is pushed out toward the direction B by the pop-ups 43*b* (43*a*) shown by the broken line in FIGS. 16 and 17. At the same time, the connection between the ASF connector 44 and the printer connector 117 is released.

In this condition, when the user release the push lever 40 (to stop the urging in the direction 40A), a condition shown in FIG. 15 is established. That is to say, the connection between connectors 44, 117 is released, and the hook 16 is disengaged from the printer 101. Thus, the user can easily dismount the printer 101 from the ASF 1.

As mentioned above, if the force required for disconnecting the connectors exceeds the pushing force of the pop-ups 43*a*, 43*b*, since the printer 101 is not moved even when the hook 16 is disengaged from the printer 101, the condition shown in FIG. 12 cannot be established, and, thus, the user cannot dismount the printer 101 from the ASF 1.

To avoid this, in the illustrated embodiment, as mentioned above, the pushing-out mechanism is added.

Incidentally, FIG. 17 shows a condition that the printer 101 is not moved even when the hook 16 is disengaged from the printer 101. In this condition, the left hook 16 has already disengaged from the hook fixing hole 103*y* and the regulation of the guide surface 39*b* of the positioning base 39 for regulating the movement of the boss 40*c* of the push lever 40 has already released.

Further, the push lever 40 is positioned so that the lever shaft 42 is urged against the upper end surface of a sliding hole 40*e* to regulate the depression of the left hook 16. Further, since a surface 40*d* of the push lever which abuts against the left hook 16 is curved (arc a center of which is the lever shaft 42), even when the push lever 40 is rotated, the position of the left hook 16 is not changed.

In this condition, when the user continues to push the push portion 40*a* of the push lever 40, the push lever 40 is rotated in the direction 40D around the lever shaft 42. When the push lever 40 is rotated in this way, in the condition that the left hook is disengaged from the printer 101, the protruded portion 40*b* of the push lever 40 abuts against the sheet feeding side lower portion 100*b* of the printer, thereby pushing the printer 101 toward the direction B.

Figure 18:
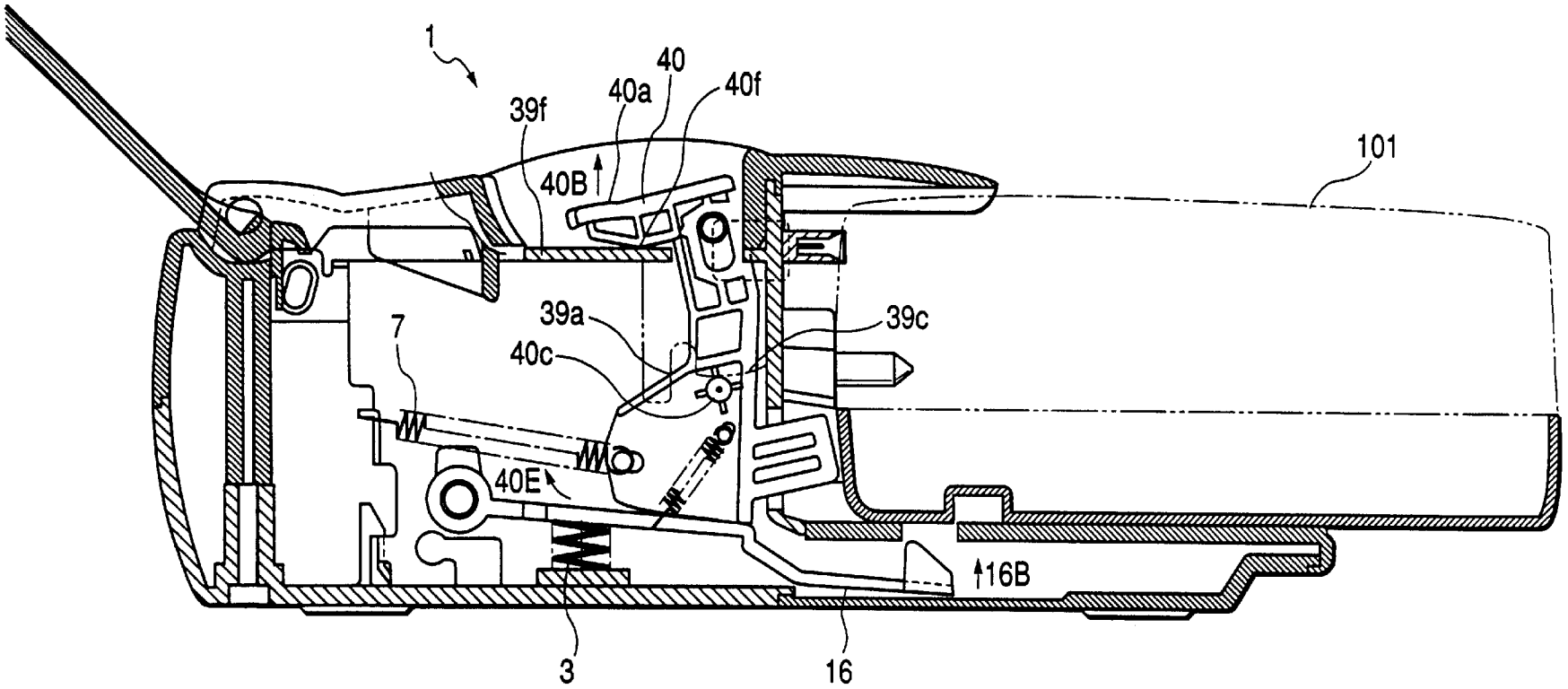
FIG. 18 is a left sectional view for explaining a mounting/dismounting mechanism between the ASF and the printer of the present invention.

Thereafter, when the push lever 40 is further pushed, as shown in FIG. 18, an abutment surface 40*f* of the push lever 40 abuts against a stopper portion 39*f* of the positioning base 39. At this position, the rotation of the push lever 40 is regulated. A pushed amount of the printer 101 (pushed by the push lever 40) is selected to be a shifting amount by which the fitting between the left hook 16 and the printer 101 is released and the connection between the connectors is released.

After the printer 101 is pushed in this way, the user stops the pushing of the push portion 40*a* of the push lever 40. As a result, the left hook 16 is lifted in the direction 16B by the hook spring 3. At the same time, the push lever 40 is pushed upwardly by the left hook 16, with the result that the boss 40*c* of the push lever 40 abuts against the guide surface 39*c* of the positioning base 39. Thereafter, the push lever 40 is rotated in the direction 40B by the force of the spring 7.

When the boss 40*c* of the push lever 40 abuts against the guide surface 39*a* of the positioning base 39, the rotation of the push lever 40 is regulated, and the push lever 40 is lifted in the direction 40B by the spring force of the hook spring 3.

As a result, as shown in FIG. 15, the connection between the connectors is ultimately released, and the left hook 16 is disengaged from the printer 101. Thus, the user can easily dismount the printer 101 from the ASF 1.

As mentioned above, in the illustrated embodiment, when the printer 101 is dismounted from the ASF 1, since the push lever 40 is pushed substantially in the vertical direction, a vertical force acts on the ASF 1 itself. Thus, when the printer 101 is pushed substantially in the horizontal direction, the ASF 1 is not moved. Further, since the printer 101 is pushed substantially in the horizontal direction, poor dismounting (which may occur if the printer 101 is moved in the mounting direction again by its own weight) can be prevented.

Figure 19:
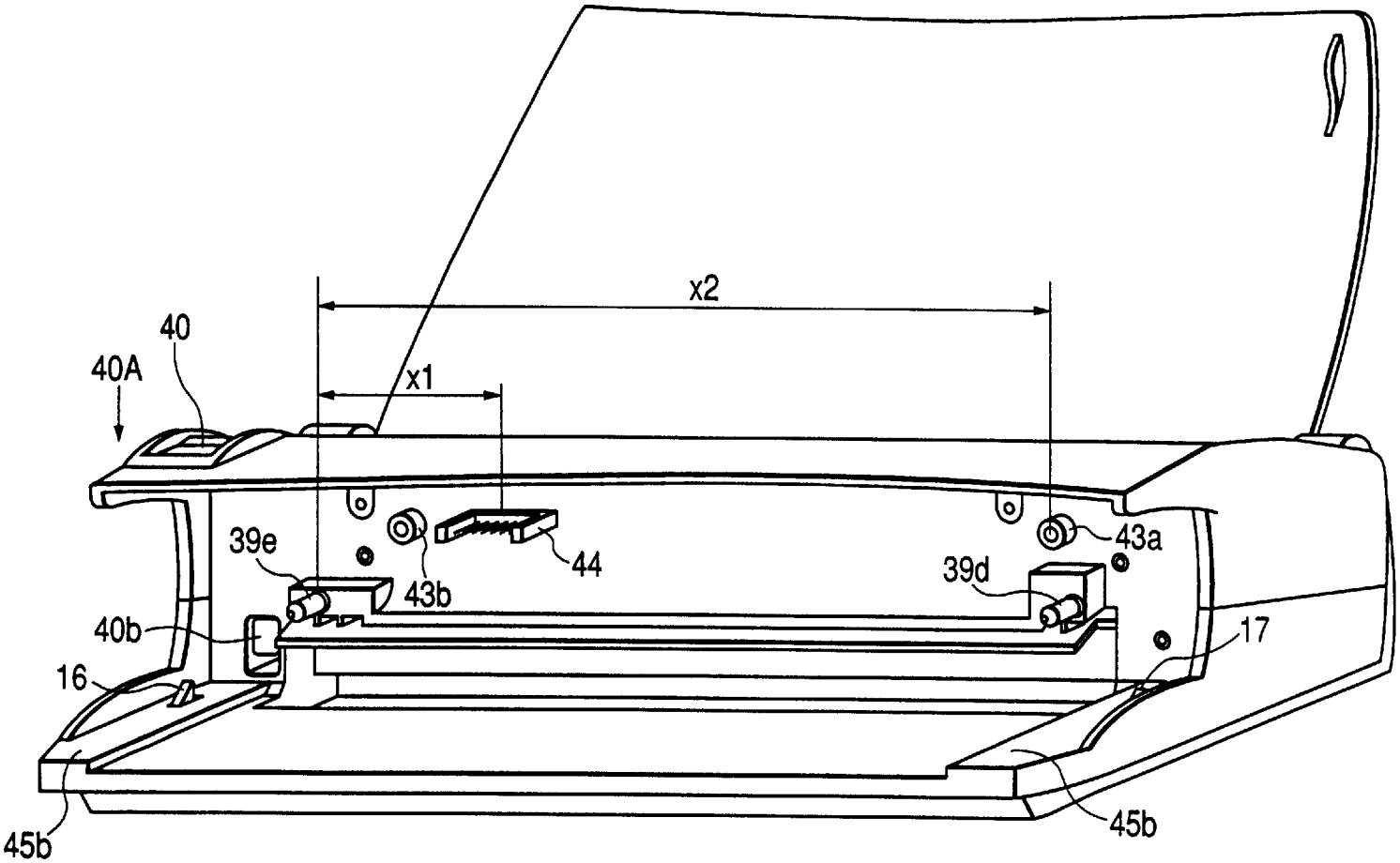
FIG. 19 is a perspective view showing part arrangement and a force relationship associated with the mounting/dismounting mechanism between the ASF and the printer of the present invention.
Figure 20:
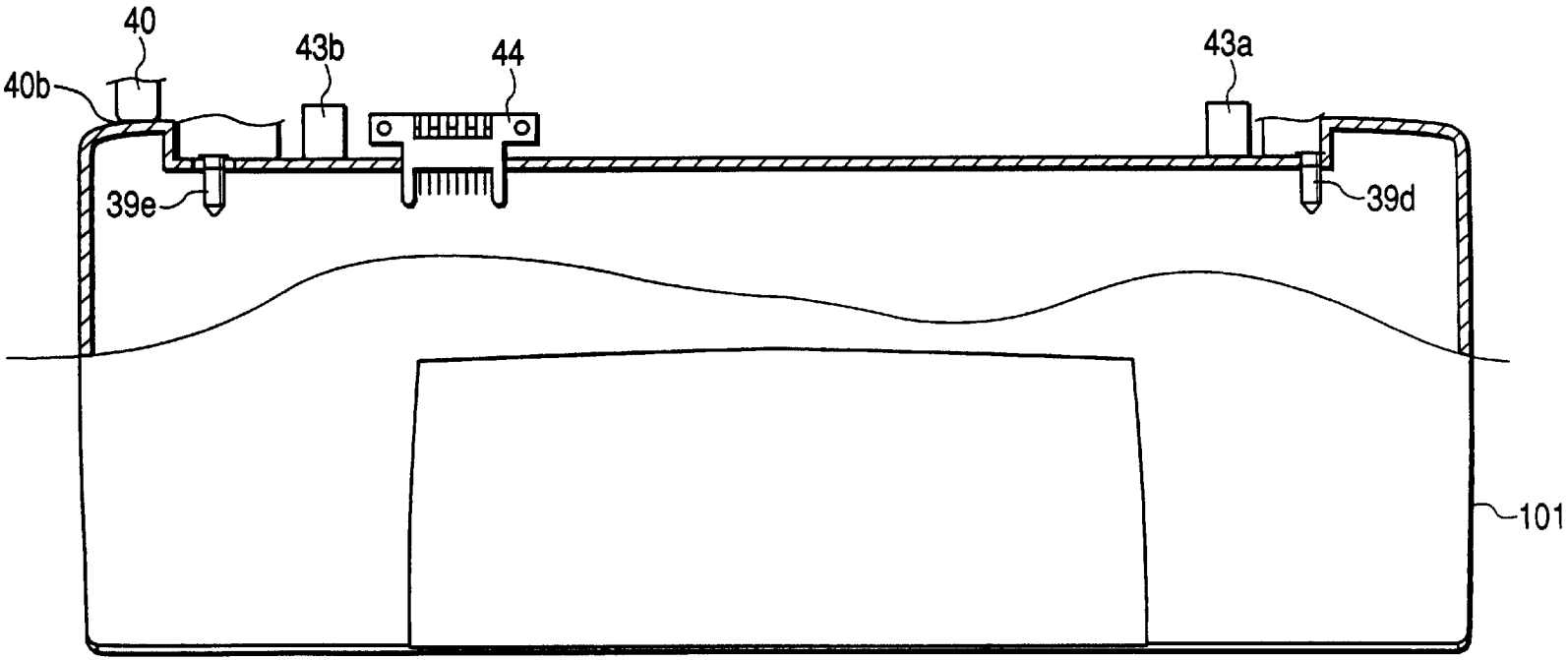
FIG. 20 is a top view for explaining the mounting/dismounting mechanism between the ASF and the printer of the present invention.

FIG. 19 shows arrangement of and a force relationship between the push lever 40, pop-ups 43*a*, 43*b*, positioning bosses 39*d*, 39*e*, left and right hooks 16, 17 and ASF connector 44 in the illustrated embodiment. FIG. 20 is a sectional view of the upper part of the ASF 1.

As shown in FIGS. 19 and 20, the left and right hooks 16, 17 and the positioning bosses 39*d*, 39*e* of the printer 101 are provided on both width-wise end portions of the printer 101. The ASF connector 44 is disposed between the two positioning bosses 39*e*, 39*d* near the second positioning boss 39*e*. The push lever 40 and the second pop-up 43*b* are disposed more remotely than the ASF connector 44 with respect to the first positioning boss 39*d*.

With this arrangement, when the printer 101 is dismounted from the ASF 1, as mentioned above, the push lever 40 is pushed in the direction 40A, and, at the same time, the protruded portion 40*b* of the push lever 40 is urged against the printer 101 to push out the printer 101 in the condition that the hooks 16, 17 are disengaged from the hook fixing holes 103*y*, 103*z* (FIG. 14), thereby releasing the connection between the connectors (as well as the disengagement between the hooks 16, 17 and the hook fixing holes 103*y*, 103*z*). In this way, the dismounting of the printer can be achieved.

The pop-ups 43*a*, 43*b* are auxiliary members for reducing the user's force required for pushing the push lever 40 and are slidably biased by elastic members (not shown) toward the printer pushing direction.

In the illustrated embodiment, the printer 101 is pushed while sliding it on the printer sliding portions 45*b* and rotating around the positioning boss 39*d* or 39*e*.

Figure 21:
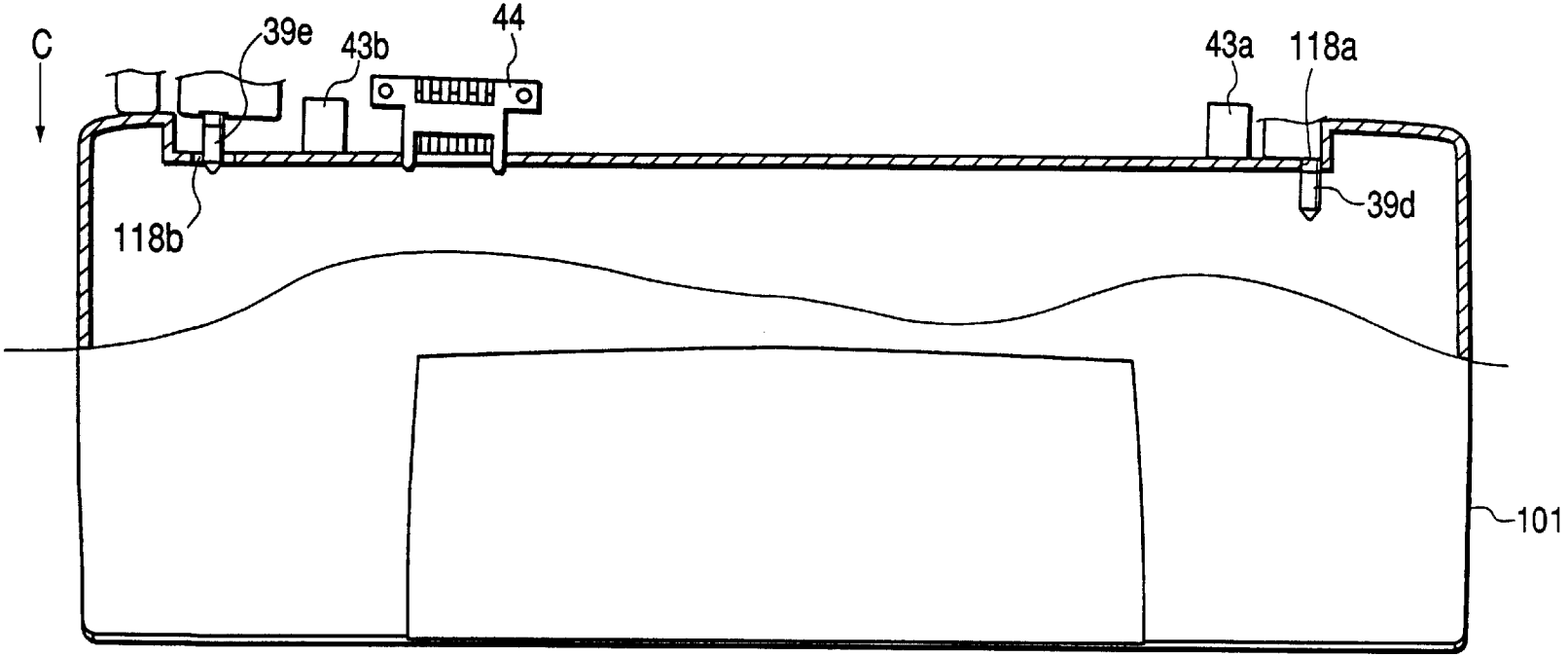
FIG. 21 is a top view for explaining the mounting/dismounting mechanism between the ASF and the printer of the present invention.

Since the printer positioning hole 118*a* associated with the first positioning boss is the circular hole and the printer positioning hole 118*b* associated with the second positioning boss is the elongated hole (refer to FIG. 12), from the condition shown in FIG. 20, when the printer 101 tries to be dismounted from the ASF 1 while rotating around the first positioning boss 39*d*, a positional relationship between the printer 101 and the ASF 1 becomes as shown in FIG. 21.

However, when such a condition (relationship) is established, since the non-detachment between the first positioning boss 39*d* and the positioning hole 118*a* occurs, the printer 101 cannot be moved only by the pushing force of the first pop-up 43*a*. If the user tries to forcibly dismount the printer 101 from the ASF 1, the first positioning boss 39*d* will be deformed or damaged.

To avoid this, in the illustrated embodiment, the non-detachment is prevented by deviating the fitting position between the first positioning boss 39*d* and the positioning hole 118*a* (rotational center of the printer) toward the connector disconnecting direction by the force of the first pop-up 43*a* before the printer 101 is pushed out by the push lever 40 and the second pop-up 43*b*.

That is to say, in the dimensional relationship shown in FIG. 19, a force required for pushing out the printer 101 by the pushing force of the first pop-up 43*a* while rotating the printer around the second positioning boss 39*e* has the following value:

$$F1>(X1/X2)\times P1+P2$$

where, F1 is the printer pushing force of the first pop-up 43*a*, P1 is the disconnecting force for disconnecting the connector 44, P2 is a friction force between the printer 101 and the printer sliding surfaces 45*b* of the ASF 1, X1 is a distance between the second positioning boss 39*e* (rotational center) and the connector 44, and X2 is a distance between the second positioning boss 39*e* (rotational center) and the first pop-up 43*a*.

As apparent from the above relationship, the greater the distance the first pop-up 43*a* and the ASF connector 44 (i.e., the smaller the value of X1/X2), the smaller the pushing force F1 of the first pop-up 43*a*. As mentioned above, the printer pushing force F1 of the first pop-up 43*a* acts as the reaction force when the printer 101 is mounted to the ASF 1, and, in consideration of the fact that the connector disconnecting force is generally 1 to 2 kgf, the value of X1/X2 is preferably equal to or smaller than 0.5.

On the other hand, in the illustrated embodiment, the pawl height of the right hook 17 is selected to be smaller than the pawl height of the left hook 16 so that the right hook 17 is disengaged from the hook fixing hole 103*z* (FIG. 12) before the left hook 16 is disengaged from the hook fixing hole 103*y*.

Figure 22:
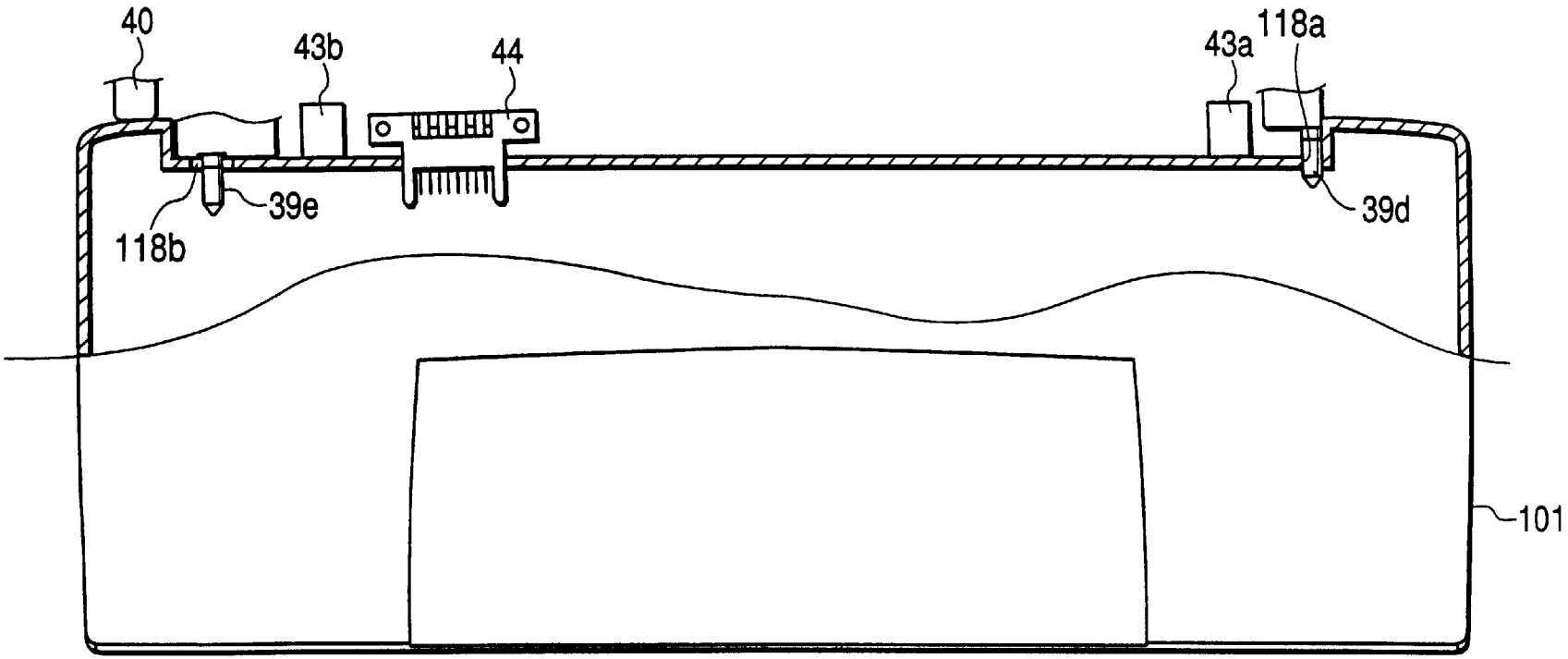
FIG. 22 is a top view for explaining the mounting/dismounting mechanism between the ASF and the printer of the present invention.

With this arrangement, at the moment when the right hook 17 is disengaged from the hook fixing hole 103*z*, the printer 101 is rotated around the second positioning boss 39*e* (rotational center) by the pushing force of the first pop-up 43*a*, with the result that the fitting position between the first positioning boss 39*d* and the positioning hole 118*a* is shifted toward the connector disconnecting direction, as shown in FIG. 22.

Figure 23:
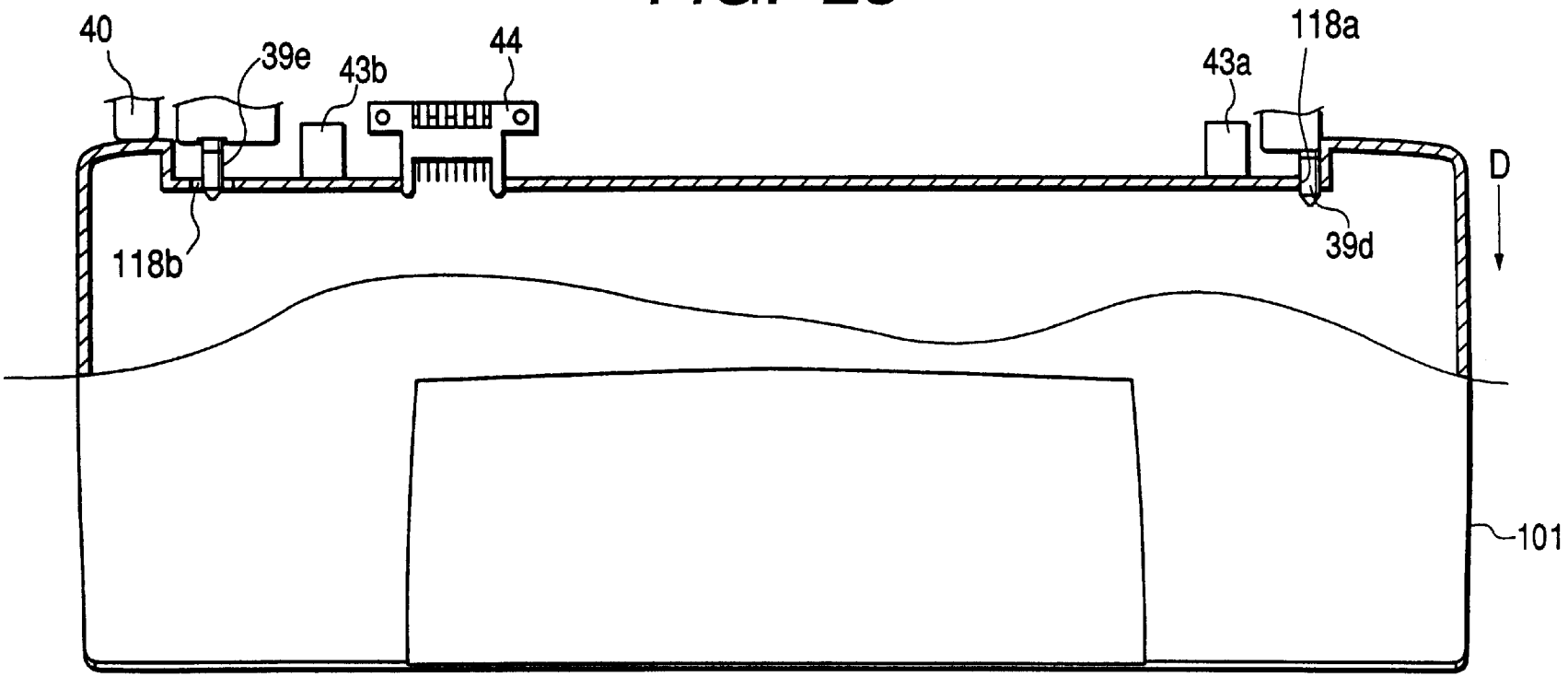
FIG. 23 is a top view for explaining the mounting/dismounting mechanism between the ASF and the printer of the present invention.

Thereafter, the left hook 16 is disengaged from the hook fixing hole 103*y*. In this condition, when the printer 101 is pushed out by the push lever 40 and the second pop-up 43*b*, as shown in FIG. 23, the printer 101 can be dismounted from the ASF 1 without non-detachment between the first positioning boss 39*d* and the positioning hole 118*a*.

In the case where the push lever 40 and the second pop-up 43*b* are arranged between the first positioning boss 39*d* (rotational center for the printer 101) and the ASF connector 44, if the connecting force between the connectors is great, the printer 101 will be rotated around the connector 44, with the result that the non-detachment between the first positioning boss 39*d* and the positioning hole 118*a* (circular hole) of the printer 101 occurs, thereby deforming or damaging the boss 39*d*.

For this reason, as mentioned above, it is required that the push lever 40 and the second pop-up 43*b* are disposed more remotely than the ASF connector 44 with respect to the first positioning boss 39*d*.

Incidentally, in order to prevent the non-detachment, only the first pop-up 43*a* may be provided. (Control portion)

Figure 24:
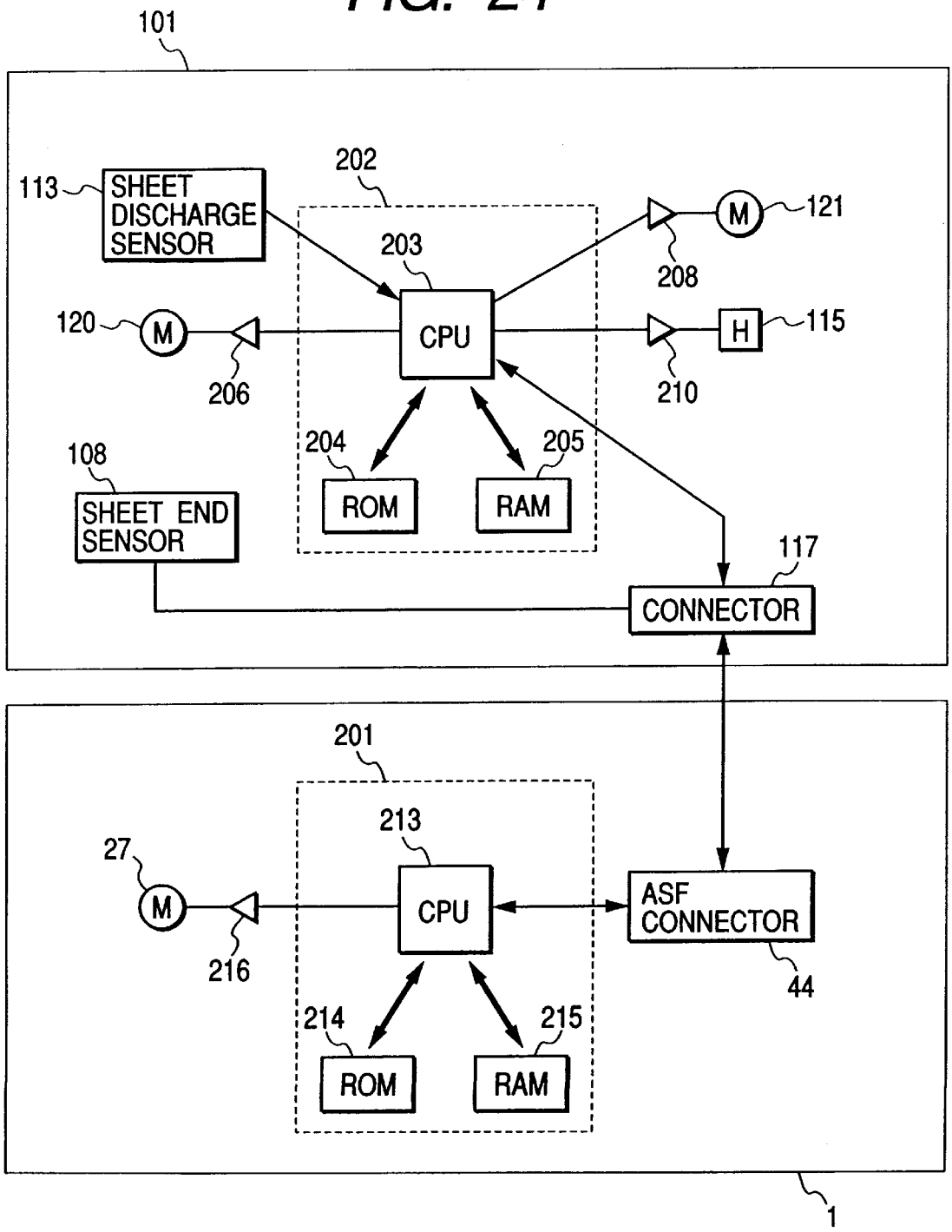
FIG. 24 is a connection block diagram of the ASF and the printer of the present invention.

FIG. 24 is a connection block diagram of a printer control portion and an ASF control portion according to the present invention.

A printer control portion 202 for controlling the printer 101 is disposed on a substrate 123 shown in FIG. 4 and includes a microcomputer in which a CPU 203, a ROM 204 and a RAM 205 are connected by buses.

When the recording is effected by the printer 101, the printer control portion 202 drives a carriage motor 121 via a motor driver 208 and drives the recording head 115 mounted on a carriage (not shown) connected to the carriage motor 121 via a head driver 210 on the basis of printer control program stored in the ROM 204, thereby effecting one-line recording.

Thereafter, the printer control portion 202 drives a sheet feeding motor 120 via a motor driver 206 to feed the sheet and drives the carriage motor 121 and the recording head 115 again, thereby effecting next one-line recording. By repeating these operations, the recording on the sheet is completed. The connector 117 acts as a bi-communication port for outputting a command signal from the CPU 203 of the printer control portion to an external part and inputting an external response signal to the CPU 203 and can supply an electric power to the external part as will be described later. A sheet end sensor 108 is provided within the printer 101 and has an optical or mechanical switch. Output voltage of the sheet end sensor 108 is changed from a LOW condition to a HIGH condition. A sheet discharge sensor 113 has the same function as the sheet end sensor 108, and output voltage of this sensor 113 is changed to a HIGH condition if the recorded sheet remains within the printer 101.

The output voltage values of the sheet end sensor 108 and the sheet discharge sensor 113 can be monitored by the CPU 203, and the output voltage of the sheet end sensor 108 can be outputted to outside directly through the connector 117.

Similar to the printer control portion 202, an ASF control portion 201 for controlling the ASF 1 includes a microcomputer in which a CPU 213, a ROM 214 and a RAM 215 are connected by buses. The CPU 213 drives a sheet feeding motor 27 via a motor driver 216 on the basis of ASF control program stored in the ROM 214. The ASF connector 44 acts as a bi-communication port for receiving a signal from an external equipment such as the printer 101 and for outputting a signal from the CPU 213 of the ASF control portion 201.

(Communication port portion)

Figure 26:
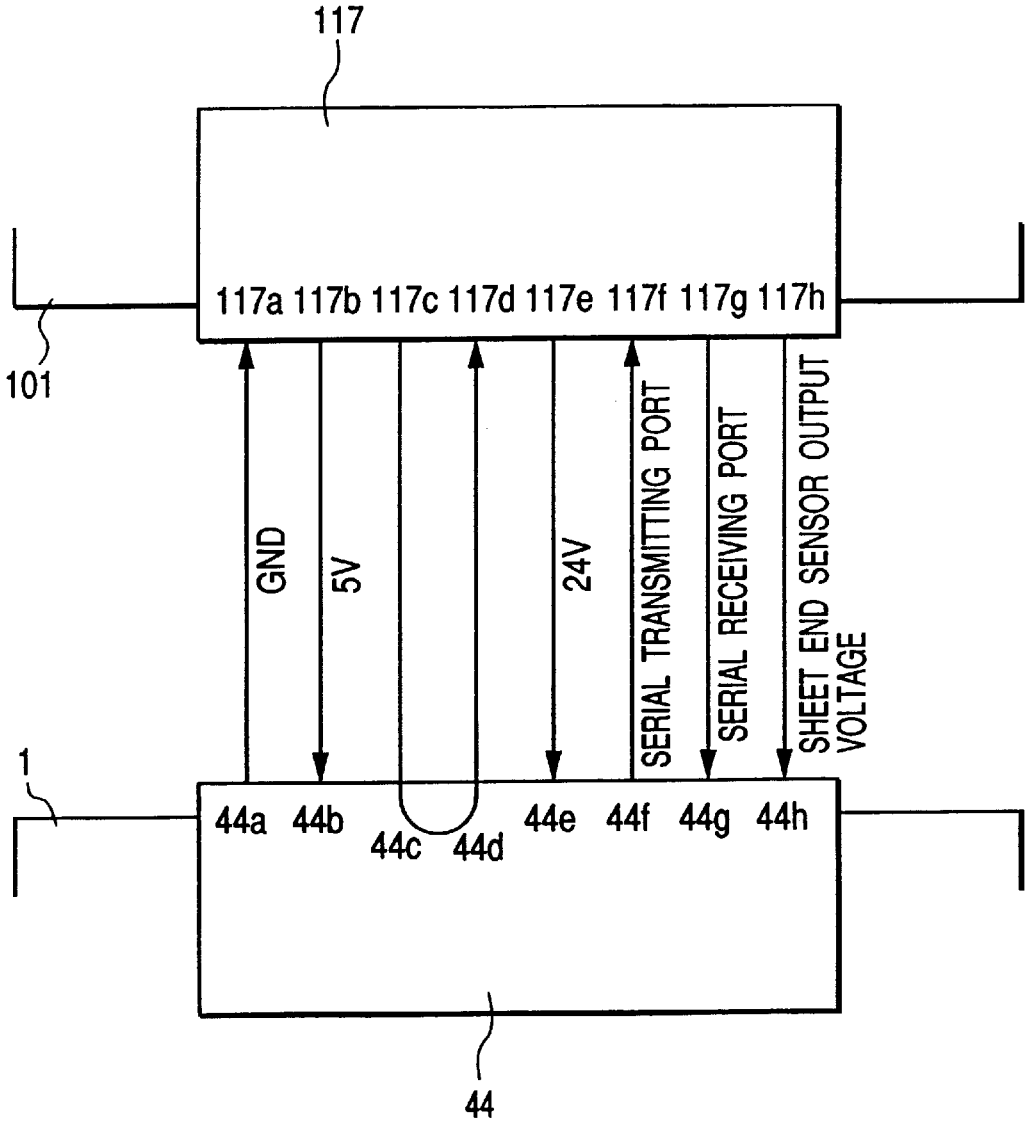
FIG. 26 is a schematic view showing connection between a connector and an ASF connector 44.

FIG. 26 schematically shows the detailed constructions of the connector 117 and the ASF connector 44. The connector 117 and the ASF connector 44 have eight ports 117*a* to 117*h* and 44*a* to 44*h*, and, when the ASF 1 is mounted to the printer 101, the corresponding ports are interconnected electrically.

The ASF 1 includes a GND line 44*a*, a 5 V power source line 44*b* for a signal, a 24 V power source line 44*e* for driving the sheet feeding motor 27, a transmitting port 44*f* for transmitting a signal to the printer, a receiving port 44*g* for receiving a signal from the printer, and a line 44*h* for receiving the output voltage of the sheet end sensor 108 of the printer 101. Since the ports 44*c* and 44*d* become short-circuit, in the printer 101, it can easily be ascertained that the equipment is connected to the external part via the ports 117*c* and 117*d*.

(Separation of ASF and convey mechanism portion)

Figure 25:
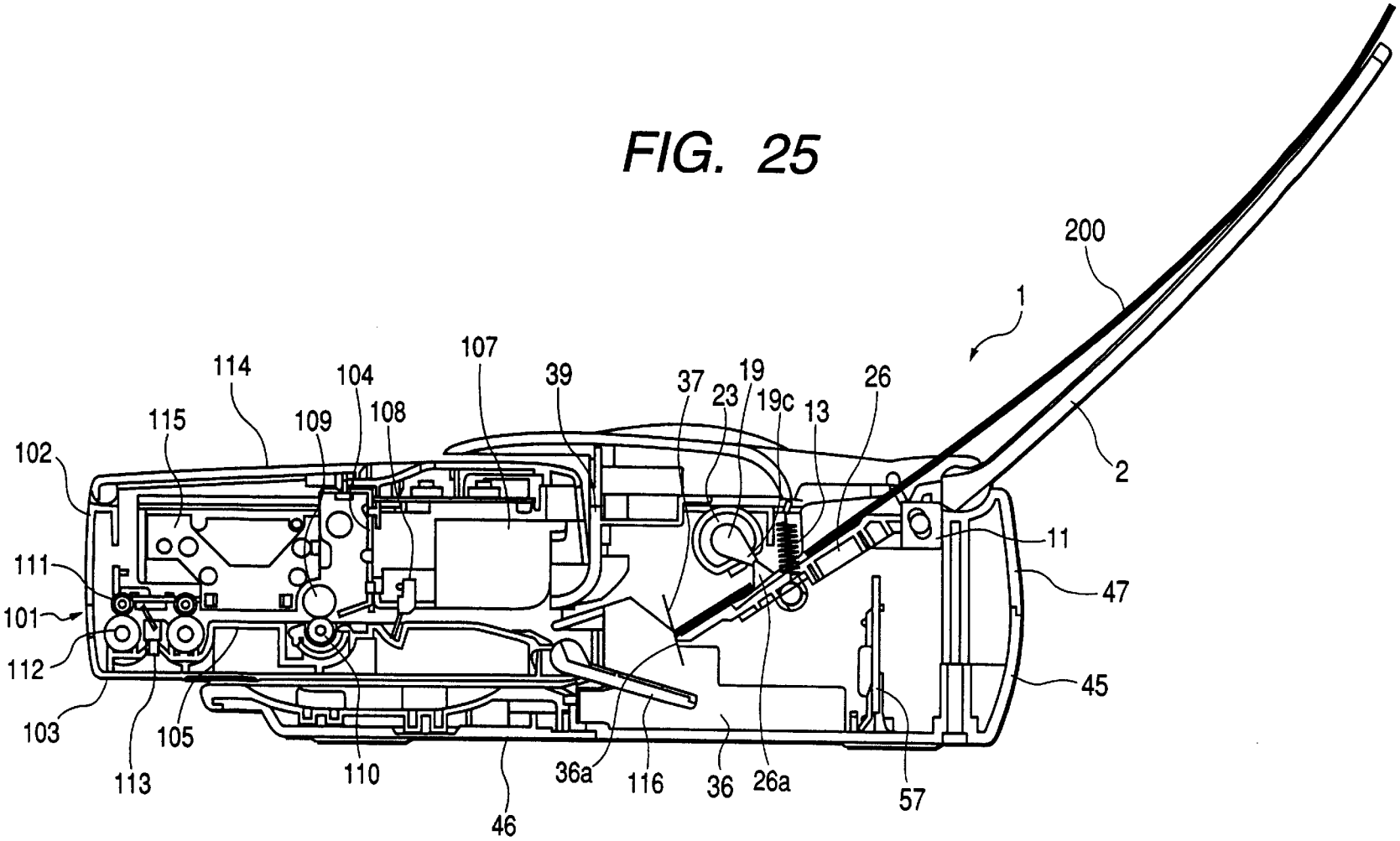
FIG. 25 is a schematic sectional view showing a connection condition between the ASF and the printer of the present invention.

FIG. 25 is a sectional view showing the condition that the ASF (to be mounted) according to the present invention is mounted to the printer.

The sheet feeding roller 19 for feeding out the sheet 200 is provided with the sheet feeding rubber 23 mounted thereon. When the sheet feeding roller 19 is rotated, the sheet 200 is conveyed by the frictional force of the sheet feeding rubber 23.

The pressure plate 26 on which the sheets 200 are stacked has both ends (upstream in the sheet conveying direction) rotatably supported by the ASF chassis 11. The pressure plate 26 is biased toward the sheet feeding rubber 23 by the pressure plate spring 13. In an initial condition, since cam portions 19*c* provided on both ends of the sheet feeding roller 19 are engaged by cam portions 26*a* provided on both ends of the pressure plate 26, the pressure plate 26 is spaced apart from the sheet feeding rubber 23 so that the sheets 200 can be set smoothly. The bank 36 has an abutment surface 36*a* disposed on an extension line of the pressure plate 26 in the sheet conveying direction. When the sheets 200 are set, the leading ends of the sheets are urged against the abutment surface 36*a*. The bank sheet (sheet separating member) 37 is attached to the abutment surface 36*a*. The bank sheet 37 is formed from an elastic member such as plastic film, so that the sheets 200 are separated one by one by an elastic force generated when the bank sheet is flexed.

(Convey mechanism and printing mechanism of printer)

Next, a convey mechanism portion and a printing mechanism portion of the printer 101 shown in FIG. 25 will be described.

The LF roller 109 for conveying the sheet 200 is constituted by coating material having high coefficient of friction such as urethane resin on a surface of a metallic pipe and is rotated by the sheet feeding motor 120 shown in FIG. 24 and cooperates with the pinch roller 110 to pinch the sheet 200 therebetween and convey the sheet.

The recording head 115 serves to record image information on the conveyed sheet 200 and is mounted on the carriage (not shown) reciprocating in the longitudinal direction of the LF roller 109. The recording head 115 is driven by the carriage motor 121 (FIG. 24) together with the carriage to be reciprocated in the width-wise direction of the sheet 200 (perpendicular to the plane of FIG. 25).

The spur rollers 111 and the sheet discharge rollers 112 are disposed at a downstream side of the LF roller 109 and the recording head 115 and constitutes two pairs of rollers for conveying the recorded sheet 200. The discharge rollers 112 are connected to the LF roller 109 via drive transmitting members (not shown) and are rotated by the LF roller 109 in the same direction as the LF roller 109 to convey the sheet 200.

The sheet end sensor 108 is disposed at an upstream side of the LF roller 109 in the sheet path, and a sheet discharge sensor is disposed between two pairs of sheet discharge rollers. Output voltage of each of these sensors is changed from a LOW condition to a HIGH condition when the sheet 200 passes through the sensor.

(Drive mechanism portion of ASF)

Figure 27:
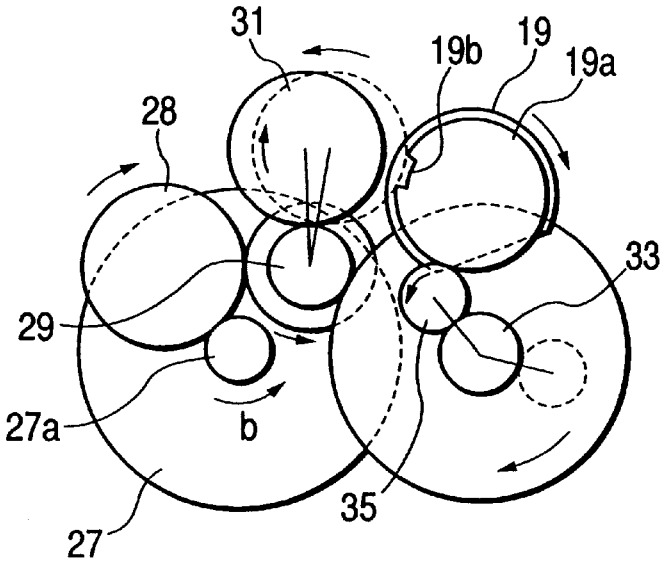
FIG. 27 is a schematic view showing connecting and operating directions of a drive mechanism portion of the ASF.
Figure 28:
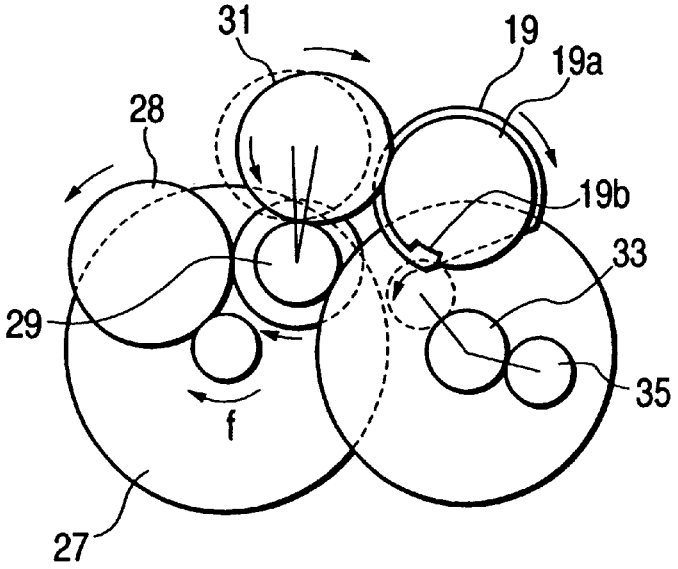
FIG. 28 is a schematic view showing connecting and operating directions of a drive mechanism portion of the ASF.

FIGS. 27 and 28 show a drive mechanism of the ASF (to be mounted) according to the present invention.

The sheet feeding motor 27 is a reversible stepping motor. An idle gear 28 is meshed with a motor gear 27*a* of the sheet feeding motor 27. An ASF double gear 29 including two gears having different diameters is meshed with the idle gear 28. A normal rotation planetary gear 31 is meshed with the small diameter gear of the ASF double gear and is revolved around the ASF double gear. A reverse rotation sun gear 33 including two gears having different diameters is meshed with the small diameter gear of the ASF double gear. A reverse rotation planetary gear 35 is meshed with the small diameter gear of the reverse rotation sun gear 33 and is revolved around the reverse rotation sun gear. A sheet feeding roller gear 19*a* provided on an end of a shaft of the sheet feeding roller 19 has a non-toothed portion 19*b*. The sheet feeding roller gear 19*a* is disposed on revolution paths of the normal rotation planetary gear 31 and the reverse rotation planetary gear 35 and is adapted to be engaged by these gears.

Next, operation of the gears will be described. In FIG. 27, when the sheet feeding motor 27 is rotated (reverse rotation) in a direction shown by the arrow b, the gears are rotated in directions shown by the respective arrows. That is to say, the reverse rotation planetary gear 35 is revolved (in the direction shown by the arrow) around the reverse rotation sun gear 33 via the idle gear 28 and the ASF double gear 29 from a position shown by the broken line in FIG. 27 toward a position shown by the solid line to be engaged by the sheet feeding roller gear 19*a*. As a result, the sheet feeding roller 19 is rotated in the direction shown by the arrow (direction along which the sheets 200 rested on the pressure plate 26 are fed out toward the printer). When the sheet feeding roller gear 19*a* meshed with and rotated by the reverse rotation planetary gear 35 is rotated to a position where the non-toothed portion 19*b* is opposed to the reverse rotation planetary gear 35, the sheet feeding roller gear is disengaged from the reverse rotation planetary gear, with the result that the sheet feeding roller gear is not rotated even when the sheet feeding motor 27 is further rotated in the reverse direction.

In this case, since the normal rotation planetary gear 31 is revolved in the direction shown by the arrow from a position shown by the broken line in FIG. 27 toward a position shown by the solid line and is stopped by a stopper (not shown), the rotation of the sheet feed roller is not influenced.

In FIG. 28, when the sheet feeding motor 27 is rotated (normal rotation) in a direction shown by the arrow f, the gears are rotated in directions shown by the respective arrows. That is to say, the normal rotation planetary gear 31 is revolved (in the direction shown by the arrow) around the ASF double gear 29 via the idle gear 28 and the ASF double gear 29 from a position shown by the broken line in FIG. 28 toward a position shown by the solid line to be engaged by the sheet feeding roller gear 19*a*. As a result, the sheet feeding roller 19 is rotated in the direction shown by the arrow in FIG. 28 (direction along which the sheets 200 rested on the pressure plate 26 are fed out toward the printer 101). When the sheet feeding roller gear 19*a* meshed with and rotated by the normal rotation planetary gear 31 is rotated to a position where the non-toothed portion 19*b* is opposed to the normal rotation planetary gear 31, the sheet feeding roller gear is disengaged from the normal rotation planetary gear, with the result that the sheet feeding roller gear is not rotated even when the sheet feeding motor 27 is further rotated in the normal direction.

In this case, since the reverse rotation planetary gear 35 is revolved in the direction shown by the arrow from a position shown by the broken line in FIG. 28 toward a position shown by the solid line and is stopped by a stopper (not shown), the rotation of the sheet feed roller is not influenced.

At the position where the non-toothed portion 19*b* of the sheet feeding roller gear 19*a* is opposed to the normal rotation planetary gear 31, the cam portions 19*c* of the sheet feeding roller are just engaged by the cam portions 26*a* of the pressure plate 26 to assume the same phase as the initial condition, with the result that the pressure plate 26 is spaced apart from the sheet feeding rubber 23.

Accordingly, when the sheet feeding motor 27 is continuously rotated in the normal direction, the cam portions 19*c* of the sheet feeding roller are engaged by the cam portions 26*a* of the pressure plate, and the sheet feeding roller 19 is stopped at the same phase as the initial condition while keeping the condition that the pressure plate 26 is spaced apart from the sheet feeding rubber 23. Thereafter, since the normal rotation planetary gear 31 and the reverse rotation planetary gear 35 are idly rotated at the positions shown by the solid line in FIG. 28, a stable condition that the rotation is not transmitted to the sheet feeding roller 19 is established.

As mentioned above, regardless of the normal and reverse rotations of the sheet feeding motor 27, the sheet feeding roller 19 is rotated only in the direction along which the sheet 200 is fed out toward the printer 101 and is not rotated in the opposite direction.

(Sheet feeding operation and recording operation of printer)

Next, a series of operation for feeding, conveying and discharging the sheet 200 effected by the printer and the ASF according to the present invention will be explained.

When recording command is received from an external information equipment such as a computer, the printer 101 performs the sheet feeding operation and then performs the recording operation.

Figure 29:
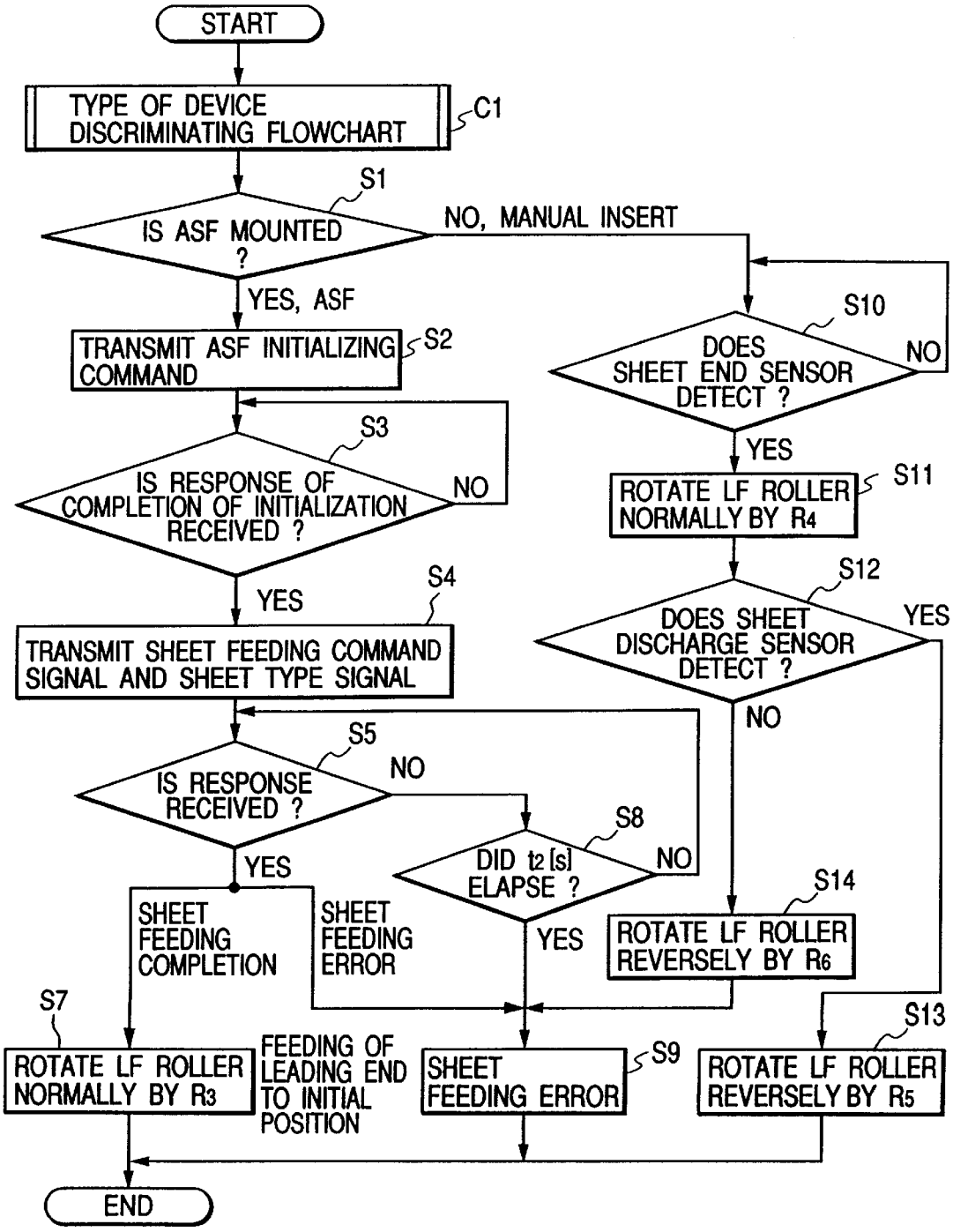
FIG. 29 is a control flowchart of a sheet feeding operation in a printer control portion according to a first embodiment.

FIG. 29 is a control flowchart showing the sheet feeding operation of the printer 101. First of all, the printer control portion 202 of the printer 101 executes a sub flowchart C1. Although the detailed contents will be described later with reference to FIG. 33, the sub flowchart C1 serves to discriminate a kind of the apparatus mounted on the printer thorough the ports 117*f*, 117*g* shown in FIG. 26.

Then, the program goes to a step S1 where, if the result of the sub flowchart C1 indicates the fact that the ASF is mounted on the printer 101, since the sheet is fed from the ASF, the program goes to a step S2. In the step S2, the printer control portion 202 transmits an initializing command signal to the ASF, and then the program goes to a step S3.

In the step S3, if there is no response signal indicating completion of initialization from the ASF, the program returns to the step S3. When the response signal is received, the program goes to a step S4. In the step S4, the printer control portion 202 transmits a sheet feeding command signal and a sheet type signal indicating type of sheet to be fed (ordinary paper, coated paper, post card, glossy film or the like) to the ASF, and the program goes to a step S5.

In the step S5, if there is no response signal from the ASF, the program goes to a step S8 where, if a predetermined limit time period t2 is not elapsed, the program returns to the step S5. In the step S8, if the limit time period t2 from the start of the sheet feeding is elapsed, the program goes to a step S9 where the printer control portion 202 emits sheet feeding error signal, and the sheet feeding operation is ended. In the step S5, if there is response from the ASF and the response is a signal indicating sheet feeding completion, the program goes to a step S7. The step S7 serves to effect feeding of a leading end of the sheet 200 to the initial position. In the step S7, the printer control portion 202 drives the sheet feeding motor 120 to rotate the LF roller 109 by a predetermined amount R3 in the sheet conveying direction (normal direction), and the sheet feeding operation is ended. The predetermined amount R3 is selected so that the leading end of the sheet 200 does not reach a sheet detectable area of the sheet discharge sensor 113 but reach immediately below the recording head 115. Accordingly, when the printer 101 then starts to effect the recording on the sheet 200, it is not required that the sheet 200 is returned toward the upstream side in the conveying direction. Thus, since the trailing end of the sheet does not strike against the internal mechanisms of the ASF, folding of the sheet and erroneous feeding of the sheet can be prevented.

In the step S5, if there is response from the ASF and the response is a signal indicating sheet feeding error, the program goes to a step S9, where the printer control portion 202 emits the sheet feeding error signal, and the sheet feeding operation is ended.

In the step S1, if the result of the sub flowchart C1 indicates the fact that the ASF is not mounted on the printer 101, since the sheet is manually fed (manual insertion), the program goes to a step S10.

In the step S10, if the sheet is not inserted by the user, since the output voltage of the sheet end sensor 108 is in the LOW condition, the sheet is not detected, and the program returns to the step S10. When the sheet 200 is inserted into the printer 101 by the user until the leading end of the sheet abuts against the LF roller 109, since the output voltage of the sheet end sensor 108 is changed to the HIGH condition and the sheet is detected, the program goes to a step S11. In the step S11, the printer control portion 202 drives the sheet feeding motor 120 via the motor driver 206 to rotate the LF roller 109 by a predetermined amount R4 in the normal direction (direction along which the sheet is conveyed during the recording). The predetermined amount R4 is selected so that the leading end of the sheet 200 can reach the sheet detectable area of the sheet discharge sensor 113. Then, the program goes to a step S12, where, if the sheet discharge sensor 113 detect the sheet 200, it is judged that the sheet feeding is succeeded, and the program goes to a step S13. In the step S13, the printer control portion 202 drives the sheet feeding motor 120 via the motor driver 206 to rotate the LF roller 109 by a predetermined amount R5 in the reverse direction (direction opposite to the direction along which the sheet is conveyed during the recording). The predetermined amount R5 is selected so that the sheet 200 conveyed to the sheet detectable area of the sheet discharge sensor 113 is returned up to the recording start position but the leading end of the sheet 200 does not leave the nip between the LF roller 109 and the pinch roller 110.

In the step S12, if the sheet discharge sensor 113 does not detect the sheet 200 (for example, if the sheet 200 is not pinched between the LF roller 109 and the pinch roller 110 due to poor urging of the sheet against the LF roller 109, or if the leading end of the sheet 200 does not reach the sheet detectable area of the sheet discharge sensor 113 even when the conveyance of the predetermined amount R4 is effected due to oblique urging of the sheet 200 against the LF roller 109), the printer control portion judges that the manual sheet feeding is failed, and the program goes to a step S14. In the step S14, the printer control portion 202 drives the sheet feeding motor 120 via the motor driver 206 to rotate the LF roller 109 by a predetermined amount R6 in the reverse direction.

The predetermined amount R6 is selected to a value sufficient to leave the sheet 200 conveyed to the sheet detectable area of the sheet discharge sensor 113 from the nip between the LF roller 109 and the pinch roller 110.

With the arrangement as mentioned above, in the manual insertion, by ascertaining whether the sheet is detected by the sheet discharge sensor 113 or not, the success of the sheet feeding can surely be confirmed, and, if the sheet feeding is failed, since the sheet 200 is returned up to the position where the sheet is not pinched between the LF roller 109 and the pinch roller 110, the sheet 200 can easily be removed, and the manual insertion is effected again.

Incidentally, unlike to the mounting of the ASF, in the manual insertion, since there is no mechanism against which the sheet strikes, even when the sheet 200 is conveyed in the opposite direction, folding of the sheet and erroneous feeding of the sheet do not occur.

After the sheet feeding operation is finished by the above-mentioned sheet feeding control flowchart, the printer 101 performs the recording operation. The printer control portion 202 drives the carriage motor via the motor driver 298 and drives the recording head 115 mounted on the carriage (not shown) connected to the carriage motor 121 via the head driver 210, thereby effecting one-line recording. Thereafter, the printer control portion 202 drives the sheet feeding motor 120 via the motor driver 206 to convey the sheet 200 by an amount corresponding to one line and drives the carriage motor 121 and the recording head 115 again, thereby effecting next one-line recording. By repeating these operations, the recording on the sheet is completed. When the recording is completed, the printer control portion 202 drives the sheet feeding motor 120 to rotate the LF roller 109 in the normal direction. As a result, the sheet discharge rollers 112 are rotated to discharge the sheet 200 out of the printer 101.

(Sheet feeding operation of ASF)

Figure 30:
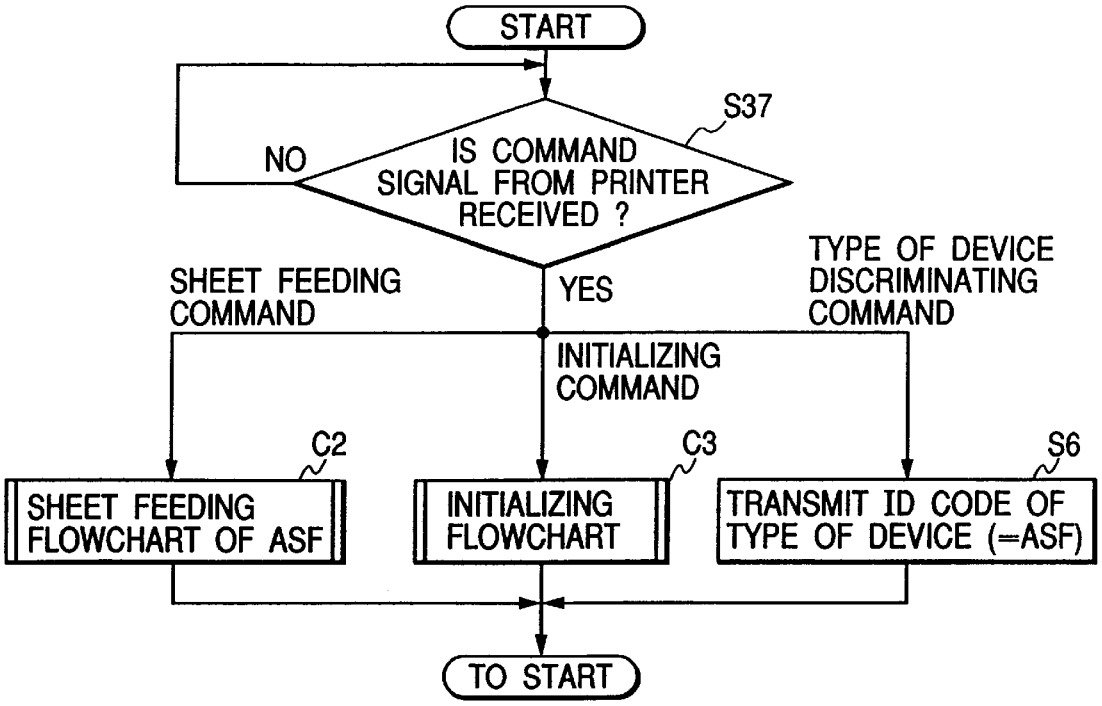
FIG. 30 is a main control flowchart of an ASF control portion.

FIG. 30 shows a main control flowchart of the ASF which can be mounted to the printer according to the present invention. The ASF control portion 201 according to the present invention is normally in a waiting condition after it was connected to the printer 101, and, as shown in a step S37, if a command signal from the printer 101 is not received, the step S37 is repeatedly executed until the command signal is received. When the command signal from the printer 101 is received through the serial receiving port 44*g* shown in FIG. 26, in accordance with the contents of the command signal, the program goes to the following sub flowchart or the following step. That is to say, when the command signal from the printer 101 indicates "sheet feeding command", the program goes to a sub flowchart C2 for controlling the sheet feeding operation of the ASF; whereas, when the command signal indicates "initializing command", the program goes to a sub flowchart C3 for controlling the initializing operation. After the respective sub flowcharts are completed, the program goes to the step S37 again to restore the waiting condition. When the command signal from the printer 101 indicates "type of device discriminating command", the program goes to a step S6. When code ID indicating the type of the ASF 1 itself is transmitted to the printer 101 through the serial transmitting port 44*f*, the program goes to the step S37 again to restore the waiting condition.

Among the above-mentioned two sub flowcharts, here, the sub flowchart C2 for controlling the sheet feeding operation of the ASF is firstly explained, and the details of the sub flowchart C3 for controlling the initializing operation will be described later.

Figure 31:
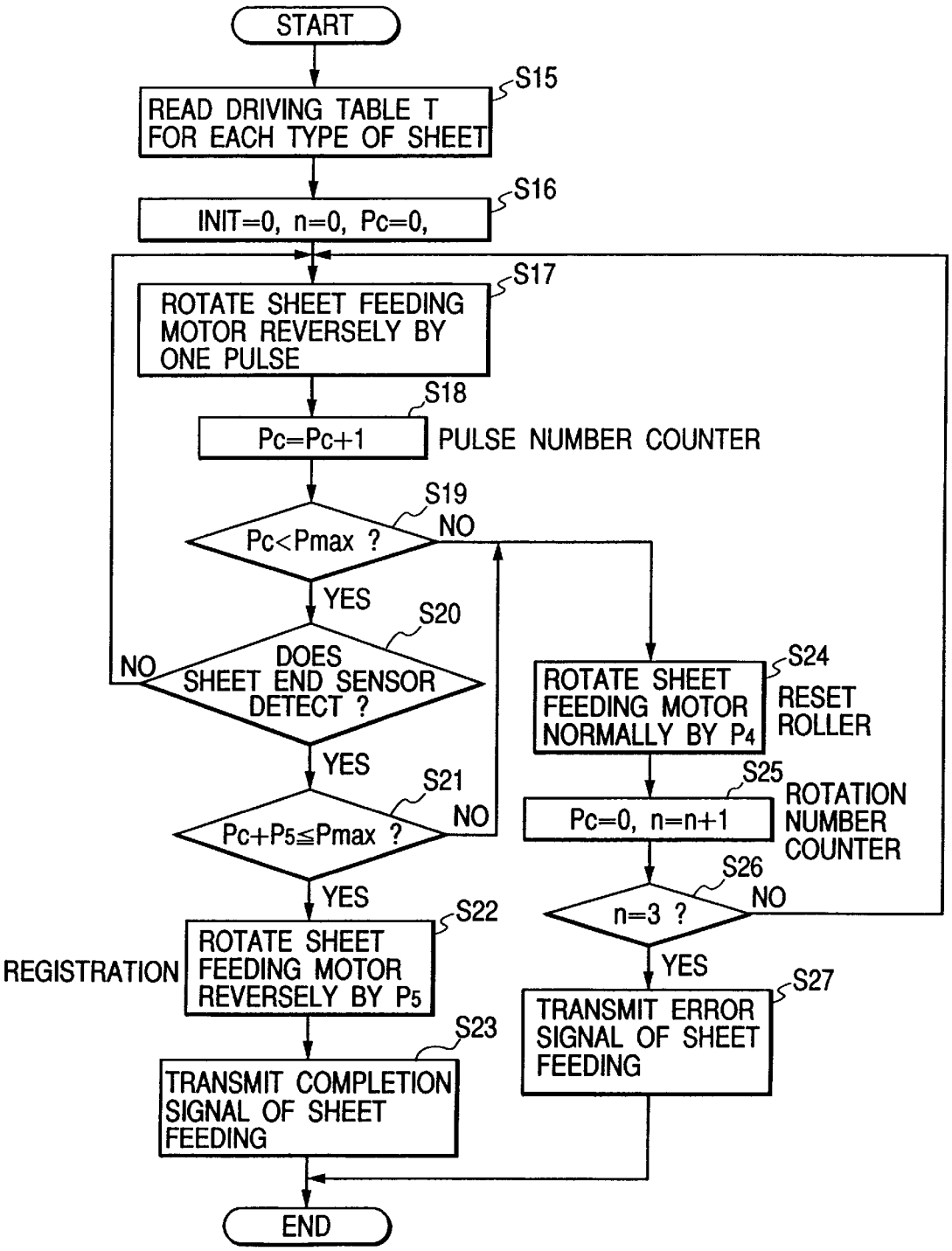
FIG. 31 is a sub flowchart C2 of sheet feeding operation control in the ASF control portion according to a first embodiment.

FIG. 31 shows the sub flowchart C2 for controlling the sheet feeding operation of the ASF 1.

In the ASF control portion 201, first of all, the program goes to a step S15, where a drive table T for the sheet feeding motor 27 optimum to the type of the sheet to be fed is read-in from the ROM 214 to the CPU 213 on the basis of the sheet type information received from the printer 101 together with the sheet feeding command signal. The drive table T includes information regarding a driving speed of the sheet feeding motor (pulse motor) 27 and registration pulse number P5 for rotating the sheet feeding roller 19 by an optimum amount depending upon the type of the sheet during the registration operation in a step S22 which will be described later. A several number of tables are prepared in consideration of possible sheet properties.

After the drive table T is read-in, the program in the ASF control portion 201 goes to a step S16, where "0" is set as initial values of variables defined by INIT, n, Pc. The variables are stored in the RAM 215. The INIT is a graph showing whether the phase of the sheet feeding roller 19 in the rotational direction is in an initial position or not, n is a rotation number counter indicating the number of rotations of the sheet feeding roller 19 after the sheet feeding flowchart C2 is started, and Pc is a pulse number counter indicating the number of pulses by which the sheet feeding motor 27 is rotated in the reverse direction.

Then, the program goes to a step S17, where the ASF control portion 201 drives the sheet feeding roller 19 by one pulse in the reverse direction via the sheet feeding motor driver 216. Then, the program goes to a step S18, where the value of the pulse number counter is increased by 1, then the program goes to a step S19. In the step S19, the ASF control portion 201 compares the value of the pulse number counter with allowable pulse number Pmax.

The allowable pulse number Pmax is a total number of pulses from when the sheet feeding motor 27 starts to rotate in the reverse direction to when the sheet feeding roller is rotated to the position where the non-toothed portion 19*b* of the sheet feeding roller gear is opposed to the reverse rotation planetary gear 35 (FIG. 27) to prevent the further rotation. Immediately after the sheet feeding is started, since a relationship Pc<Pmax is established, the program goes to a step S20. In the step S20, although the ASF control portion 201 ascertains the output voltage of the sheet end sensor 108 within the printer 101 via the port 44*h* (FIG. 26), since the sheet 200 does not yet reach the interior of the printer 101 immediately after the sheet feeding is started, the output voltage of the sheet end sensor 108 is in the LOW condition, and, thus, the program returns to the step S17. By repeating the steps S17 to S20 as mentioned above, the reverse rotation planetary gear 35 (FIG. 27) is revolved from the position shown by the broken line to the position shown by the solid line to be engaged by the sheet feeding roller gear 19*a*, thereby starting the rotation of the sheet feeding roller 19. When the sheet feeding roller 19 start to rotated from the initial phase condition, the cam portions 19*c* of the sheet feeding roller are disengaged from the cam portions 26*a* of the pressure plate, with the result that the pressure plate 26 is lifted by the pressure plate spring 13 to abut the sheet stack 200 rested on the pressure plate 26 against the sheet feeding rubber 23. In this case, the leading ends of the sheets urged against the abutment surface 36*a* of the bank 36 are also lifted and abut against a central portion of the bank sheet 37.

When the reverse rotation of the sheet feeding motor 27 is continued by repeating the steps S17 to S20 to rotate the sheet feeding roller 19, the sheet 200 starts to be conveyed by the friction force of the sheet feeding rubber 23, with the result that only the uppermost sheet is separated from the other sheets by flexing the bank sheet (elastic member) 37 by the leading ends of the sheets.

However, if the reverse rotation of the sheet feeding motor is continued until the vale of the pulse number counter Pc reaches a certain great number, since the relationship Pc<Pmax is not satisfied, the program goes from the step S19 to a step S24. In the step S24, the ASF control portion 201 drives the sheet feeding motor 27 by a predetermined pulse number P4 in the normal direction. The predetermined pulse number P4 is selected to a value sufficient to rotate the sheet feeding roller 19 to the initial position by the normal rotation planetary gear 31. That is to say, by executing the step S24, the sheet feeding roller 19 is rotated up to the phase which is a position obtained after just one revolution of the roller from the initial position. At that position, since the non-toothed portion 19*b* of the sheet feeding roller gear 19 is opposed to the normal rotation planetary gear 31, the gears are disengaged from each other, thereby stopping the sheet feeding roller gear. Then, the program goes to a step S25, where the value of the pulse number counter Pc is returned to "0" and the value of the rotation number counter n is increased by one, and the program goes to a step S26. In the step S26, since n=1 at this point, the program returns to the step S17, thereby starting the reverse rotation of the sheet feeding motor 27 again.

As mentioned above, the ASF control portion 201 executes the steps S17 to S20 repeatedly, with the result that the sheet feeding roller 19 starts to the second rotation to further convey the sheet 200. When the leading end of the sheet 200 reaches the sheet end sensor 108 within the printer 101, the output voltage of the sheet end sensor 108 is changed to the HIGH condition, and the program goes from the step S20 to a step S21. In the step S21, the ASF control portion 201 compares a value obtained adding the read-in registration pulse number P5 in the drive table T to the value of the pulse number counter Pc with the magnitude of the allowable pulse number Pmax. If Pc+P5≦Pmax, since the transmission of the reverse drive is not interrupted on the way even when the sheet feeding motor 27 is further rotated by P5 pulses in the reverse direction, the program goes to a step S22.

If Pc+P5>Pmax, if the sheet feeding motor 27 is further rotated by P5 pulses in the reverse direction, since the non-toothed portion 19*b* reaches the position where it is opposed to the reverse rotation planetary gear 35 on the way to interrupt the transmission of the driving force to the sheet feeding roller 19, the program goes to a step S24. In the step S24, the sheet feeding motor is rotated by P4 pulses in the normal direction again to return the sheet feeding roller 19 to the initial position. Then, in a step S25, 0 is inserted into the counter Pc and n+1 is inserted into the counter n, and the program goes to a step S26. Normally, during the second rotation of the sheet feeding roller 19, since the sheet 200 is detected by the sheet end sensor 108, at this point, n=2. The program returns to the step S17. At this point, since the output voltage of the sheet end sensor 108 becomes the HIGH condition and the pulse number counter Pc has been reset soon before, the program goes from the step S17 to the steps S18→S19→S20→S21. This time, since the relationship Pc+P5≦Pmax is satisfied, the program goes to a step S22.

The step S22 serves to effect the registration. In this step, the ASF control portion 201 drives the sheet feeding motor 27 in the reverse direction by the pulse number P5 in the read-in drive table T to rotate the sheet feeding roller 19. In this case, the leading end of the sheet 200 is further fed into the interior of the printer 101 from the position where the leading end is detected by the sheet end sensor 108 and is stopped by abutting against the nip between the LF roller 109 and the pinch roller 110 which are now stopped. However, the trailing end of the sheet 200 is further pushed by the sheet feeding roller 19. As a result, the tip end of the sheet 200 is aligned with the nip between the LF roller 109 and the pinch roller 110.

Then, the program goes to a step S23, where the ASF control portion 201 transmits a signal indicating completion of the sheet feeding to the printer 101 via the serial transmitting port 44*f*, and the operation is ended.

Incidentally, when the sheet is not rested on the pressure plate 26, even if the sheet feeding roller 19 is rotated permanently, the output voltage of the sheet end sensor 108 is not changed to the HIGH condition.

Thus, the ASF control portion 201 executes a loop comprised of the steps S17→S18→S19→S20→S17 repeatedly by several times, and then, after the operation in which the program is returned to the step S17 through the steps S19→S24→S25→S26 is repeated by two times, at the third time, when the program reaches the step S26, since the rotation number counter n for the sheet feeding roller 19 becomes "3", the program goes to a step S27, where the sheet feeding error signal is transmitted to the printer 101, and the operation is ended.

(The other operations of printer and ASF)

Figure 32:
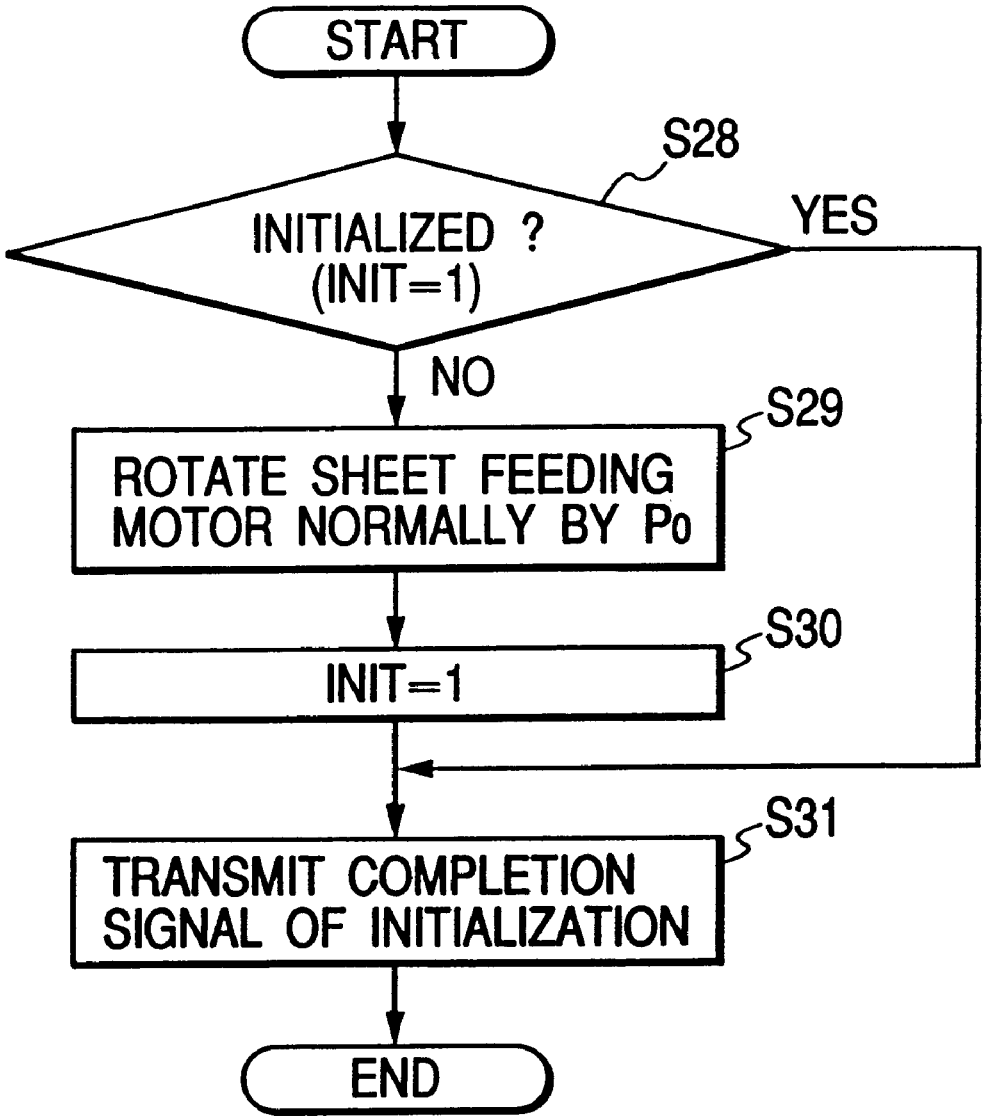
FIG. 32 is a sub flowchart C3 of initializing operation control in the ASF control portion.

FIG. 32 shows a sub flowchart C3 for controlling the initializing operation of the ASF 1. When the initialization command signal is received from the printer 101, in the ASF control portion 201, the program goes to a step S28, where a value of a flag INIT indicating whether the phase of the sheet feeding roller 19 in the rotational direction is in the initial position or not is ascertained. If INIT=1, since it is indicated that the sheet feeding roller 19 is in the initial position, the program goes to a step S31, where the initialization completion signal is transmitted to the printer 101, and the operation is ended. On the other hand, if INIT=0, the program goes to a step S29, the sheet feeding roller 19 is rotated by predetermined pulse number P0 in the normal direction. The predetermined pulse number P0 is selected to a value sufficient to rotate the non-toothed portion 19*b* to the position where it is opposed to the normal rotation planetary gear 31 thereby to rotate the sheet feeding roller 19 to its initial position regardless of the phase of the sheet feeding roller 19 in the rotational direction. Thus, by executing the step S29, the sheet feeding roller 19 is rotated to the initial position, and the pressure plate 26 is separated from the sheet feeding rubber 23 to permit the smooth setting of the sheets 200.

Then, the program goes to a step S30, where "1" is inserted into the flag INIT to indicate the fact that the sheet feeding roller is in the initial position. Then, the program goes to a step S31, where the initialization completion signal is transmitted to the printer 101, and the operation is ended.

Figure 33:
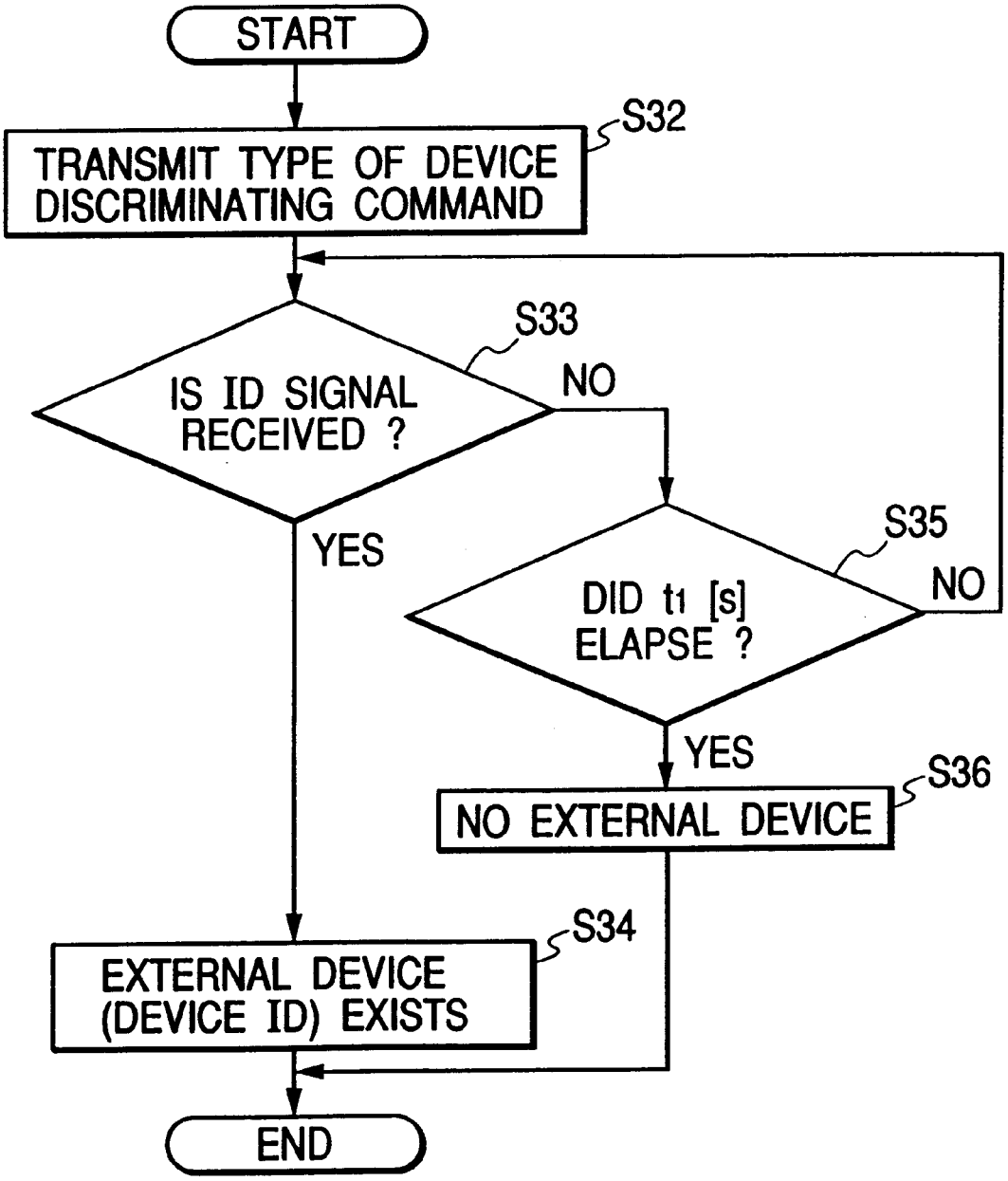
FIG. 33 is a sub flowchart C1 of type of device discriminating operation control in the printer control portion.

FIG. 33 is a sub flowchart C1 for discriminating the type of the device mounted on the printer 101 via the ports 117*f*, 117*g*. In the printer control portion 202, the program firstly goes to a step S32, where the type of device discriminating signal is transmitted to the external equipment through the port 117*g*. Then, the program goes to a step S33, where, if the response signal from the external equipment is not received through the port 117*f*, the program goes to a step S35. In the step S35, if a predetermined limit time period t1 is not elapsed, the program returns to the step S33. In the step S35, if the limit time period t1 is elapsed, the program goes to a step S36, where it is judged that the external equipment is not mounted, and the operation is ended.

Also, in the step S33, if the response signal from the external equipment is received, the program goes to a step S34. In the step S34, the printer control portion 202 reads a partial code ID indicating a type of the mounted device from the received response signal, and the operation is ended.

(Second Embodiment)

Figure 34:
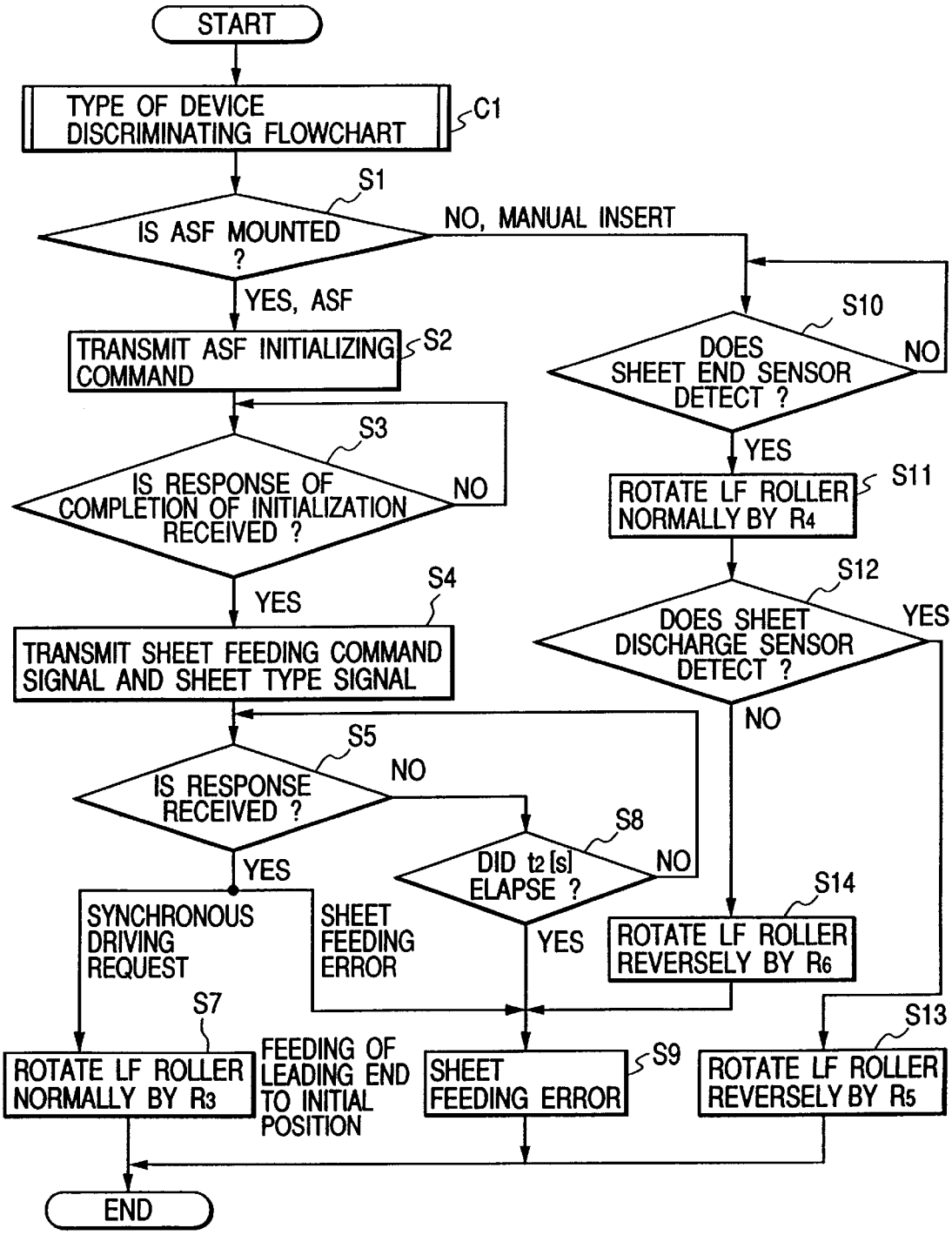
FIG. 34 is a control flowchart of a sheet feeding operation in a printer control portion according to a second embodiment.
Figure 35:
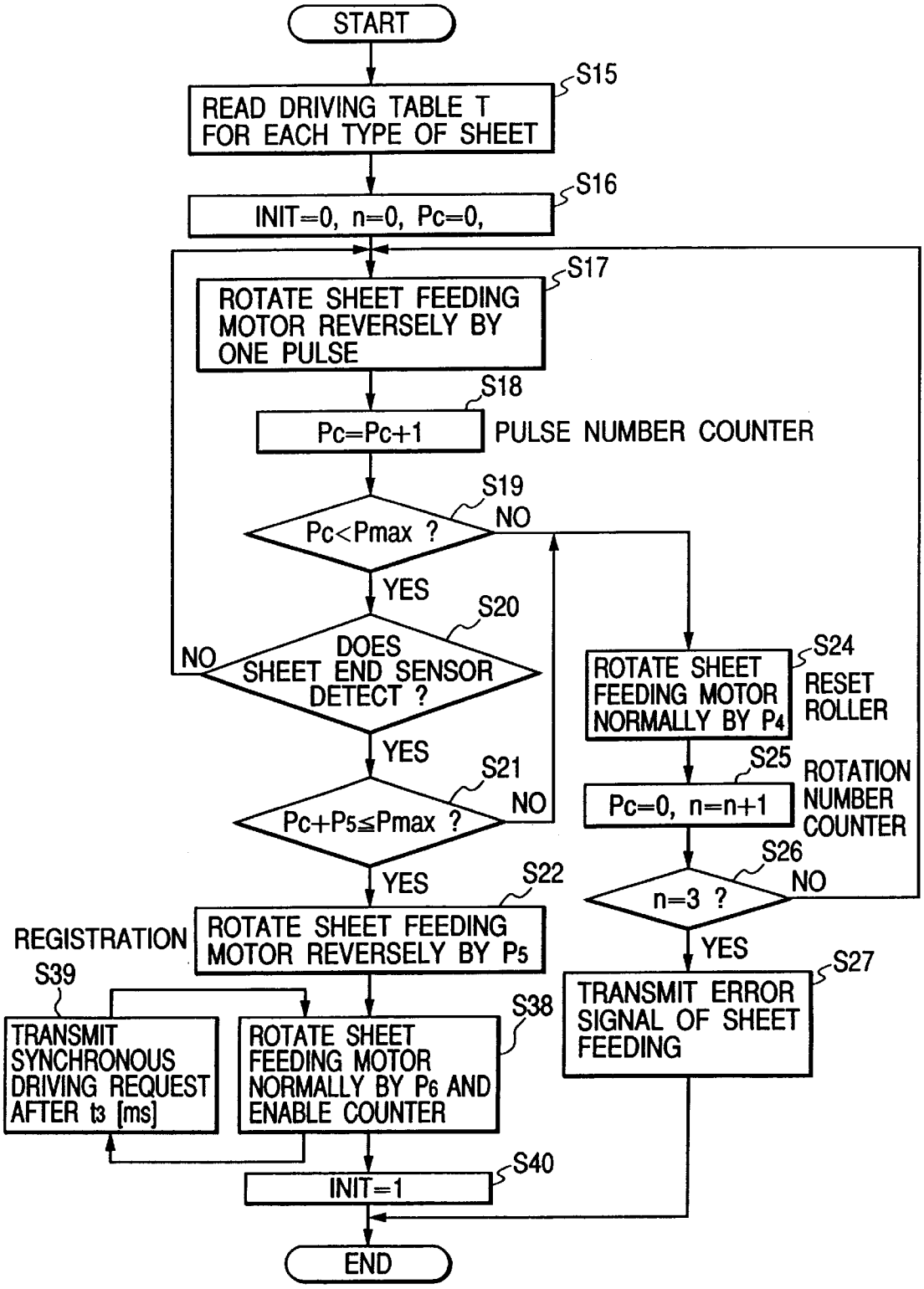
FIG. 35 is a sub flowchart C2 of sheet feeding operation control in the ASF control portion according to a second embodiment.

FIGS. 34 and 35 show a control flowchart for a printer and an ASF mountable to the printer from outside, according to a second embodiment of the present invention. Incidentally, the same elements and operations as those in the first embodiment will be designated by the same reference numerals, and detailed explanation thereof will be omitted.

Figure 36:
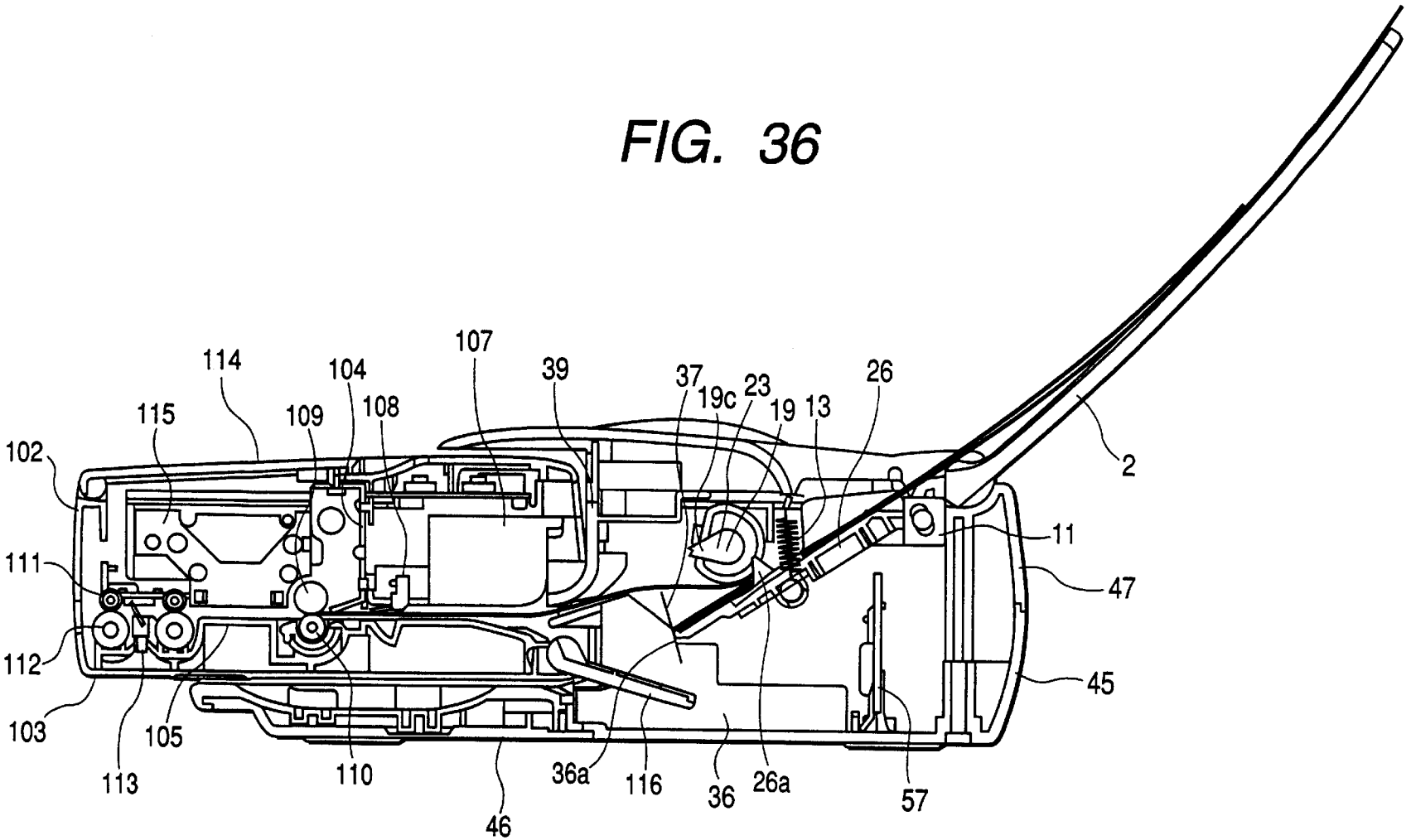
FIG. 36 is a schematic sectional view showing a condition that a step S22 is completed in the sheet feeding operation.

In the first embodiment, while an example that, as shown in FIG. 31, after the ASF control portion 201 drives the sheet feeding motor in the reverse direction by the P5 pulses in the step S22, the program goes to the step S23 where the sheet feeding completion signal is transmitted to the printer 101 was explained. However, in this case, since the sheet feeding roller 19 is not returned to its initial position, as shown in FIG. 36, the sheet feeding roller 19 is maintained to be urged against the sheet 200. In this condition, if the feeding of the leading end of the sheet to the initial position and the recording operation are effected only by the LF roller 109, back tension is generated by the sheet feeding roller 19, which may lead to worsen conveying accuracy of the sheet 200.

The second embodiment eliminates such inconvenience.

As shown in FIG. 35, after the ASF control portion 201 effects the registration in the step S22, the program goes to a step S38, where the sheet feeding motor 27 is rotated in the normal direction by a predetermined pulse number P6. The predetermined pulse number P6 is selected to a value sufficient to rotate the sheet feeding roller 19 to its initial position by the normal rotation planetary gear 31. At the same time when the normal rotation of the sheet feeding motor 27 is started, a counter for measuring a lapse time period from the start of the driving is operated. When a predetermined time period t3 is elapsed, the program goes to a step S39, where a synchronous driving request signal is transmitted to the printer 101. The predetermined time period t3 is selected to a time period slightly greater than a time period from when the sheet feeding motor 27 starts to rotate in the step S38 to when the normal rotation planetary gear 31 is revolved to be engaged by the sheet feeding roller gear 19*a* thereby to start the rotation of the sheet feeding roller 19.

Further, a speed for driving the sheet feeding motor 27 in the step S38 is selected so that a peripheral speed of the sheet feeding rubber 23 mounted on the sheet feeding roller 19 becomes slightly greater than a peripheral speed when the LF roller 109 of the printer is rotated in the step S7.

At the time when the step S38 is completed, the sheet feeding roller 19 is rotated up to the phase same as that in the initial position, and the program goes to a step S40. In the step S40, the ASF control portion 201 inserts "1" indicating the fact that the phase of the sheet feeding roller 19 in the rotational direction is in the initial condition into the INIT flag, and the operation is ended.

On the other hand, in the step S39, when the printer control portion 202 receives the synchronous driving request signal from the ASF control portion 201, the program goes from the step S5 in FIG. 34 to the step S7, thereby starting the normal rotation of the LF roller 109.

Figure 37:
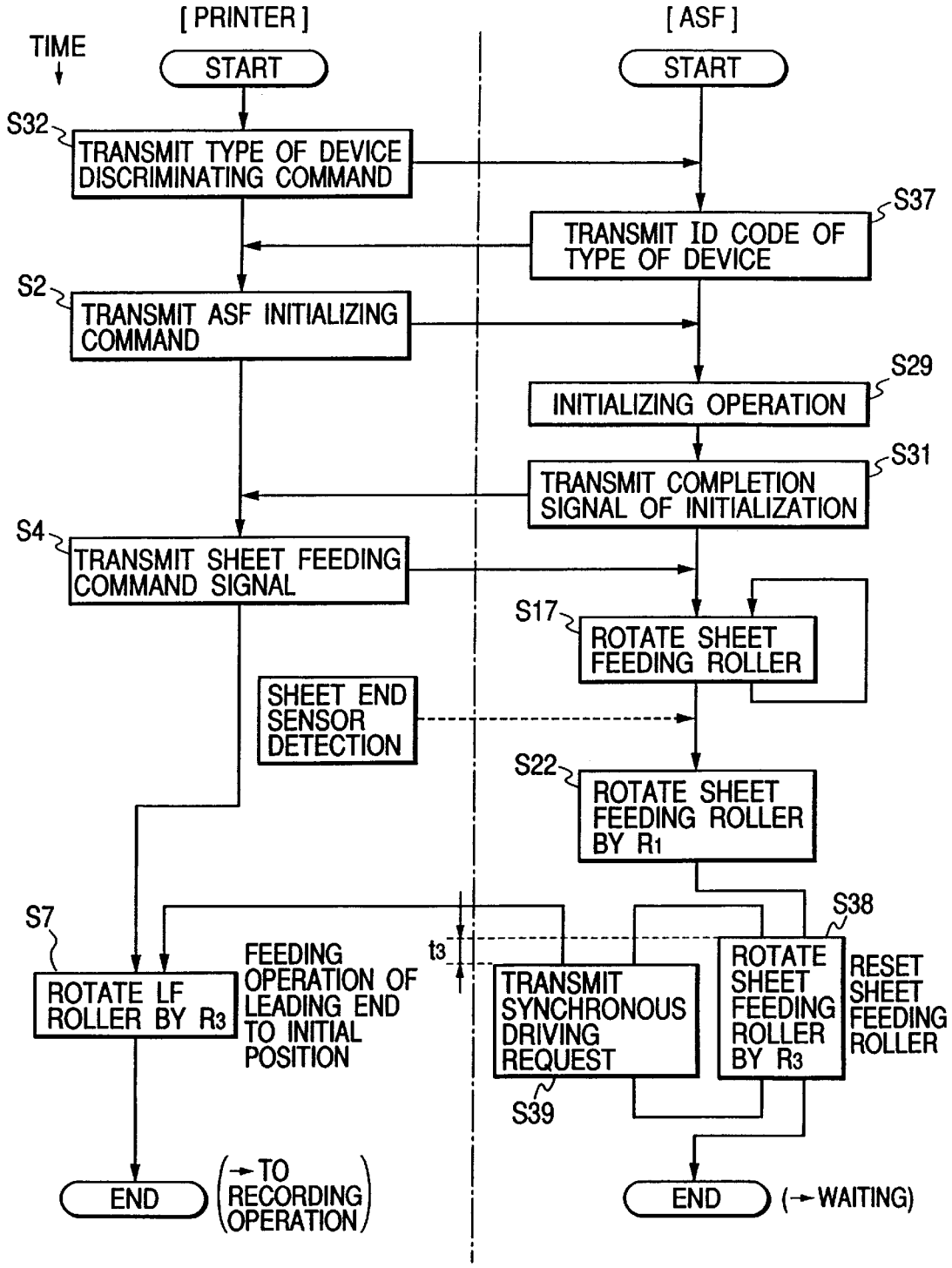
FIG. 37 is a time chart schematically showing flow of operations of the printer and the ASF in the second embodiment.

FIG. 37 is a time chart showing how the printer 101 and the ASF according to the illustrated embodiment are operated as the time goes on.

When the printer starts the sheet feeding operation, first of all, the type of device discriminating command signal is transmitted to the ASF (step S32). The ASF transmits signal ID indicating the type of device code of the ASF itself to the printer (step S37). Then, the printer transmits the ASF initialization command signal to the ASF (step S2), and, if the initialization condition is not achieved, the ASF rotates the sheet feeding roller to effect the initializing operation (step S29), and the initialization completion signal is transmitted to the printer (step S31). Then, the printer transmits the sheet feeding command signal to the ASF (step S4). The ASF reads-in the optimum drive table T on the basis of the sheet type information transmitted together with the sheet feeding command signal (steps S15 omitted in FIG. 37) and then drives the sheet feeding motor to rotate the sheet feeding roller on the basis of the sheet feeding operation control flowchart C2 (step S18). The output voltage of the sheet end sensor 108 of the printer is changed to the HIGH condition. When the sheet is detected, the ASF further rotates the sheet feeding roller by the rotation amount R1 associated with the pulse number P5 to effect the registration (step S22). After the registration is completed, the ASF further rotates the sheet feeding roller by the rotation amount R3 to return the sheet feeding roller to its initial condition (step S33). When the predetermined time period t3 is elapsed after the driving of the sheet feeding motor is started, the synchronous driving request signal is transmitted to the printer (step S39).

When the synchronous driving request signal is received from the ASF, the printer rotates the LF roller by the rotation amount R3 to effect the feeding of the leading end of the sheet to its initial position (step S7).

As apparent from the above-mentioned explanation, in the illustrated embodiment, in FIG. 36 showing the condition after the step S22 is completed, the sheet feeding roller 19 is rotated and, soon after, the LF roller 109 starts to be rotated. In this case, the peripheral speed of the sheet feeding rubber 23 is slightly greater than the peripheral speed of the LF roller 109. Accordingly, when the LF roller 109 starts to rotate to effect the feeding of the leading end of the sheet to its initial position in the step S7, since the sheet feeding rubber 23 urged against the sheet 200 has already been rotated soon before, back tension is not generated, and, since the peripheral speed of the sheet feeding rubber 23 is slightly greater than the peripheral speed of the LF roller 109, back tension due to difference in peripheral speed is not also generated, with the result that the conveying accuracy during the feeding of the leading end of the sheet 200 to its initial position is stabilized.

If the time period t3 is too small, the LF roller 109 may start to rotate before the transmission of the driving force of the sheet feeding motor 27 to the sheet feeding roller 19. Conversely, if the time period t3 is too great, the sheet feeding roller 19 may be rotated excessively before the LF roller 109 starts to rotate, with the result that the sheet 200 may be deformed on the way or the leading end of the sheet may not be aligned with the nip between the LF roller 109 and the pinch roller 110. On the basis of test results regarding the illustrated embodiment, it was found that the optimum value t3 is about 10 ms to 100 ms. When the peripheral speed of the sheet feeding rubber 23 mounted on the sheet feeding roller 19 is not so faster than the peripheral speed of the LF roller 109, if the sheet feeding rubber 23 is slipped due to particular type of sheet or environmental condition, the back tension may be generated; whereas, if the peripheral speed of the sheet feeding rubber 23 is too fast, the sheet 200 may be deformed. As a result of test results, it was found that it is optimum that the peripheral speed of the sheet feeding rubber 23 in the step S38 is greater than the peripheral speed of the LF roller 109 in the step S7 by about 5% to 50%.

In the illustrated embodiment, while the signal corresponding to the "sheet feeding completion signal" in the first embodiment was called as the "synchronous driving request signal" due to difference in meaning of operation, a signal same as the "sheet feeding completion signal" may be used as an actual signal. Accordingly, the sheet feeding operation control flowcharts in the first and second embodiments (FIGS. 29 and 34) are substantially the same. That is to say, the printer shown in the first embodiment can be mounted to both ASFs shown in the first and second embodiments.

Figures 38, 39:
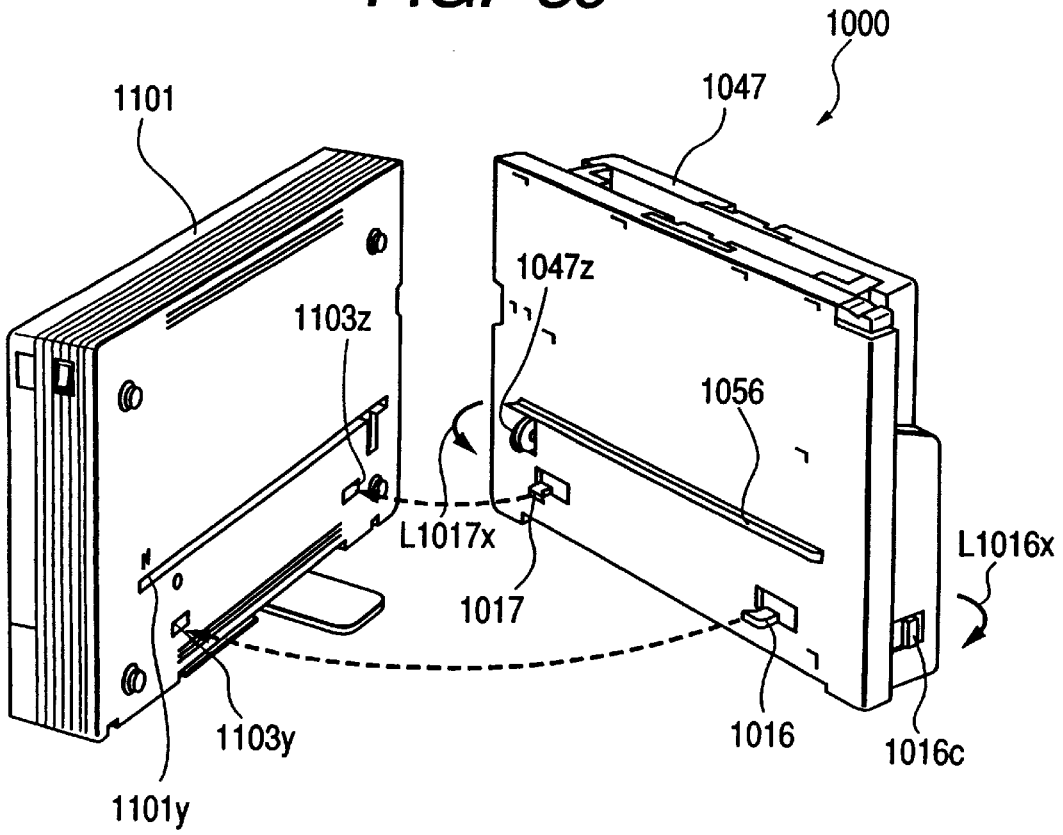
FIG. 38 is a Table showing contents of a drive table of a sheet feed motor.
FIG. 39 is a perspective view showing a conventional printer body and an ASF mounted to the printer body from outside, in a separated condition.

Now, the contents of the plurality of drive tables T in the second embodiment will be explained with reference to FIG. 38.

For example, when the sheet type information received by the ASF indicates the ordinary paper, the ASF control portion 201 selects the drive table T1. Regarding the ordinary paper, since a resistance force during the registration in the step S22 is small, the driving speed is set to a middle speed. Further, since the possibility of skew-feed of the sheet during the sheet feeding is less, it is not required that the amount for urging the sheet against the LF roller 109 is great, and, thus, the registration pulse number P5 is set to a small value.

When the sheet type information received by the ASF indicates the envelope, the ASF control portion 201 selects the drive table T3. Since the envelope has a great resistance during the sheet feeding and particularly a great resistance force during the registration in the step S22, the drive speed is selected to a low speed smaller than the middle speed not to cause out-of-phase of the sheet feeding motor 27, thereby ensuring great torque. Since the envelope may be skew-fed in comparison with other sheets, the registration pulse number P5 in the step S22 is set to a middle value greater than the small value for the ordinary paper in the table 1. As a result, since the amount for urging the leading end of the envelope against the LF roller 109 is increased, the registration of the envelope can surely be attained.

When the sheet type information received by the ASF indicates the glossy paper, the ASF control portion 201 selects the drive table T4. The glossy paper has a great resistance force during the registration but is hard to be skew-fed. Thus, in the table 4, the driving speed on registration is selected to a low speed, and the registration pulse number P5 is set to a small value similar to the ordinary paper.

When the sheet type information received by the ASF indicates the post card, the ASF control portion 201 selects the drive table T2. Regarding the post card, since a resistance force during the registration is not so great, the driving speed on registration is selected to a middle speed similar to the ordinary paper.

On the other hand, in FIG. 37, when the LF roller 109 of the printer and the sheet feeding roller 19 of the ASF are rotated simultaneously, the sheet such as the post card having high rigidity is hard to be deformed on the way. As a result, since the post card is pushed by the sheet feeding roller 19 having greater peripheral speed in opposition to the friction force of the LF roller 109 to convey the leading end of the post card by an amount greater than the rotation amount R3 of the LF roller, the correct recording may not be obtained. To avoid this, in the table T2, the registration pulse number P5 in the step S22 is set to a greatest value as much as possible. More specifically, the registration pulse number P5 is set to a variable determined by reverse rotation driving pulse number of the sheet feeding motor 27 required for detecting the sheet 200 by the sheet end sensor 108, which is indicated as P5=Pmax−Pc. Thus, whenever the sheet 200 is detected by the sheet end sensor 108, at the time when the execution of the step S22 in FIG. 35 is finished, the total of the reverse rotation driving pulse number of the sheet feeding motor 27 becomes Pmax. That is to say, the non-toothed portion 19*b* of the sheet feeding roller gear 19*a* is positively rotated up to the position where it is opposed to the reverse rotation planetary gear 35. Thus, after the completion of the step S22, the phase of the sheet feeding roller 19 in the rotational direction is greatly advanced from the initial position, so that, even when the sheet feeding roller 19 is rotated in the step S40, the phase of the sheet feeding roller 19 is returned to the initial position quickly. Accordingly, since the post card stack rested on the pressure plate 26 is quickly separated from the sheet feeding rubber 23 immediately after the synchronous driving between the LF roller 109 and the sheet feeding roller 19 is started, the sheet feeding roller 19 does not push the post card in opposition to the friction force of the LF roller 109.

When the sheet type information received by the ASF from the printer 101 indicates a type of a sheet not available to the ASF 1 or when the type of sheet is not designated, the ASF control portion 201 selects the drive table T5. In the illustrated embodiment, although the same values as those in the post card drive table T2 are stored in the drive table T5, in accordance with possible conditions, the same values as those in other table or values different from those in other table may be stored in the table T5.

As mentioned above, according to the present invention, when the recording apparatus is mounted, after the recording apparatus is rested on the recording apparatus supporting portion for supporting the recording apparatus, by shifting the recording apparatus in the mounting direction, the mounting ability can be improved. Further, by regulating the upward movement of the recording apparatus by the eaves portion during and after the mounting, the damage of the connecting portion to the recording apparatus can be prevented, and the dismounting and damage can also be prevented even if any force directing toward undesirable direction acts on the recording apparatus.

As mentioned above, in the sheet feeding apparatus according to the present invention, since the electrical connecting portions of the recording apparatus and the ASF are disposed between the pin and the connection releasing member near the pin, the mounting and dismounting between the recording apparatus and the ASF can easily be performed.

Further, since the electrical connecting portion is disposed between the first and second pins near the second pin and the fitting between the circular hole and the first pin is released before the fitting between the elongated hole and the second pin is released, the non-detachment between the circular hole and the first pin can be prevented, and damage of the positioning means and the electrical connecting portions can be prevented, and the mounting and dismounting between the recording apparatus and the ASF can easily be performed.

As mentioned above, according to the present invention, by manipulating the single operation member, the plurality of lock members are shifted integrally or simultaneously. Accordingly, the lock members can be disengaged from the engagement portions simultaneously, thereby facilitating the releasing operation.

Further, when the engagement between the lock members and the engagement portions is released by depressing the operation member downwardly, it is not required that the image forming apparatus itself should be kept stationary, thereby easily effecting the releasing operation by one hand.

In addition, since the plurality of lock members are shifted integrally or simultaneously and the operation member is engaged by at least one lock member, the operation member is not shifted to the proper position until all of the lock members are in the engaged condition. Accordingly, the engagement condition of the lock members can be ascertained on the basis of the position of the operation member.

On the other hand, when there is provided the protruded portion which is shifted substantially in the horizontal direction by pushing the operation member downwardly, the separation of the recording apparatus can be effected smoothly. Further, when the shifting movement of the protruded portion in the horizontal direction is effected after the lock members are shifted, the separation of the recording apparatus can be effected smoothly.

According to the present invention, the apparatuses can surely be positioned and interconnected by engagement between the pair of protruded shafts and the circular/elongated holes of the connection positioning means.

Further, when the engagement amount of the lock member near the circular hole is smaller than the engagement amount of the lock member near the elongated hole, the non-detachment between the circular hole and the protruded shaft can be prevented, thereby separating the apparatuses from each other smoothly.

In addition, since the biasing means of the spacing means pushes the periphery of the circular hole, the non-detachment between the circular hole and the protruded shaft can be prevented, thereby separating the apparatuses from each other smoothly.

Furthermore, it is not required for forcibly separating the apparatuses from each other, thereby preventing deformation of the apparatuses.

The printer and the ASF are surely be positioned by the engagement between the pair of protruded shafts and the circular/elongated holes of the connection positioning means, and, thereafter, since the apparatuses are separated from each other smoothly without non-detachment between the circular hole and the protruded shaft, there is no damage.

Further, it is not required for forcibly separating the printer and the ASF from each other, thereby preventing deformation of the printer and the ASF.

What is claimed is:

1. A sheet feeding apparatus to which a recording apparatus for recording an image on a recording medium by itself is detachably mountable and which feeds the recording medium to the mounted recording apparatus, comprising:

a recording apparatus supporting portion for supporting said recording apparatus for movement in a mounting direction when said recording apparatus is to be mounted; and an eaves portion disposed substantially in parallel with said recording apparatus supporting portion for regulating an upward movement of said recording apparatus when and after said recording apparatus is mounted, wherein a part of said recording apparatus is protruded from said recording apparatus supporting portion and said eaves portion in a direction opposite to the mounting direction when said recording apparatus is mounted to said sheet feeding apparatus.

2. A sheet feeding apparatus according to claim 1, wherein a length of said recording apparatus supporting portion in the mounting direction is a length for forming a space having a predetermined mounting direction length below said recording apparatus when said recording apparatus is mounted.

3. A sheet feeding apparatus according to claim 2, wherein the length L2 of said recording apparatus supporting portion in the mounting direction for forming said space below said recording apparatus has the following relationship with respect to a length L1 of said recording apparatus in the mounting direction:

$$L1/2 \leqq L2 \leqq L1-15 \text{ mm}.$$

4. A sheet feeding apparatus according to claim 3, wherein the relationship "$L1/2 \leqq L2 \leqq L1-15$ mm" is satisfied at least a part of said recording apparatus supporting portion in a direction perpendicular to the mounting direction.

5. A sheet feeding apparatus according to claim 1, wherein a length L3 of said eaves portion in the mounting direction has the following relationship with respect to the length L1 of said recording apparatus in a mounting direction:

$$L1/4 \leqq L3 \leqq L1/2.$$

6. A sheet feeding apparatus according to claim 5, wherein the relationship "$L1/4 \leqq L3 \leqq L1/2$" is satisfied at least a part of said eaves portion in a direction perpendicular to the mounting direction.

7. A sheet feeding apparatus according to claims 1 or 2, wherein said recording apparatus supporting portion has sliding portions for slidingly contacting with said recording apparatus at both ends thereof in the direction perpendicular to the mounting direction, and a stepped portion is provided between said sliding portions.

8. A sheet feeding apparatus according to claim 7, wherein said stepped portion has a position and depth so that said recording apparatus supporting portion is not contacted with projections protruded from a lower surface of said recording apparatus when said recording apparatus is shifted in the mounting direction.

9. A sheet feeding apparatus having an apparatus body to which a recording apparatus for recoding an image on a sheet by itself is detachably mountable and feeding the sheet to said recording apparatus mounted to said apparatus body, comprising:

connecting means for connecting said recording apparatus to said apparatus body, said connecting means including an elongated hole formed in one of said recording apparatus and said apparatus body, a pin provided on the other of said recording apparatus and said apparatus body and connectable to said elongated hole, and a connection releasing member provided on either one of said recording apparatus of said apparatus body and biased toward a connection releasing direction; and an electrical connecting portion of said recording apparatus or said apparatus body being disposed near said pin between said connection releasing member and said pin.

10. A sheet feeding apparatus according to claim 9, further comprising lock means provided on either one of said recording apparatus and said apparatus body and connectable to the other of said recording apparatus and said apparatus body, and wherein, after the connection between said recording apparatus and said apparatus body effected by said lock means is released, said connection releasing member is operated toward the connection releasing direction, thereby releasing the connection between said elongated hole and said pin.

11. A sheet feeding apparatus according to claim 10, further comprising a protruded member at a side of connection between said elongated hole and said pin, and wherein, after the connection between said recording apparatus and said apparatus body effected by said lock means is released, said connection releasing member is operated toward the connection releasing direction, thereby releasing the connection between said elongated hole and said pin and operating said protruded member.

12. A sheet feeding apparatus having an apparatus body to which a recording apparatus for recording an image on a sheet by itself is detachably mountable and feeding the sheet to said recording apparatus mounted to said apparatus body, comprising:

connecting means for connecting said recording apparatus to said apparatus body, said connecting means including a circular hole and an elongated hole formed in one of said recording apparatus and said apparatus body, first and second pins provided on the other of said recording apparatus and said apparatus body, first and second pins provided on the other of said recording apparatus and said apparatus body and connectable to said circular hole and said elongated hole, respectively, and first and second connection releasing members provided in the vicinity of said first and second pins and biased toward a connection releasing direction; and wherein said connecting means is designed so that the connection between said circular hole and said first pin is released before the connection between said elongated hole and said second pin is released, and electrical connecting portions of said recording apparatus and said apparatus body are disposed in the vicinity of said second pin between said first and second pins.

13. A sheet feeding apparatus according to claim 12, wherein a ratio between a distance X1 from said second pin to said electrical connecting portions and a distance X2 from said second pin to said first connection releasing member is 0.5 or less.

14. A sheet feeding apparatus according to claim 12, wherein said second connection releasing member is spaced apart from the connecting position between said circular hole and said first pin more than said electrical connecting portions.

15. An image forming apparatus comprising:

a sheet feeding apparatus for feeding a sheet; and a recording apparatus for recording an image on the sheet fed by said sheet feeding apparatus;

said sheet feeding apparatus and said recording apparatus being separatable from each other; and wherein one of said sheet feeding apparatus and said recording apparatus has a plurality of lock members movably supported, and an operation member engaged by at least one of said lock members and movably supported, so that said plurality of lock members are moved integrally by manipulating said operation member; and wherein said sheet feeding apparatus or said recording apparatus not having said lock members has a plurality of engagement portions with which said plurality of lock members are engaged, so that said sheet feeding apparatus and said recording apparatus are interconnected by engaging said lock members with said engagement portions, and engagement between said lock members and said engagement portions is released by moving said lock members via said operation member.

16. An image forming apparatus according to claim 15, wherein each of said lock members is a pawl-shaped member and each of said engagement portions is a hole.

17. An image forming apparatus according to claim 15 or 16, wherein said lock members are rotatably supported.

18. An image forming apparatus according to claim 15 or 16, wherein said lock members and said operation member are provided on said sheet feeding apparatus and said engagement portions are provided in said recording apparatus.

19. An image forming apparatus according to claim 18, wherein said sheet feeding apparatus has a horizontal guide surface for determining a shifting direction of said recording apparatus when said recording apparatus is mounted, and said lock members are arranged to protrude upwardly from said guide surface so that said lock members are moved downwardly by lowering said operation member thereby to release the engagement between said lock members and said engagement portions.

20. An image forming apparatus according to claim 19, wherein said lock members are biased by an elastic member toward a direction along which said lock members are engaged by said engagement portions, so that, when said lock members are engaged with said engagement portions, said elastic member moves said operation member via said lock members.

21. An image forming apparatus according to claim 20, wherein said elastic member comprises a spring.

22. An image forming apparatus according to claim 21, wherein said elastic member comprises a coil spring.

23. An image forming apparatus according to claim 18, wherein said sheet feeding apparatus has a protruded portion connected to said operation member and supported for shifting movement substantially in a horizontal direction, so that said recording apparatus is shifted in the horizontal direction by shifting said protruded portion substantially in the horizontal direction by lowering said operation member.

24. An image forming apparatus according to claim 23, wherein the shifting movement of said protruded portion substantially in the horizontal direction is effected after the movement of said lock member, thereby separating said recording apparatus from said sheet feeding apparatus.

25. An image forming apparatus according to claim 15 or 16, wherein said lock members and said operation member are provided on said recording apparatus and said engagement portions are provided in said sheet feeding apparatus.

26. A mount/dismount connecting mechanism comprising:

connection means for detachably interconnecting apparatuses;

connection positioning means in which a circular hole and an elongated hole formed in one of said apparatuses are engaged with a pair of protruded shafts provided on the other apparatus to determine a relative connection position between said apparatuses;

connection releasing means for releasing a connecting condition of said connection means interconnecting said apparatuses; and spacing means for biasing the interconnected apparatuses toward a separating direction; and wherein said connection means has a pair of lock members for interconnecting said apparatuses in the vicinity of said elongated hole and said circular hole, and said lock member disposed in the vicinity of said circular hole releases the connection before said lock member disposed in the vicinity of said elongated hole releases the connection.

27. A mount/dismount connecting mechanism according to claim 26, wherein said pair of lock members are provided on the other apparatus, and an engagement amount between said lock member disposed in the vicinity of said circular hole and said one apparatus is smaller than an engagement amount between said lock member disposed in the vicinity of said elongated hole and said one apparatus.

28. A mount/dismount connecting mechanism according to claim 26 or 27, wherein said spacing means has a biasing member biased to be protruded in the vicinity of said circular hole rather than said elongated hole in a condition that said apparatuses are interconnected.

29. A mount/dismount connection mechanism according to claim 26 or 27, wherein said spacing member has a pair of biasing members biased to be protruded in the vicinity of said circular hole and said elongated hole in a condition that said apparatuses are interconnected.

30. A mount/dismount connecting mechanism according to claims 26 or 27 further including a recording apparatus wherein one of two apparatuses is a sheet feeding apparatus for feeding a sheet and the other apparatus is a recording apparatus for forming an image on the sheet fed from said sheet feeding apparatus, and said sheet feeding apparatus and said recording apparatus are interconnected by said mount/dismount connecting mechanism.

31. A sheet feeding apparatus to which a recording apparatus is detachably mountable and which feeds a sheet to the mounted recording apparatus, comprising:

a supporting portion on which the recording apparatus is to be rested; and a regulating member for regulating an upward movement of the recording apparatus rested on said supporting portion, wherein the recording apparatus has a case provided with an inlet for the sheet, the case including therein conveying means for conveying the sheet inserted from the inlet and recording means for recoding an image on the sheet conveyed by the conveying means, whereby the recording apparatus can record the image on the sheet by itself.

32. A sheet feeding apparatus according to claim 31, wherein the recording apparatus is moved in a predetermined mounting direction while rested on said supporting portion so that the recording apparatus is mounted to said sheet feeding apparatus.

33. A sheet feeding apparatus according to claim 32, wherein said predetermined mounting direction is substantially in a horizontal direction.

34. A sheet feeding apparatus according to claim 32 or 33, wherein a part of the recording apparatus is protruded from said supporting portion in a direction opposite to said predetermined mounting direction when the recording apparatus is mounted to said sheet feeding apparatus.

35. A sheet feeding apparatus according to claim 32 or 33, further comprising:

locking means for locking the recording apparatus in a state that the recording apparatus is mounted to said sheet feeding apparatus; and urging means for pushing out the recording apparatus in a direction opposite to said predetermined mounting direction when a lock of said locking means is released.

36. A sheet feeding apparatus according to claim 35, further comprising protruding means for pushing out the recording apparatus manually in cooperation with said urging means.

* * * * *

UNITED STATES PATENT AND TRADEMARK OFFICE

CERTIFICATE OF CORRECTION

PATENT NO. : 6,200,043 B1
DATED : March 13, 2001
INVENTOR(S) : Hiroyuki Inoue, et al.

It is certified that error appears in the above-identified patent and that said Letters Patent is hereby corrected as shown below:

Column 9,
Line 45, "to be" should be deleted.

Column 14,
Line 4, "positions" should read -- position --.

Column 15,
Line 36, "remains" should read -- remain --.
Line 63, "edges" should read -- edge --.

Column 25,
Line 64, "provided. (Control portion)" should read -- provided. ¶ (Control portion) --.

Column 39,
Line 19, "be" should read -- to be --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*